US007465533B2

(12) United States Patent
Sakai et al.

(10) Patent No.: US 7,465,533 B2
(45) **Date of Patent: *Dec. 16, 2008**

(54) PHOTOTHERMOGRAPHIC MATERIAL AND AN IMAGE FORMING METHOD

(75) Inventors: Minoru Sakai, Minami-Ashigara (JP); Yoshihisa Tsukada, Minami-Ashigara (JP)

(73) Assignee: FUJIFILM Corporporation, Tokyo (JP)

( * ) Notice: Subject to any disclaimer, the term of this patent is extended or adjusted under 35 U.S.C. 154(b) by 24 days.

This patent is subject to a terminal disclaimer.

(21) Appl. No.: 11/727,317

(22) Filed: Mar. 26, 2007

(65) Prior Publication Data

US 2007/0178417 A1 Aug. 2, 2007

Related U.S. Application Data

(63) Continuation-in-part of application No. 11/228,341, filed on Sep. 19, 2005, now abandoned.

(30) Foreign Application Priority Data

Sep. 22, 2004 (JP) ..... 2004-276098
Jul. 27, 2005 (JP) ..... 2005-218029

(51) Int. Cl.

| | |
|---|---|
| ***G03C 5/16*** | (2006.01) |
| ***G03C 1/00*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/348; 430/349; 430/350; 430/351; 430/617; 430/618; 430/619; 430/620; 430/523; 430/531; 430/536

(58) Field of Classification Search ..... 430/348–351, 430/617–620, 523, 531, 536
See application file for complete search history.

(56) References Cited

U.S. PATENT DOCUMENTS

| | | | | |
|---|---|---|---|---|
| 6,004,735 | A | 12/1999 | Schell et al. | |
| 6,713,241 | B2 | 3/2004 | Vaeth et al. | |
| 7,172,857 | B2 * | 2/2007 | Sakai et al. | 430/617 |
| 2004/0063049 | A1 * | 4/2004 | Nakajima et al. | 430/536 |
| 2004/0161714 | A1 | 8/2004 | Suzuki | |
| 2006/0073429 | A1 | 4/2006 | Sakai et al. | |

FOREIGN PATENT DOCUMENTS

JP 2004-309641 A 11/2004

* cited by examiner

*Primary Examiner*—Geraldina Visconti
(74) *Attorney, Agent, or Firm*—Margaret A. Burke; Sheldon J. Moss

(57) ABSTRACT

A photothermographic material having a support, an image forming layer which is disposed on the support and contains at least a photosensitive silver halide, a non-photosensitive organic silver salt, a reducing agent, and a binder, at least one non-photosensitive layer which is disposed on the same side of the support as the image forming layer and farther from the support than the image forming layer, and a back layer which includes at least another non-photosensitive layer and is disposed on the opposite side of the support from the image forming layer, wherein the back layer contains a fluorocarbon polymer having a monomer component represented by the following (M2):
(M2) a monomer containing a fluorine atom and having an unsaturated bond capable of radical polymerization.

An image forming method is also provided.

19 Claims, No Drawings

PHOTOTHERMOGRAPHIC MATERIAL AND AN IMAGE FORMING METHOD

CROSS-REFERENCE TO RELATED APPLICATION

This application is a continuation-in-part of U.S. patent application Ser. No. 11/228,341, filed Sep. 19, 2005 now abandoned which claims priority under 35 U.S.C. 119 from Japanese Patent Application Nos. 2004-276098 and 2005-218029, the disclosures of which are incorporated by reference herein.

BACKGROUND OF THE INVENTION

1. Field of the Invention

The present invention relates to a photothermographic material and an image forming method.

2. Description of the Related Art

In recent years, in the field of films for medical diagnosis and in the field of films for graphic arts, there has been a strong desire for decreasing the amount of processing liquid waste from the viewpoints of protecting the environment and economy of space. Technology is therefore required for light sensitive photothermographic materials which can be exposed effectively by laser image setters or laser imagers and thermally developed to obtain clear black-toned images of high resolution and sharpness, for use in medical diagnostic applications and for use in photographic technical applications. The light sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are described, for example, in U.S. Pat. Nos. 3,152,904 and 3,457,075, as well as in "Thermally Processed Silver Systems" by D. H. Klosterboer, appearing in "Imaging Processes and Materials", Neblette, 8th edition, edited by J. Sturge, V. Warlworth, and A. Shepp, Chapter 9, pages 279 to 291, 1989. All of the patents, patent publications, and non-patent literature cited in the specification are hereby expressly incorporated by reference herein. In particular, photothermographic materials generally have an image forming layer including a catalytically active amount of a photocatalyst (for example, silver halide), a reducing agent, a reducible silver salt (for example, an organic silver salt), and if necessary, a toner for controlling the color tone of developed silver images, dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region.

Methods of manufacturing such a photothermographic material using an organic silver salt include a method of manufacturing by a solvent coating, and a method of coating an aqueous coating solution using an aqueous dispersion of fine polymer particles or an aqueous solution of a water-soluble polymer as a main binder followed by drying. Since the latter method does not require a process of solvent recovery or the like, a production facility therefore is simple and the method is advantageous for mass production.

In the case of the photothermographic material having an aqueous-based coated image forming layer utilizing organic silver salts described above, the use of hydrophobic polymer latex as the main binder for the image forming layer to avoid adverse influence by moisture on photographic properties is disclosed in Japanese Patent Application Laid-Open (JP-A) No. 10-10670, and the additional improvement thereof leads to formation of a clear image. However, under various utilization conditions, such as storing the photothermographic material at high temperature and humidity, the surfaces of the photothermographic material are liable to be adhered to each other, whereby separation thereof often causes defects such as the image forming layer being scratched or peeled off, and therefore improvement is needed.

Problems such as the defects described above are easily generated especially when a hydrophilic polymer derived from animal protein (for example, gelatin) is used in the outermost layer. A method for improvement is disclosed in JP-A No. 2002-162712, but the improvement does not reach a sufficient level and has a negative impact on lowering Dmax and deterioration in brittleness of the film. There is therefore a need in the art for improved photothermographic materials which do not exhibit the above negative effects.

In a process of thermal development, a photothermographic material is brought to contact with a heating means at a thermal developing section at a back surface or a surface having an image forming layer of the photothermographic material. As the heating means, either a drum type heater or a plate type heater can be used. A preferable process of thermal development by a plate type heater is described in JP-A No. 11-133572, which discloses a thermal developing apparatus in which a visible image is obtained by bringing an imagewise exposed photothermographic material into contact with a heating means at a thermal developing section, wherein the heating means comprises a plate heater, and a plurality of pressing rollers which are oppositely provided along one surface of the plate heater.

The back surface which contacts with the heating means is modified to contain a lubricant and a fluorine-containing surface wetting agent in a layer coated at the back surface for lowering friction resistance of the back surface and transporting smoothly the photothermographic material.

However, these materials added in the back layer are transferred in part during the thermal developing to the heating means, and accumulated on a surface of the heating means, and therefore it results in an unevenness of a developed image or an occurrence of jamming trouble by slipping due to insufficient transportability.

Therefore, a means to improve the transportability which can transport smoothly the photothermographic material during the thermal developing without these troubles is expected.

SUMMARY OF THE INVENTION

An aspect of the invention is to provide a photothermographic material comprising a support, an image forming layer which is disposed on the support and comprises at least a photosensitive silver halide, a non-photosensitive organic silver salt, a reducing agent, and a binder, at least one non-photosensitive layer which is disposed on the same side of the support as the image forming layer and farther from the support than the image forming layer, and a back layer which comprises at least another non-photosensitive layer and is disposed on the opposite side of the support from the image forming layer, wherein the back layer contains a fluorocarbon polymer having a monomer component represented by the following (M2):

(M2) a monomer containing a fluorine atom and having an unsaturated bond capable of radical polymerization.

DETAILED DESCRIPTION OF THE INVENTION

An object of the present invention is to provide a photothermographic material excellent in adhesion resistance during storage, and an image forming method providing an excellent transportability and no contamination of heating means during a thermal development.

The photothermographic material of the present invention comprises a support, an image forming layer which is disposed on the support and comprises at least a photosensitive silver halide, a non-photosensitive organic silver salt, a reducing agent, and a binder, at least one non-photosensitive layer which is disposed on the same side of the support as the image forming layer and farther from the support than the image forming layer, and a back layer which comprises at least another non-photosensitive layer and is disposed on the opposite side of the support from the image forming layer, wherein the back layer contains a fluorocarbon polymer having at least a monomer component represented by the following (M2):

(M2) a monomer containing a fluorine atom and having an unsaturated bond capable of radical polymerization.

Preferably, the fluorocarbon polymer further contains a monomer component represented by the following (M1):

(M1) a monomer having a group capable of forming a salt or a poly(alkylene oxide) group and having an unsaturated bond capable of radical polymerization.

Further, it is more preferred that the fluorocarbon polymer has a monomer component (M3) which is different from either of (M1) and (M2) described above.

The monomer component represented by (M2) described above is preferably a fluorine atom-containing acrylate, a derivative thereof, a fluorine atom-containing methacrylate, or a derivative thereof. More preferably, the monomer component represented by (M2) is a monomer component represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 to 41 fluorine atoms, p represents 1 or 2, L represents a linking group containing 1 to 12 carbon atoms, and R represents a hydrogen atom or a methyl group.

In the fluorocarbon polymer, a content of the monomer component represented by (M2) described above is preferably 5% by weight or higher, and more preferably 20% by weight or higher.

Photothermographic material contains all chemicals necessary for development in the photothermographic material itself, and therefore, photothermographic materials have an advantage of eliminating the use of wet processing chemicals. Namely, all chemicals required for development are incorporated, in advance, in the photothermographic material, and development is carried out by the operation of these chemicals at the time of thermal development. Various components are incorporated into the photothermographic material in the form of a solution, a solid dispersion or an emulsion, so that the content of water-soluble components or the content of salts is so abundant that the material is in a state where it is easily moistened. Further, in order to carry out mass production of photothermographic materials stably, a hydrophilic binder having setting ability depending on temperature, such as gelatin, is preferably used for both of the surface protective layer which is disposed at an outer side of the image forming layer on the image forming layer side and the back layer. Therefore, in addition to the above defect, the adhesion property thereof is likely to be worsened. As a result, under conditions such as storing the photothermographic materials under high temperature and humidity, the surfaces of the materials are adhered to each other, whereby separation thereof often causes defects such as the image forming layer being scratched or peeled off. Thus, further improvement thereof is demanded.

The inventors have conducted intense research to solve the problems described above. As a result of researching means for improving the adhesion property of a photothermographic material without adversely influencing the material in other ways, the inventors succeeded in attaining a significant improvement in adhesion resistance by using a specific copolymer having a fluorine atom in the outermost layer on the backside.

The present invention provides a photothermographic material which exhibits excellent resistance to adhesion during storage.

The photothermographic material of the present invention includes a specific copolymer having a fluorine atom in the outermost layer on the backside, and the other factors are not particularly limited.

If the compound described above is added in the outermost layer disposed on the image forming layer side, there are cases where the negative electric charge of the film surface is increased, whereby dust is attracted during handling of the photothermographic material before thermal development, conveying of the material in the thermal developing process, or the like, which prevents development at these portions to form pinholes, and thus this is not preferred. Therefore the use of the compound in the backside can obtain the desired performance without causing the adverse effects described above.

First, a layer constitution of the photothermographic material of the present invention is described, and then constituent components of each layer are described.

1. Layer Constitution

The photothermographic material according to the invention has a non-photosensitive outermost layer which is disposed on the image forming layer side with respect to the support and a non-photosensitive outermost layer which is disposed on the backside.

Generally, non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

In the present invention, a polymer containing a fluorine atom according to the invention is contained in the outermost layer of the back layer which is classified in (d).

Furthermore, a layer that functions as an optical filter may be provided as (a) or (b) above. An antihalation layer may be provided as (c) or (d) to the photothermographic material.

The photothermographic material of the present invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components are incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the image forming layers as described in U.S. Pat. No. 4,460,681.

2. Constituent Components of each Layer 2-1. Outermost Layer (Fluorine Atom-Containing Copolymer)

In the present invention, the photothermographic material includes a polymer having at least a monomer component represented by the following (M2) in the outermost layer on the backside, and the other factors are not particularly limited.

(M2) a monomer containing a fluorine atom and having an unsaturated bond capable of radical polymerization.

The polymer preferably contains the monomer component represented by (M2) in an amount of 5% by weight or more, and more preferably 20% by weight or more.

It is more preferred that the fluorocarbon polymer further contains a monomer component represented by the following (M1):

(M1) a monomer having a group capable of forming a salt or a poly(alkylene oxide) group and having an unsaturated bond capable of radical polymerization.

Further, it is even more preferred that the fluorocarbon polymer has a monomer component (M3) which is different from either of (M1) and (M2) described above.

In the fluorocarbon polymer, a content of the monomer component represented by formula (M1) described above is preferably within a range of from 0.1% by weight to 20% by weight, and more preferably from 0.5% by weight to 10% by weight. In the fluorocarbon polymer, a content of the monomer component represented by formula (M3) having an unsaturated bond capable of radical polymerization which is different from either of (M1) and (M2) described above is preferably within a range of from 0.5% by weight to 95% by weight, and more preferably from 5.0% by weight to 80% by weight.

In the fluorocarbon polymer, (M1):(M2):(M3)=0% by weight to 20% by weight:5% by weight to 10% by weight:0% by weight to 95% by weight is preferable, and more preferable is (M1):(M2):(M3)=0% by weight to 10% by weight: 20% by weight to 100% by weight: 0% by weight to 80% by weight.

As the monomer having a group capable of forming a salt in (M1), an anionic monomer, a cationic monomer, and an amphoteric monomer can be described, and as the monomer having a poly(alkylene oxide) group in (M1), nonionic monomer can be described. In more detail, examples of the anionic monomer include an unsaturated carboxylic acid monomer, an unsaturated sulfonic acid monomer, an unsaturated phosphoric acid monomer, and the like; examples of the cationic monomer include an unsaturated tert-amine-containing monomer, an unsaturated ammonium salt-containing monomer, and the like; examples of the amphoteric monomer include N-(3-sulfopropyl)-N-methacryloyl oxyethyl-N,N-dimethylammonium betaine, N-(3-sulfopropyl)-N-metahcrylolyl amidopropyl-N,N-dimethyl ammonium betaine, 1-(3-sulfopropyl)-2-vinyl pyridinium betaine, and the like; examples of the non-ionic monomer include an unsaturated poly(oxyethylene oxide)monomer, an unsaturated poly(oxypropylene oxide)monomer, and the like.

Specifically, for the anionic monomer, examples of the unsaturated carboxylic acid monomer include acrylic acid, methacrylic acid, crotonic acid, itaconic acid, maleic acid, fumaric acid, their anhydrides, and their monoalkyl ester, and examples of the vinyl ethers include carboxyethyl vinylether, carboxypropyl vinylether, and the like.

Examples of the unsaturated sulfonic acid monomer include styrene sulfonic acid, 2-acrylicamide-2-methylpropane sulfonic acid, 3-sulfopropyl methacrylic acid ester, bis-(3-sulfopropyl)-itaconic acid ester, and the like, and salts thereof, and also sulfuric acid monoester of 2-hydroxyethyl methacrylic acid and a salt thereof.

Examples of the unsaturated phosphoric acid monomer include vinyl phosphonic acid, vinyl phosphate, acid phosphoxyethyl methacrylate, acid phosphoxypropyl methacrylate, bis (methacryloxy ethyl)phosphate, diphenyl-2-methacryloyloxy ethyl phosphate, diphenyl-2-methacrylolyoxy ethyl phosphate, dibutyl-2-methacryloyloxy ethyl phosphate, dibutyl-2-acryloyloxy ethyl phosphate, dioctyl-2-methacrylolyoxy ethyl phosphate and the like.

Examples of the cationic monomer include unsaturated tert-amine-containing monomer, unsaturated ammonium salt-containing monomer, and the like. Specifically, examples include mono-vinyl pyridines such as vinyl pyridine, 2-methyl-5-vinyl pyridine, 2-ethyl-5-vinyl pyridine, and the like; styrenes having a dialkyl amino group such as N,N-dimethylamino styrene, and N,N-dimethylamino methyl styrene; esters having a dialkylamino group of acrylic acid or methacrylic acid such as N,N-dimethylamino ethyl methacrylate, N,N-dimethylamino ethyl acrylate, N,N-diethylamino ethyl methacrylate, N,N-diethylamino ethyl acrylate, N,N-dimethylamino propyl methacrylate, N,N-dimethylamino propyl acrylate, N,N-diethylamino propyl methacrylate, N,N-diethylamino propyl acrylate; vinyl ethers having a dialkylamino group such as 2-dimethylamino ethyl vinyl ether; acrylamides or methacrylamides having a dialkylamino group such as N-(N',N'-dimethylamino ethyl)methacrylamide, N-(N',N'-dimethylamino ethyl)acrylamide, N-(N',N'-diethylamino ethyl) methacrylamide, N-(N',N'-diethylamino ethyl)acrylamide, N-(N',N'-dimethylamino propyl)methacrylamide, N-(N',N'-dimethylamino propyl)acrylamide, N-(N',N'-diethylamino propyl)methacrylamide, N-(N',N'-diethylamino propyl)acrylamide, and quaternized compounds by well-known quaternizing agent such as a halogenated alkyl compound (with an alkyl group having 1 to 18 carbon atoms, and as halogen, chloride, bromide, or iodide), halogenated benzyl compounds such as, for example, benzyl chloride, or benzyl bromide, alkyl esters (with an alkyl group having 1 to 18 carbon atoms) of alkylsulfonic acid or arylsulfonic acid such as methane sulfonic acid, benzenesulfonic acid, or toluenesulfonic acid, and dialkylsulfate (with alkyl groups having 1 to 4 carbon atoms).

Examples of the nonionic monomer include esters of unsaturated carboxylic acid monomer and polyalkylene oxide addition product with polyoxyalkylene glycol or lower alcohols, and the reaction products of allylglycidyl ether or glycidyl ether of unsaturated carboxylic acid monomer and polyoxyalkyene oxide addition product with polyoxyalkylene glycol or lower alcohols. For example, the compounds represented by the following formulae can be used.

$CH_2{=}CHCH_2O{-}(CH_2CH_2O)_n{-}H$ $R^1OOC{-}CH{=}CH{-}\underset{\underset{O}{\|}}{CO}{-}CH_2\underset{\underset{OH}{|}}{CH}CH_2O{-}(CH_2CH_2)_n{-}R^2$ (in the formula $R^1$ is H, $CH_3$ or $-CH_2\underset{\underset{OH}{|}}{CH}CH_2O{-}(CH_2CH_2O)_n{-}R^2$, and $R^2$ is H or $CH_3$)

$CH_2{=}CH{-}\overset{\overset{O}{\|}}{C}O{-}(CH_2CH_2O)_n{-}H$ $CH_2{=}CH{-}\overset{\overset{O}{\|}}{C}O{-}(CH_2CH_2O)_n{-}CH_3$ $CH_2{=}\overset{\overset{CH_3}{|}}{C}{-}\overset{\overset{O}{\|}}{C}O{-}(CH_2CH_2O)_n{-}H$ $CH_2{=}\overset{\overset{CH_3}{|}}{C}{-}\overset{\overset{O}{\|}}{C}O{-}(CH_2CH_2O)_n{-}CH_3$ $CH_2{=}CH{-}\overset{\overset{O}{\|}}{C}O{-}CH_2\underset{\underset{OH}{|}}{CH}CH_2O{-}(CH_2CH_2O)_n{-}H$ $CH_2{=}\overset{\overset{CH_3}{|}}{C}{-}\overset{\overset{O}{\|}}{C}O{-}CH_2\underset{\underset{OH}{|}}{CH}CH_2O{-}(CH_2CH_2O)_n{-}H$ $CH_2{=}CH{-}\overset{\overset{O}{\|}}{C}O{-}CH_2\underset{\underset{OH}{|}}{CH}CH_2O{-}(CH_2CH_2O)_n{-}CH_3$ $CH_2{=}\overset{\overset{CH_3}{|}}{C}{-}\overset{\overset{O}{\|}}{C}O{-}CH_2\underset{\underset{OH}{|}}{CH}CH_2O{-}(CH_2CH_2O)_n{-}CH_3$ (In the above formulae, n is an integer of 2 to 100)

In the present invention, as for the (M2) monomer, well-known compounds having polyfluoroalkyl group or perfluoroalkyl group, such as methacrylate, vinyl ester, vinyl ether, maleate, fumaleate, α-olefin, can be described. More preferably, examples of the fluorine-containing monomer include monomers having a polyfluoroalkyl group or a perfluoroalkyl group with 4 or more carbon atoms.

Examples of these compounds are shown below, but the invention is not limited in these.

$CH_2{=}CHCO_2C_2H_4C_6F_{13}$ $CH_2{=}CHCO_2C_2H_4C_8F_{17}$ $CH_2{=}CHCO_2C_2H_4C_4F_9$ $CH_2{=}C(CH_3)CO_2C_2H_4C_6F_{13}$ $CH_2{=}CHCO_2C_2H_4C_{10}F_{21}$ $CH_2{=}C(CH_3)CO_2C_2H_4C_{10}F_{21}$ $CH_2{=}C(CH_3)CO_2C_2H_4C_8F_{17}$ $C_8F_{17}SO_2(C_3H_7)CH_2CH_2OCOCH{=}CH_2$ $C_8F_{17}SO_2(CH_3)CH_2CH_2OCOC(CH_3){=}CH_2$

-continued

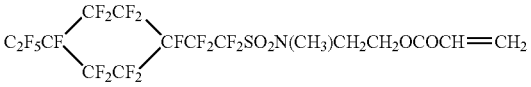

$C_2F_5CF(CF_2CF_2)_2CFCF_2CF_2SO_2N(CH_3)CH_2CH_2OCOCH{=}CH_2$ $C_7F_{15}CON(C_2H_5)CH_2CH_2OCOC(CH_3){=}CH_2$ $C_8F_{17}(CH_2)_{11}OCOC(CH_3){=}CH_2$ $C_8F_{17}CH_2\underset{\underset{OH}{|}}{CH}CH_2OCOC(CH_3){=}CH_2$ $(CF_3)_2CFO(CH_2)_5OCOCH{=}CH_2$ $C_2F_5(OCF_2CF_2)_5OCF_2CF_2CON(CH_3)CH_2CH_2OCOCH{=}CH_2$ $C_8F_{17}SO_2N(CH_2CH_2OCOCH{=}CH_2)_2$ $C_8F_{17}SO_2N(CH_3)(CH_2)_{10}OCOCH_2CH{=}CH_2$ $C_8F_{17}SO_2N(C_2H_5)CH_2CH_2OCOCH{=}CHCOOC_4H_9$ $C_6F_{13}SO_2N(CH_3)CH_2CH_2OCOCH{=}CH_2$ $C_8F_{17}SO_2NHCH_2CH_2SO_2CH{=}CH_2$ $CF_2{=}CF_2$ $CH_2{=}CHCO_2CH_2(CF_2)_4H$ $CH_2{=}CHCO_2CH_2(CF_2)_6H$ $CH_2{=}CHCO_2CH_2(CF_2)_8H$ $CH_2{=}C(CH_3)CO_2CH_2(CF_2)_4H$ $CH_2{=}C(CH_3)CO_2CH_2(CF_2)_6H$ $CH_2{=}C(CH_3)CO_2CH_2(CF_2)_8H$ $CH_2{=}C(CH_2COOC_2H_4C_4F_9)COOC_2H_4C_4F_9$ $CH_2{=}C(CH_2COOCH_2C_5F_{12}H)COOCH_2C_6F_{12}H$ $CH_2{=}CHCO_2CH_2CH_2OCH_2CH(OH)CH_2C_4F_9$ $CH_2{=}CHCO_2CH_2CH_2OCH_2CH(OH)CH_2C_6F_{13}$ $CH_2{=}C(CH_3)CO_2CH_2CH_2OCH_2CH(OH)C_8F_{17}$ $CH_2{=}\overset{\overset{CH_2-COOC_2H_4C_4F_9}{|}}{C}-COOC_2H_4C_4F_9$ $CH_2{=}\overset{\overset{CH_2-COOCH_2C_6F_{12}H}{|}}{C}-COOCH_2C_6F_{12}H$ Moreover, a macro monomer of the monomer described above is included. Preparation of the macro monomer can be easily performed by well-known recipes in the art.

For example, the above monomer is subjected to radical polymerization with thioglycolic acid, 2-mercapto ethanol, and the like in the presence of an initiator, and then a radical polymerizable unsaturated bond is introduced into one terminal end by reacting the resultant reaction products with glycidyl methacrylate, isocyanato ethyl methacrylate, and the like to form the above macro monomer.

The number-average molecular weight of the macro monomer is preferably 10,000 or less, and more preferably 5,000 or less.

Examples of the monomer (M3) having a radical polymerizable unsaturated bond which is different from either of (M1) and (M2) include well-known compounds such as methacrylate, vinyl ester, vinyl ether maleate, fumaleate, α-olefin, and the like.

Specific examples of these compounds include vinyl esters such as vinyl acetate, vinyl propionate, vinyl butyrate, vinyl pivalate, vinyl capronate, vinyl laurate, vinyl versate, vinyl cyclohexene carboxylate, or the like; vinyl ethers such as methyl vinyl ether, ethyl vinyl ether, n-propyl vinyl ether, isopropyl vinyl ether, n-butyl vinyl ether, isobutyl vinyl ether, t-butyl vinyl ether, n-pentyl vinyl ether, n-hexyl vinyl ether, n-octyl vinyl ether, 2-ethylhexyl vinyl ether, cyclohexyl vinyl ether, lauryl vinyl ether, or the like; mono-olefins such as ethylene, propyrene, or the like; maleates such as dimethyl maleate, diethyl maleate, dioctyl maleate, or the like; di-olefins such as butadiene, isoprene, or the like; allyl compounds such as allyl acetate, or the like; methacrylic esters such as methyl methacrylate, ethyl methacrylate, n-butyl methacrylate, isobutyl methacrylate, 2-ethylhexyl methacrylate, n-octyl methacrylate, decyl methacrylate, dodecyl methacrylate, or the like; styrene monomers such as styrene, vinyl toluene, or the like; monomers such as acrylonitrile, or the like. And in addition to the above, macro monomers of the monomer described above is included.

Preparation of the macro monomer can be easily performed according to the well-known recipes in the art.

For example, the monomer described above is subjected to radical polymerization with thioglycol acid, 2-mercapto ethanol, and the like in the presence of an initiator, and then a radical polymerizable unsaturated bond is introduced into one terminal end by reacting the resultant reaction products with glycidyl methacrylate, isocyanato ethyl methacrylate, and the like to form the above macro monomer.

The monomer used can be selected from one or more kinds of the monomers mentioned above.

The monomer (M2) preferably contains a repeating unit A derived from a monomer of fluorine atom-containing acrylate or a monomer of fluorine atom-containing methacrylate.

Specifically, the repeating unit A can be derived from fluoromethacrylate represented by the following formula (P) or a mixture of fluoromethacrylate:

$$(Rf)pLOCOCR{=}CH_2 \qquad \text{Formula (P)}$$

wherein, the substituent Rf represents a monovalent aliphatic organic group having 1 to 20 carbon atoms, more preferably 2 to 10 carbon atoms, and a fluorine atom. The backbone chain of Rf may be either a straight chain, a branched chain, or a cyclic chain, and can contain a quaternary divalent oxygen atom or a trivalent nitrogen atom bonded only to the carbon atom directly. Rf is preferably completely fluorinated, but a hydrogen atom or a chlorine atom bonded to the carbon atom may be present as a substituent of the backbone chain of Rf. Rf preferably contains at least one perfluoromethyl terminal group. p is preferably 1 or 2.

The bonding group L represents a linking group having 1 to 12 carbon atoms, and may be arbitrary substituted and/or interrupted by a substituent with another atom such as O, P, S, or N, or an unsubstituted group. R represents one selected from a hydrogen atom or a methyl group. The mentioned fluoromethacrylate monomer preferably contains 30% by weight or more of fluorine atoms.

One example of the fluoromethacrylate useful for the present invention includes the compound described below:

$$CF_3(CF_2)x(CH_2)yOCOCR{=}CH_2$$

wherein, x represents an integer of from 0 to 20, more preferably an integer of from 2 to 10, y represents an integer of from 1 to 10, and R represents one selected from a hydrogen atom or a methyl group;

$$HCF_2(CF_2)xCH_2)yOCOCR{=}CH_2$$

wherein, x represents an integer of from 0 to 20, preferably an integer of from 2 to 10, y represents an integer of from 1 to 10, and R represents one selected from a hydrogen atom or a methyl group;

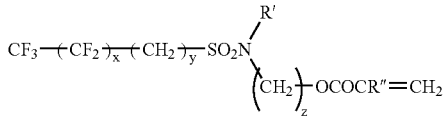

wherein, x represents an integer of from 0 to 20, preferably an integer of from 2 to 10, y represents an integer of from 1 to 10, z represents an integer of from 1 to 4, R' represents one selected from an alkyl group or an aryl alkyl group, and R" represents one selected from a hydrogen atom or a methyl group;

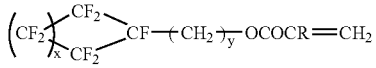

wherein, x represents an integer of from 1 to 7, y represents an integer of from 1 to 10, and R represents one selected from a hydrogen atom or a methyl group;

$$CF_3(CF_2CF_2O)x(CF_2O)y(CH_2)zOCOCR{=}CH_2$$

wherein, x+y represents an integer of from 1 to 20, z represents an integer of from 1 to 10, and R represents one selected from a hydrogen atom or a methyl group.

The copolymer according to the present invention may be either a random copolymer, a graft copolymer, or a block copolymer. A molecular weight of the copolymer is preferably, in terms of weight-average molecular weight, in a range of from about 5,000 to about 10,000,000, and more preferably from 5,000 to 1,000,000.

Concerning the composition of the fluorine atom-containing copolymer according to the present invention, preferred specific examples are shown below. However, the scope of the present invention is not limited to these examples.

TABLE 1

| | FL-1 | FL-2 | FL-3 | FL-4 | FL-5 |
|---|---|---|---|---|---|
| MMA | 50.8 | 49.8 | 0 | 0 | 50.8 |
| LaMA | 0 | 0 | 0 | 22 | 0 |
| EtMA | 0 | 0 | 85 | 0 | 0 |
| Fluorine-containing monomer-1 | 41.2 | 48.2 | 7 | 70 | 36.2 |
| 2-Acrylamido-2-methylpropanesulfonc acid | 8 | 0 | 0 | 0 | 0 |
| Acrylic acid | 0 | 2 | 8 | 0 | 8 |
| (Dimethylamino)ethyl methacrylate | 0 | 0 | 0 | 8 | 0 |
| Glycidyl methacrylate | 0 | 0 | 0 | 0 | 5 |

MMA: Methyl methacrylate
EtMA: Ethyl methacrylate
LaMA: Lauryl methacrylate
Fluorine atom-containing monomer-1: 1H,1H,2H,2H-Heptadecafluorodecyl methacrylate

TABLE 2

| | FL-6 | FL-7 | FL-8 |
|---|---|---|---|
| $CF_3(CF_2)7CH_2CH_2O{-}CH{=}CH_2$ | 72 | 0 | 0 |
| $CH_3(CH_2)_3{-}O{-}CH{=}CH_2$ | 14 | 0 | 0 |
| Thtrafluoroethylene | 0 | 25 | 0 |
| Propylene | 0 | 25 | 0 |

TABLE 2-continued

| | FL-6 | FL-7 | FL-8 |
|---|---|---|---|
| Fluorine atom-containing monomer-2 | 0 | 0 | 50 |
| Fluorine atom-containing monomer-3 | 0 | 0 | 40 |
| Acrylic acid | 0 | 50 | 0 |
| Maleic anhydride | 14 | 0 | 0 |
| Methacrylic acid | 0 | 0 | 10 |

Fluorine atom-containing monomer-2

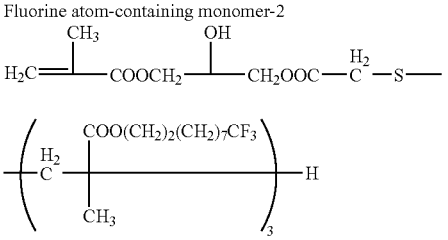

Fluorine atom-containing monomer-3

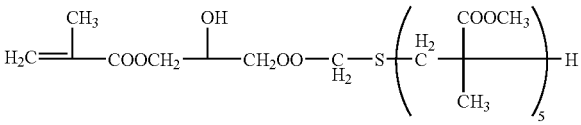

TABLE 3

| | FL-9 | FL-10 | FL-11 | FL-12 |
|---|---|---|---|---|
| MMA | 46.0 | 42.2 | 35.5 | 19.4 |
| BuA | 46.0 | 44.8 | 41.5 | 0 |
| Fluorine-containing monomer-4 | 5.0 | 10.0 | 20.0 | 40.0 |
| N-Methylolacrylamide | 1.0 | 1.0 | 1.0 | 1.0 |
| 2-Ethylhexyl acrylate | 0 | 0 | 0 | 37.6 |
| Acrylic acid | 2.0 | 2.0 | 2.0 | 2.0 |

BuA: Butyl acrylate
Fluorine-containing monomer-4: 2,2,2-Trifluoroethyl methacrylate

TABLE 4

| | FL-13 | FL-14 | FL-15 | FL-16 | FL-17 | FL-18 |
|---|---|---|---|---|---|---|
| Fluorine atom-containing monomer-5 | 5 | 15 | 25 | 20 | 5 | 10 |
| n-Butyl methacrylate | 90 | 60 | 65 | 70 | 83 | 78 |
| t-Butyl methacrylate | 0 | 20 | 0 | 0 | 0 | 0 |
| 2-Hydroxyethyl methacrylate | 0 | 0 | 5 | 5 | 10 | 10 |
| Acrylic acid | 5 | 5 | 5 | 5 | 2 | 2 |

Fluorine atom-containing monomer-5: β-(Perfluorooctyl)ethyl acrylate

FL-19: 33 parts of β-(perfluorooctyl)ethyl acrylate, 34 parts of β-(perfluorodecyl)ethyl acrylate, and 33 parts of β-(perfluorododecyl)ethyl acrylate Synthetic examples of some of the above specific examples is described.

<<Synthesis of FL-1>>

Into the reaction vessel with a stirrer, a reflux condenser, a dropping funnel, a thermometer, and a nitrogen gas inlet tube were added 64 parts of isopropyl alcohol, 4 parts of ion-exchange water, 14.8 parts of methyl methacrylate, 41.2 parts of 1H,1H,2H,2H-heptadecafluorodecyl methacrylate, and 8 parts of 2-acrylamide-2-methylpropane sulfonic acid, while the dissolved oxygen was removed by bubbling of nitrogen gas.

On the other hand, 36 parts of dissolved-oxygen-removed isopropyl alcohol, 36 parts of methyl methacrylate and 0.07 parts of azobis-isobutyronitrile were added into the dropping funnel. After the temperature of the vessel was heated to 83±3° C., 2 parts of methyl ethyl ketone containing 0.13 parts of azobis-isobutyronitrile was added to the mixture, and the monomer was dropped from the dropping funnel in accordance with the consumption speed of the methyl methacrylate. After the finish of dropping the monomer, 3 parts of methyl ethyl ketone prepared by dissolving 0.2 parts of azobis-isobutyronitrile was added thereto and the reaction was continued over a period of 2 hours. Thereafter, 2 parts of methyl ethyl ketone prepared by dissolving 0.1 parts of azobis-isobutyronitrile was added and the reaction was continued over a period of 6 hours to give a homogeneous copolymer.

Thereafter, 15.5 parts of a 10% by weight aqueous solution of sodium hydroxide was added to the resultant copolymer to neutralize, and then 300 parts of ion-exchange water was added. The remaining methyl ethyl ketone was removed under the reduced pressure to form an aqueous dispersion of polymer FL- 1 of the present invention.

<<Synthesis of FL-7>>

Into 1 liter stainless steel-made autoclave with stirrer were added 450 parts of dissolved-oxygen-removed methyl ethyl ketone and 5 parts of acrylic acid, and the inner gas was replaced by a nitrogen gas. After the inner gas was replaced by tetrafluoroethylene, the mixed monomer of propylene/tetrafluoroethylene=60 mol %/40 mol % was poured in the mixture and the inner pressure was set to 4.9 MPa.

The temperature was elevated after the start of stirring, and when the inner temperature reached to 70° C., 10 parts of methyl ethyl ketone prepared by dissolving 0.9 parts of benzoyl peroxide was poured and the mixed monomer having the same composition as the above was added while keeping the inner pressure at 13.7 MPa. Thereafter 145 parts of acrylic acid was added over a period of 8 hours. While keeping the inner temperature at 75° C., each monomer was added in accordance with the consumption speed of propylene and tetrafluoroethylene, during the process the inner pressure was kept in a range of from 12.7 Mpa to 13.7 MPa. Thereafter, at 3 hours later and at 6 hours later, 10 parts of methyl ethyl ketone prepared by dissolving 0.9 parts of benzoyl peroxide was added respectively and then after the reaction was continued over a period of 12 hours, the autoclave was cooled down and the volatile substances were evaporated. Where the consumption amount of the mixed monomer reached to approximately 150 parts.

A composition of the obtained copolymer was measured by NMR method and the measurement resulted in a composition such as tetrafluoroethylene/propyrene/acrylic acid=25% by weight/25% by weight/50% by weight.

Thereafter, to 100 parts of the copolymer (solid content: 38.5 parts), 27 parts of triethylamine and 160 parts of ion-exchange water were added and then the remaining methyl ethyl ketone was removed under a reduced pressure to form an aqueous dispersion of polymer FL-7 of the present invention.

The synthesizing method of the polymer used for the present invention is not restricted to the above procedures, and any well-known method can be applied. The details can be referred to the literature described in JP-A Nos. 2-147601, 5-17538, 8-208936, and 11-288061.

The solvent of the coating solution for the outermost layer may be either an organic solvent or an aqueous solvent, but an aqueous solvent is preferred. In the case of the aqueous solvent, the copolymer used in the present invention is preferably a hydrophobic polymer and preferably used in the form of polymer latex in the coating solution. Herein the polymer latex means the one in a dispersed state where fine particles of a water-insoluble hydrophobic polymer are dispersed in water.

The average particle diameter and the particle diameter distribution of the dispersed particles are the same values described in the explanation of polymer latex described below.

The term "an aqueous solvent" means a solvent consisted of water or a mixture of water and 70% by weight or less of a water-miscible organic solvent. Examples of the water-miscible organic solvents include alcohols such as methyl alcohol, ethyl alcohol, or propyl alcohol, cellosolves such as methyl cellosolve, ethyl cellosolve, or butyl cellosolve, ethyl acetate, dimethyl formamide, and the like.

The copolymer according to the present invention may be used for the binder in combination with hydrophilic polymers such as gelatin, poly(vinyl alcohol), methyl cellulose, hydroxypropyl cellulose, carboxymethyl cellulose, or the like or the latex polymers described below.

When the above-mentioned copolymer is used, the content of the polymer is preferably 20% by weight or higher, and more preferably from 30% by weight or higher, based on the total binders.

The coating amount of the polymer is in a range from 0.05 $g/m^2$ to 2.0 $g/m^2$, and more preferably from 0.1 $g/m^2$ to 1.0 $g/m^2$.

(Other Components of Outermost Layer)

1) Matting Agent

In the present invention, a matting agent can be included. Preferably, a matting agent is included in at least either the outermost layer or the layer adjacent to the outermost layer. The case, where a matting agent is included in the outermost layer, is more preferred. The layer including a matting agent may be one layer or plural layers.

Particularly, the matting agent is preferably used as a dispersion of matting agent, which is dispersed beforehand by a polymer, a surfactant, or a combination thereof. More preferred are a dispersion of matting agent, which is dispersed beforehand by a water-soluble polymer, a surfactant, or a combination thereof.

The matting agent used in the present invention is generally water-insoluble organic or inorganic fine particle. Any matting agents can be used and for example, organic matting agents described in U.S. Pat. Nos. 1,939,213, 2,701,245, 2,322,037, 3,262,782, 3,539,344, 3,767,448, and the like, inorganic matting agents described in U.S. Pat. Nos. 1,260, 772, 2,192,241, 3,257,206, 3,370,951, 3,523,022, 3,769,020, and the like, these well-known ones in the said industry, can be used.

As the organic compound used as a matting agent, aqueous dispersed vinyl polymers such as poly(methyl acrylate), poly (methyl methacrylate), polyacrylonitrile, acrylonitrile/α-methylstyrene copolymer, polystyrene, styrene/divinylbenzene copolymer, poly(vinyl acetate), poly(ethylene carbonate), polytetrafluoroethylene, or the like, cellulose derivatives such as methylcellulose, cellulose acetate, cellulose acetate propionate, or the like, starch derivatives such as carboxy starch, carboxynitrophenyl starch, reactants of urea-formaldehyde-starch, or the like, hardened gelatin by known hardener, hardened gelatin being a fine hollow capsule particle by a coacervated hardening, and the like are preferably used.

As examples of inorganic compound, silicon dioxide, titanium dioxide, magnesium dioxide, aluminium oxide, barium sulfate, calcium carbonate, silver chloride, and silver bromide desensitized by a known method, glass, diatomaceous earth, and the like are preferably used. Different kind of compound can be used by mixing with the above matting agent, depending on needs. Concerning a size of the matting agent, any particle diameter can be used without the limitation of particle size and shape of the matting agent. In the practice of the present invention, the matting agent having a particle diameter of 0.1 μm to 30 μm is preferably used. The particle diameter is more preferably 0.3 μm to 20 μm, and even more preferably 0.5 μm to 10 μm. And a particle diameter distribution may be narrow or wide. The variation coefficient of a particle size distribution is preferably 50% or less, more preferably 40% or less, and even more preferably 30% or less. Herein, the variation coefficient means the value represented by (standard deviation of particle size)/(average value of particle size)×100. Further, the combined use of two kinds of matting agent, which has a low variation coefficient and the ratio of the average particle diameter is larger than 3, is preferable.

On the other hand, because a matting agent effects greatly to haze and surface gloss of the coated film, it is preferred that the particle diameter, the shape, and the particle diameter distribution are arranged in a suitable condition in proportion to the need at a preparing step of the matting agent or at the mixing step of plural matting agents.

Preferable examples of the matting agent used in the present invention are described below, however this invention is not limited in these.

M-1: polyethylene particle, specific gravity of 0.90, (FLOW BEADS LE-1080 produced by Sumitomo Seika Co., Ltd.);

M-2: polyethylene particle, specific gravity of 0.93, (FLOW BEADS EA-209 produced by Sumitomo Seika Co., Ltd.);

M-3: polyethylene particle, specific gravity of 0.96, (FLOW BEADS HE-3040 produced by Sumitomo Seika Co., Ltd.);

M-4: silicon particle, specific gravity of 0.97;

M-5: silicon particle, specific gravity of 1.00, (E-701 produced by Dow Corning Toray Silicone Co., Ltd.);

M-6: silicon particle, specific gravity of 1.03;

M-7: polystyrene particle, specific gravity of 1.05, (SB-6 produced Sekisui Plastics Co., Ltd.);

M-8: poly(St/MAA=97/3) copolymer particle, specific gravity of 1.05;

M-9: poly(St/MAA=90/10) copolymer particle, specific gravity of 1.06;

M-10: poly(St/MMA/MAA=50/40/10) copolymer particle, specific gravity of 1.09;

M-11: crosslinking polyethylene particle, specific gravity of 0.92;

M-12: crosslinking polyethylene particle, specific gravity of 0.95;

M-13: crosslinking polyethylene particle, specific gravity of 0.98;

M-14: crosslinking silicon particle, specific gravity of 0.99;

M-15: crosslinking silicon particle, specific gravity of 1.02;

M-16: crosslinking silicon particle, specific gravity of 1.04;

M-17: poly(St/DVB=90/10) particle, specific gravity of 1.06 (SX-713 produced by SOKENKAGAKU Co.);

M-18: poly(St/DVB=80/20) particle, specific gravity of 1.06 (SX-713 produced by SOKENKAGAKU Co.);

M-19: poly(St/DVB=70/30) particle, specific gravity of 1.07 (SX-713 produced by SOKENKAGAKU Co.);

M-20: copoly(St/MAA/DVB=87/3/10) particle, specific gravity of 1.06, (SX-713α produced by SOKENKAGAKU Co.);

M-21: copoly(St/MAA/DVB=80/10/10) particle, specific gravity of 1.07, (SX-713α produced by SOKENKAGAKU Co.);

M-22: copoly(St/MMA/MAA/DVB=40/40/10/10) particle, specific gravity of 1.10.

The content of a matting agent is set within a range in which the expected effect of the present invention can be exhibited and the original function of the layer containing a matting agent can not be prevented too much. The addition amount of the matting agent is preferably in a range of from 1 mg/m$^2$ to 400 mg/m$^2$, more preferably from 5 mg/m$^2$ to 300 mg/m$^2$, with respect to the coating amount per 1 m$^2$ of the photothermographic material.

When the matting agent is contained in the image forming layer side, it is general that the amount of the matting agent is within the range not to occur star-dust trouble, and the level of matting of 500 seconds to 10,000 seconds is preferred, and more preferred, 500 seconds to 2,000 seconds as Beck's smoothness. When the matting agent is contained in a back layer, the level of matting of 2,000 seconds or less and 10 seconds or more is preferred, and more preferred, 1,500 seconds or less and 50 seconds or more. Beck's smoothness can be calculated by seeing Japan Industrial Standared (JIS) P8119 and TAPPI standard method T479.

The matting agent contained on the image forming layer side is used as a dispersion of matting agent, which is dispersed beforehand by a polymer, a surfactant, or a combination thereof. There are two dispersing methods.

(a) the preparing method of a matting agent dispersion to make a polymer droplet by emulsified dispersion in an aqueous medium of a polymer solution prepared in advance (e.g., dissolved in an organic solvent having a low boiling point) as a matting agent and then to remove the organic solvent having a low boiling point from the emulsion dispersion;

(b) the method of arranging a dispersion of fine particles of polymer or the like prepared in advance as a matting agent in an aqueous medium not to get lumpy.

In the present invention, the method (b) that takes into consideration for environment not to exhaust a low boiling point solvent in air is preferable.

The dispersing method of the matting agent described above can comprise mechanically dispersion using the known high speed starring method (e.g., Disbar emulsifier, a homomixer, a turbine mixer, or a homogenizer) or an ultrasonic emulsifier in the beforehand presence of aqueous medium containing a polymer or a surfactant as an auxiliary dispersing agent in an aqueous solvent. At the dispersion, to prevent the occurrence of vesicles, the dispersing method which comprise dispersing the matting agent in the depressed condition less than atomospheric pressure can be used in combination. The auxiliary dispersing agent is generally dissolved in an aqueous solvent beforehand the addition of a matting agent, however can be added as an aqueous dispersion made by polymerized matting agent (without drying process). The auxiliary dispersing agent can be added in the dispersion during dispersion and can be added to the dispersion for stabilization of physical properties after dispersion. In each case, it is general that the solvent (e.g., water, alcohol, or the like) is coexisted. At before and after the dispersion or during dispersion, pH may be controlled by a suitable pH controlling agent.

Besides the mechanical dispersing method, the stability of matting agent dispersion after dispersion may be increased by the pH control. And at dispersion, a very small quantity of organic solvent having a low boiling point can be used and in general, the organic solvent is removed after completion of the fine granulating process.

The prepared dispersion can be stored with starring to prevent sedimentation of a matting agent at storage or can be stored in a high viscosity condition using hydrophilic colloide (e.g., the case of jelly condition by using gelatin). And to prevent the propagation of bacterium at the storage, the addition of an antiseptic is preferred.

As the water-soluble polymer, which can be used in the matting agent dispersion according to the present invention, either of an animal water-soluble polymer and a non-animal water-soluble polymer can be used. The water-soluble polymer is preferably added in an amount of 5% by weight to 300% by weight, and more preferably 10% by weight or to 200% by weight, with respect to the matting agent, and dispersed.

When the matting agent dispersion in the present invention contains a surfactant, the dispersion state becomes stable. Therefore, the addition of a surfactant is preferable. The surfactant used herein is not especially limited, however, well-known compounds can be used. As an auxiliary dispersing agent disclosed conventionally, an anionic auxiliary dispersing agent such as alkylphenoxyethoxyethanesulfonate, polyoxyethylene alkylphenyl ether sulfonate, alkylbenzenesulfonate, alkylnaphthalenesulfonate, alkylsulfonate, alkylsulfosuccinate, sodium oleilmethyltaurate, condensed polymer of formaldehyde and naphthalenesulfonic acid, poly (acrylic acid), polymethacrylic acid, copolymer of maleic acid and acrylic acid, carboxymethyl cellulose, cellulose sulfate, or the like, a nonionic auxiliary dispersing agent such as polyoxyethylene alkyl ether, sorbitan ester of fatty acid, polyoxyethylene sorbitan ester of fatty acid, blocked polymer of polyalkyleneoxide, or the like, a cationic auxiliary dispersing agent, and a betaine type auxiliary dispersing agent can be described. Particularly, an anionic surfactant such as sodium triisopropylnaphthalenesulfonate (a mixture of different substitution positions of three isopropyl groups) or the like is preferred.

As an antiseptic possible to be add to the dispersion, for example, sodium salt of benzoisothiazolinone, p-hydroxybenzoic acid ester (methyl ester, butyl ester, or the like) can be contained. The addition amount is preferably in a range of from 0.005% by weight to 0.1% by weight with respect to the dispersion.

2) Fluorocarbon Compound

It is preferred that the photothermographic material of the present invention contains a fluorocarbon compound having a fluoroalkyl group with 2 or more carbon atoms and 12 or fewer fluorine atoms. It is more preferred that the fluorocarbon compound is contained in at least one of an outermost layer and a layer adjacent to the outermost layer. The fluorocarbon compound in the present invention can be used as a surfactant. Further, it is also preferred that the fluorocarbon compound is added to the above-described matting agent dispersion.

The fluorocarbon compound used in the present invention may have any structure, as far as it has a fluoroalkyl group described above (hereinafter, fluorine substituted alkyl group is called "Rf"). And the fluorocarbon compound may have at least one Rf, and can have two or more Rfs. The fluorocarbon compound having two or more Rfs is preferred.

As specific examples of Rf, the following compounds can be described, but Rf is not limited thereto.

—$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—CF $(CF_3)_2$ group, —$CH_2CF_3$ group, —$C_4H_8$—$CH(C_2F_5)$ group, —$C_4H_8$—$CH(CF_3)_2$ group, —$C_4H_8$—$C(CF_3)_3$ group, —$CH_2$—$C_4F_8$—H group, —$CH_2$—$C_6F_{12}$—H group Rf has 12 or fewer fluorine atoms, preferably from 3 to 11 fluorine atoms, and more preferably from 5 to 9 fluorine atoms. And Rf has 2 or more carbon atoms, preferably from 4 to 16 carbon atoms, and more preferably from 5 to 12 carbon atoms.

The structure of Rf is not particularly limited as far as Rf has 2 or more carbon atoms and 12 or fewer fluorine atoms, however, the group represented by the following formula (A) is preferred.

-Rc-Re-W Formula (A)

In formula (A), Rc represents an alkylene group having 1 to 4 carbon atoms, preferably 1 to 3 carbon atoms, and more preferably 1 to 2 carbon atoms.

An alkylene group represented by Rc may be a linear or branched chain.

Re represents a perfluoroalkylene group having 2 to 6 carbon atoms, and preferably 2 to 4 carbon atoms. Herein, the perfluoroalkylene group means an alkylene group where all hydrogen atoms of an alkylene group are replaced by fluorine atoms. The perfluoroalkylene group described above may be a linear or branched chain, or a cyclic structure.

W represents one selected from a hydrogen atom, a fluorine atom, or an alkyl group. W is preferably a hydrogen atom or a fluorine atom, and particularly preferably, a fluorine atom.

The fluorocarbon compound in the present invention can have a cationic hydrophilic group. The cationic hydrophilic group means the group which becomes an anion when it is dissolved in water. As specific examples, tertiary ammonium, alkyl pyridium, alkyl imidazolium, primary to tertiary aliphatic amines, and the like are described.

As a cation, an organic cationic substituent is preferable and an organic cationic group containing a nitrogen atom or a phosphorous atom is more preferable. Even more preferable is a pyridinium cation or an ammonium cation.

The kind of anion which forms a salt may be any of an inorganic anion or an organic anion. As an inorganic anion, iodide ion, bromide ion, chloride ion, and the like are described. As an organic anion, p-toluenesulfonate ion, p-toluenesulfonate ion, benzenesulfonate ion, methanesulfonate ion, trifluoromethanesulfoate ion, and the like are described.

In the present invention, the preferred cationic fluorocarbon compound is represented by the following formula (1).

Formula (1)

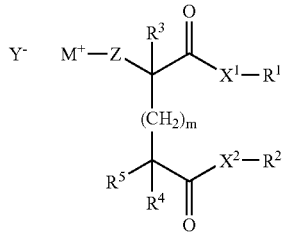

In formula (1), $R^1$ and $R^2$ each represent a substituted or unsubstituted alkyl group, however, at least one of $R^1$ and $R^2$ is a fluoroalkyl group (Rf) described above. It is preferred that both of $R^1$ and $R^2$ are Rf. $R^3$, $R^4$, and $R^5$ each independently represent a hydrogen atom or a substituent. $X^1$, $X^2$, and Z each independently represent a divalent linking group or a single bond. $M^+$ represents a cationic substituent. $Y^-$ represents a counter anion, however, when the charge results in 0 in a molecule, $Y^-$ is not necessary. m represents 0 or 1.

In formula (1) described above, when $R^1$ or $R^2$ represents a substituted or unsubstituted alkyl group other than Rf, the said alkyl group has one or more carbon atoms and may be any of a linear chain, a branched chain, or a cyclic structure. Above substituent can include an alkenyl group, an aryl group, an alkoxyl group, a halogen atom other than a fluorine atom, a carboxylate ester group, a carbonamide group, a carbamoyl group, an oxycarbonyl group, a phosphate ester group, and the like.

In the case where $R^1$ or $R^2$ represents an alkyl group other than Rf, namely an alkyl group not substituted by a fluorine atom, the said alkyl group is preferably a substituted or unsubstituted alkyl group having 1 to 24 carbon atoms, and more preferably a substituted or unsubstituted alkyl group having 6 to 24 carbon atoms. As preferable examples of the unsubstituted alkyl group having 6 to 24 carbon atoms, an n-hexyl group, an n-heptyl group, an n-octyl group, a tert-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group, a cycloheptyl group, and the like are described. And as preferable examples of the substituted alkyl group having 6 to 24 carbon atoms in total, a 2-hexenyl group, an oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, an 18-phenyloctadecyl group, a 12-(p-chlorophenyl)dodecyl group, a 2-(diphenyl phosphate)ethyl group, and the like are described.

As the alkyl group represented by $R^1$ or $R^2$, which is other than Rf, a substituted or unsubstituted alkyl group having 6 to 18 carbon atoms is even more preferred. As preferable examples of the unsubstituted alkyl group having 6 to 18 carbon atoms, an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, a 4-tert-butylcyclohexyl group, and the like are described. And as preferable examples of the substituted alkyl group having 6 to 18 carbon atoms in total, a phenethyl group, a 6-phenoxyhexyl group, a 12-phenyldodecyl group, an oleyl group, a linoleyl group, a linolenyl group, and the like are described.

As the alkyl group represented by $R^1$ or $R^2$, which is other than Rf, particularly preferred are an n-hexyl group, a cyclohexyl group, an n-heptyl group, an n-octyl group, a 2-ethylhexyl group, an n-nonyl group, a 1,1,3-trimethylhexyl group, an n-decyl group, an n-dodecyl group, a cetyl group, a hexadecyl group, a 2-hexyldecyl group, an octadecyl group, an oleyl group, a linoleyl group, and a linolenyl group. Most preferred is an unsubstituted linear, cyclic or branched alkyl group having 8 to 16 carbon atoms.

In formula (1) described above, $R^3$, $R^4$, and $R^5$ each independently represent a hydrogen atom or a substituent. As examples of the substituent, an alkyl group (preferably an alkyl group having 1 to 20 carbon atoms, more preferably an alkyl group having 1 to 12 carbon atoms, and particularly preferably an alkyl group having 1 to 8 carbon atoms, for example, a methyl group, an ethyl group, an isopropyl group, a tert-butyl group, an n-octyl group, an n-decyl group, an n-hexadecyl group, a cyclopropyl group, a cyclopentyl group, a cyclohexyl group, and the like are described), an alkenyl group (preferably an alkenyl group having 2 to 20 carbon atoms, more preferably an alkenyl group having 2 to 12 carbon atoms, and particularly preferably an alkenyl group having 2 to 8 carbon atoms, for example, a vinyl group, an allyl group, a 2-butenyl group, a 3-pentenyl group, and the like are described), an alkynyl group (preferably an alkynyl group having 2 to 20 carbon atoms, more preferably an alkynyl group having 2 to 12 carbon atoms, and particularly preferably an alkynyl group having 2 to 8 carbon atoms, for example, a propargyl group, a 3-pentynyl group, and the like are described), an aryl group (preferably an aryl group having 6 to 30 carbon atoms, more preferably an aryl group having 6 to 20 carbon atoms, and particularly preferably an aryl group having 6 to 12 carbon atoms, for example, a phenyl group, a p-methylphenyl group, a naphthyl group, and the like are described), a substituted or unsubstituted amino group (preferably an amino group having 0 to 20 carbon atoms, more preferably an amino group having 0 to 10 carbon atoms, and particularly preferably an amino group having 0 to 6 carbon atoms, for example, an unsubstituted amino group, a methyl amino group, a dimethylamino group, a diethylamino group, a dibenzylamino group, and the like are described), an alkoxy group (preferably an alkoxy group having 1 to 20 carbon atoms, more preferably an alkoxy group having 1 to 12 carbon atoms, and particularly preferably an alkoxy group having 1 to 8 carbon atoms, for example, a methoxy group, an ethoxy group, a butoxy group, and the like are described), an aryloxy group (preferably an aryloxy group having 6 to 20 carbon atoms, more preferably an aryloxy group having 6 to 16 carbon atoms, and particularly preferably an aryloxy group having 6 to 12 carbon atoms, for example, a phenyloxy group, a 2-naphthyloxy group, and the like are described), an acyl group (preferably an acyl group having 1 to 20 carbon atoms, more preferably an acyl group having 1 to 16 carbon atoms, and particularly preferably an acyl group having 1 to 12 carbon atoms, for example, an acetyl group, a benzoyl group, a formyl group, a pivaloyl group, and the like are described), an alkoxycarbonyl group (preferably an alkoxycarbonyl group having 2 to 20 carbon atoms, more preferably an alkoxycarbonyl group having 2 to 16 carbon atoms, and particularly preferably an alkoxycarbonyl group having 2 to 12 carbon atoms, for example, a methoxycarbonyl group, an ethoxycarbonyl group, and the like are described), an aryloxycarbonyl group (preferably an aryloxycarbonyl group having 7 to 20 carbon atoms, more preferably an aryloxycarbonyl group having 7 to 16 carbon atoms, and particularly preferably an aryloxycarbonyl group having 7 to 10 carbon atoms, for example, a phenyloxycarbonyl group and the like are described), an acyloxy group (preferably an acyloxy group having 2 to 20 carbon atoms, more preferably an acyloxy group having 2 to 16 carbon atoms, and particularly preferably an acyloxy group having 2 to 10 carbon atoms, for example, an acetoxy group, a benzoyloxy group, and the like are described), an acylamino group (preferably an acylamino group having 2 to 20 carbon atoms, more preferably an acylamino group having 2 to 16 carbon atoms, and particularly preferably an acylamino group having 2 to 10 carbon atoms, for example, an acetylamino group, a benzoylamino group, and the like are described), an alkoxycarbonylamino group (preferably an alkoxycarbonylamino group having 2 to 20 carbon atoms, more preferably an alkoxycarbonylamino group having 2 to 16 carbon atoms, and particularly preferably an alkoxycarbonylamino group having 2 to 12 carbon atoms, for example, a methoxycarbonylamino group and the like are described), an aryloxycarbonylamino group (preferably an aryloxycarbonylamino group having 7 to 20 carbon atoms, more preferably an aryloxycarbonylamino group having 7 to 16 carbon atoms, and particularly preferably an aryloxycarbonylamino group having 7 to 12 carbon atoms, for example, a phenyloxycarbonylamino group and the like are described), a sulfonylamino group (preferably a sulfonylamino group having 1 to 20 carbon atoms, more preferably a sulfonylamino group having 1 to 16 carbon atoms, and particularly preferably a sulfonylamino group having 1 to 12 carbon atoms, for example, a methanesulfonylamino group, a benzenesulfonylamino group, and the like are described), a sulfamoyl group (preferably a sulfamoyl group having 0 to 20 carbon atoms, more preferably a sulfamoyl group having 0 to 16 carbon atoms, and particularly preferably a sulfamoyl group having 0 to 12 carbon atoms, for example, a sulfamoyl group, a methylsulfamoyl group, a dimethylsulfamoyl group, a phenylsulfamoyl group, and the like are described), a carbamoyl group (preferably a carbamoyl group having 1 to 20 carbon atoms, more preferably a carbamoyl group having 1 to 16 carbon atoms, and particularly preferably a carbamoyl group having 1 to 12 carbon atoms, for example, an unsubstituted carbamoyl group, a methylcarbamoyl group, a diethylcarbamoyl group, a phenylcarbamoyl group, and the like are described), an alkylthio group (preferably an alkylthio group having 1 to 20 carbon atoms, more preferably an alkylthio group having 1 to 16 carbon atoms, and particularly preferably an alkylthio group having 1 to 12 carbon atoms, for example, a methylthio group, an ethylthio group, and the like are described), an arylthio group (preferably an arylthio group having 6 to 20 carbon atoms, more preferably an arylthio group having 6 to 16 carbon atoms, and particularly preferably an arylthio group having 6 to 12 carbon atoms, for example, a phenylthio group and the like are described), a sulfonyl group (preferably a sulfonyl group having 1 to 20 carbon atoms, more preferably a sulfonyl group having 1 to 16 carbon atoms, and particularly preferably a sulfonyl group having 1 to 12 carbon atoms, for example, a mesyl group, a tosyl group, and the like are described), a sulfinyl group (preferably a sulfinyl group having 1 to 20 carbon atoms, more preferably a sulfinyl group having 1 to 16 carbon atoms, and particularly preferably a sulfinyl group having 1 to 12 carbon atoms, for example, a methanesulfinyl group, a benzenesulfinyl group, and the like are described), a ureido group (preferably a ureido group having 1 to 20 carbon atoms, more preferably a ureido group having 1 to 16 carbon atoms, and particularly preferably a ureido group having 1 to 12 carbon atoms, for example, an unsubstituted ureido group, a methylureido group, a phenylureido group, and the like are described), an amide phosphate group (preferably an amide phosphate group having 1 to 20 carbon atoms, more preferably an amide phosphate group having 1 to 16 carbon atoms, and particularly preferably an amide phosphate group having 1 to 12 carbon atoms, for example, an amide diethylphosphate group, an amide phenylphosphate group, and the like are described), a hydroxy group, a mercapto group, a halogen atom (for example, a fluorine atom, a chlorine atom, a bromine atom, or an iodine atom), a cyano group, a sulfo group, a carboxy group, a nitro group, a hydroxamic acid group, a sulfino group, a hydrazino group, an imino group, a heterocyclic group (preferably a heterocyclic group having 1 to 30 carbon atoms, and more preferably a heterocyclic group having 1 to 12 carbon atoms, e.g., a heterocyclic group having a hetero atom such as a nitrogen atom, an oxygen atom, a sulfur atom, or the like, for example, an imidazolyl group, a pyridyl group, a quinolyl group, a furyl group, a piperidyl group, a morpholino group, a benzoxazolyl group, a benzimidazolyl group, a benzthiazolyl group, and the like are described), a silyl group (preferably a silyl group having 3 to 40 carbon atoms, more preferably a silyl group having 3 to 30 carbon atoms, and particularly preferably a silyl group having 3 to 24 carbon atoms, for example, a trimethylsilyl group, a triphenylsilyl group, and the like are described), and the like are described. These substituents may be further substituted. In a case where the group has two or more substituents, these substituents may be identical or different from each other. And if possible, these may bond to each other to form a ring.

As $R^3$, $R^4$, and $R^5$, an alkyl group and a hydrogen atom are preferred, and a hydrogen atom is more preferred.

In formula (1) described above, $X^1$ and $X^2$ each represent a divalent linking group or a single bond. There is no limitation regarding the divalent linking group described above, but an allylene group, —O—, —S—, —$NR^{31}$— ($R^{31}$ represents a hydrogen atom or a substituent and this substituent is similar to that of the examples which $R^3$, $R^4$, and $R^5$ each represent, and as $R^{31}$, an alkyl group, Rf described above, or a hydrogen atom is preferred and a hydrogen atom is more preferred) and the group obtained by a combination thereof are preferred, and —O—, —S—, and —$NR^-$— are more preferred. As $X^1$ and $X^2$, —O— or —$NR^{31}$— is more preferred, and —O— is particularly preferred.

In formula (1) described above, Z represents a divalent linking group or a single bond. There is no limitation regarding the divalent linking group described above, but an alkylene group, an allylene group, —C(=O)—, —O—, —S—, —S(=O)—, —$S(=O)_2$—, —$NR^{32}$— ($R^{32}$ represents a hydrogen atom or a substituent and this substituent is similar to that of the examples which $R^3$, $R^4$, and $R^5$ each represent, and as $R^{32}$, an alkyl group, or a hydrogen atom is preferred and a hydrogen atom is more preferred) and the group obtained by a combination thereof are preferred. As Z, an alkylene group having 1 to 8 carbon atoms, —C(=O)—, —O—, —S—, —S(=O)—, —$S(=O)_2$—, or —$NR^{32}$—, or the group obtained by a combination thereof is more preferred. Following examples are described:

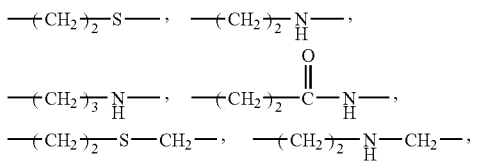

-continued

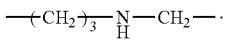

In formula (1) described above, $M^+$ represents a cationic substituent. As $M^+$, an organic cationic substituent is preferred, and an organic cationic substituent having a nitrogen atom or a phosphorus atom is more preferred. Further more, a pyridinium cation or an ammonium cation is preferred and a trialkyl ammonium cation represented by the following formula (2) is more preferred.

Formula (2)

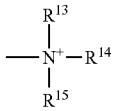

In formula (2), $R^{13}$, $R^{14}$, and $R^{15}$ each independently represent a substituted or unsubstituted alkyl group. As the substituent, the substituents as a substituent of $R^3$, $R^4$, and $R^5$ described above can be applied. And when it is possible, $R^{13}$, $R^{14}$ and $R^{15}$ can form a ring by binding to each other. As $R^{13}$, $R^{14}$, and $R^{15}$, an alkyl group having 1 to 12 carbon atoms is preferred, an alkyl group having 1 to 6 carbon atoms is more preferred and, a methyl group, an ethyl group, and a methylcarboxy group are even more preferred, and a methyl group is particularly preferred.

In formula (1) described above, $Y^-$ represents a counter anion and may be an inorganic anion or an organic anion. And when the charge results in 0 in a molecule, $Y^-$ is not necessary. As preferable inorganic anion, iodine ion, bromine ion, chloride ion, and the like are described and as preferable organic anion, p-toluenesulfonate ion, benzenesulfonate ion, methanesulfonate ion, trifluoromethanesulfoate ion, and the like are described. As $Y^-$, iodine ion, p-toluenesulfonate ion, and benzenesulfonate ion are preferred and, p-toluenesulfonic acid is more preferred.

In formula (1) described above, m represents 0 or 1 and 0 is preferred.

Among the compounds represented by formula (1) described above, the compound represented by the following formula (1-a) is preferred.

Formula (1-a)

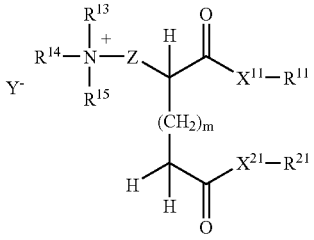

In the formula, $R^{11}$ and $R^{21}$ each independently represent a substituted or unsubstituted alkyl group, but at least one of $R^{11}$ and $R^{21}$ represents Rf described above and, $R^{11}$ and $R^{21}$ have 19 or less carbon atoms in total. $R^{13}$, $R^{14}$, and $R^{15}$ each independently represent a substituted or unsubstituted alkyl group and can form a ring by binding to each other. $X^{11}$ and $X^{21}$ each independently represent one selected from —O—, —S—, or —$NR^{31}$—. $R^{31}$ represents a hydrogen atom or a substituent, and Z represents a divalent linking group or a single bond. $Y^-$ represents a counter anion, however, when the charge results in 0 in a molecule, $Y^-$ is not necessary.

m represents 0 or 1. In the formula, Z and $Y^-$ are the same as those in formula (1) and the preferred ranges are also similar. $R^{13}$, $R^{14}$, $R^{15}$, and m are the same as those in formula (1) and the preferred ranges are also similar.

In the formula, $X^{11}$ and $X^{12}$ each independently represent one selected from —O—, —S—, or —$NR^{31}$— ($R^{31}$ represents a hydrogen atom or a substituent, and as the said substituent, the substituent described as that of $R^3$, $R^4$, and $R^5$ can be applied and as $R^{31}$, an alkyl group, Rf described above, or a hydrogen atom is preferred and, a hydrogen atom is more preferred). As $X^{11}$ and $X^{21}$, —O— or —NH— is more preferred, and —O— is even more preferred.

In the formula described above, $R^{11}$ and $R^{21}$ are the same as $R^1$ and $R^2$ in formula (1) and the preferred ranges are also similar. However, $R^{11}$ and $R^{21}$ have 19 or less carbon atoms in total, and m is 0 or 1.

Specific example of the compound represented by the above formula (1) can be described, but the present invention is not limited by following specific examples. In the following structure donations of compounds, unless otherwise indicated, an alkyl group and a perfluoroalkyl group mean a linear structure. Also, in the structure donations, 2EH means 2-ethylhexyl.

FS-1

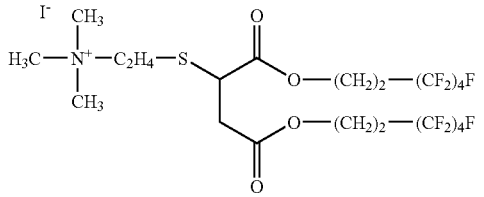

FS-2

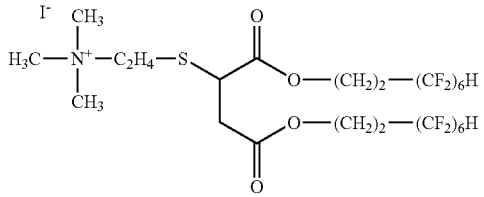

FS-3

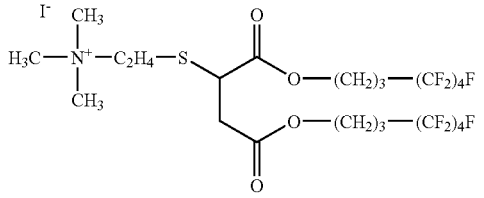

FS-4

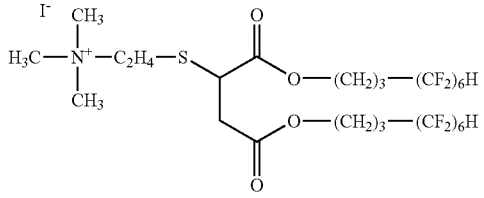

FS-5

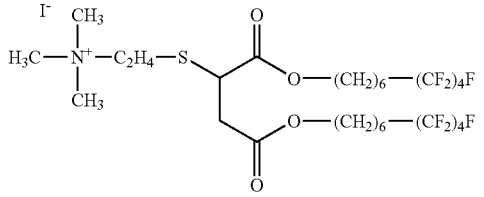

FS-6

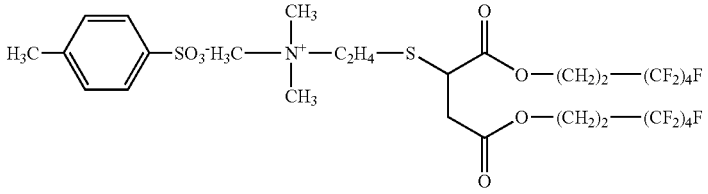

-continued
FS-7
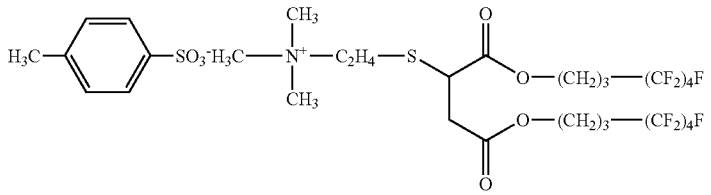
FS-8
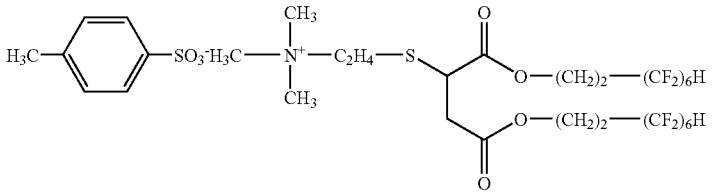
FS-9
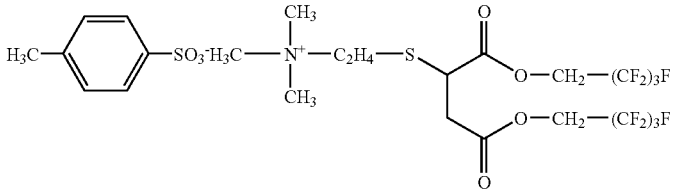
FS-10
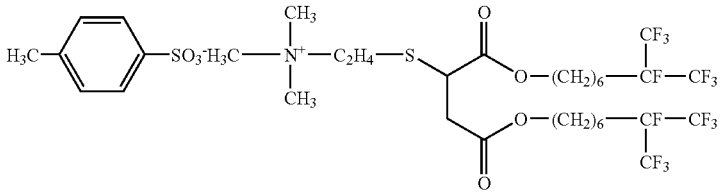
FS-11
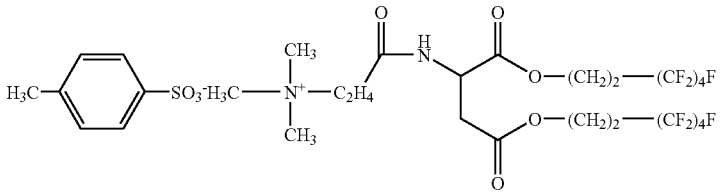
FS-12
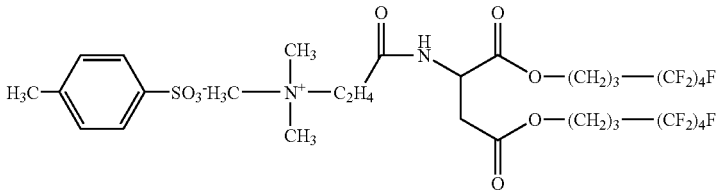
FS-13
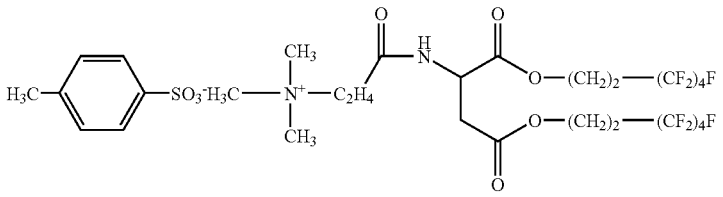
FS-14
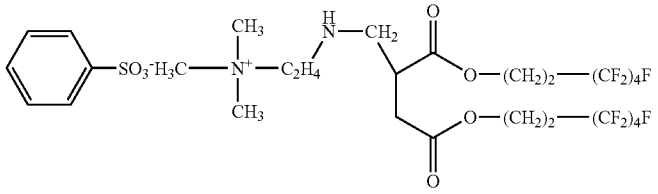

-continued
FS-15
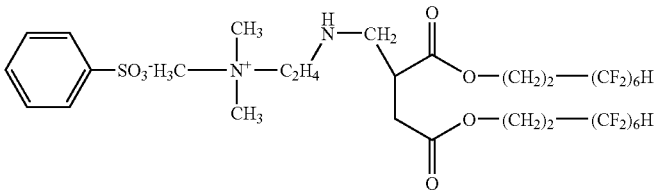
FS-16
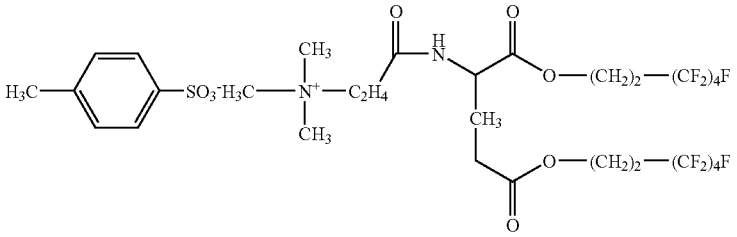
FS-17
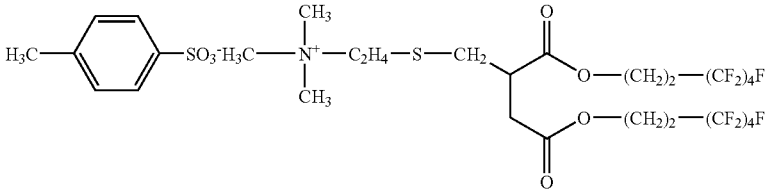
FS-18
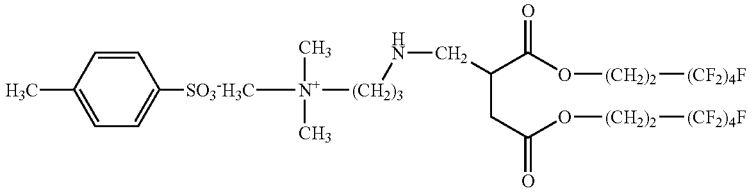
FS-19
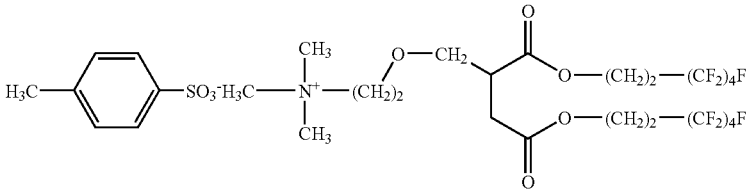
FS-20
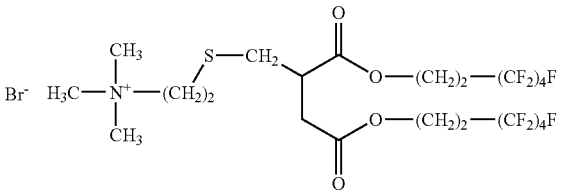
FS-21
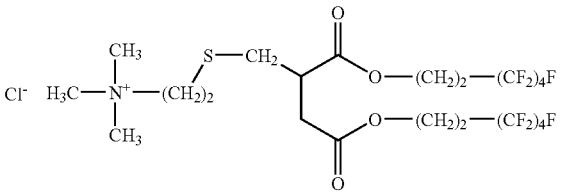

-continued
FS-22
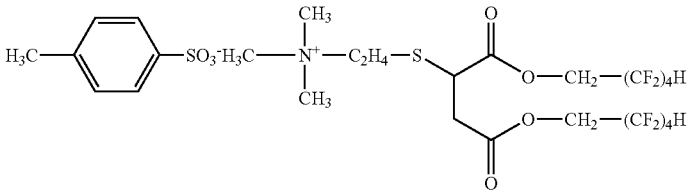
FS-23
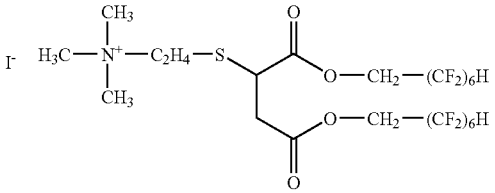
FS-24
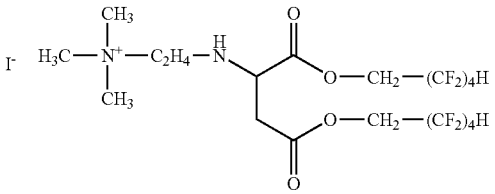
FS-25
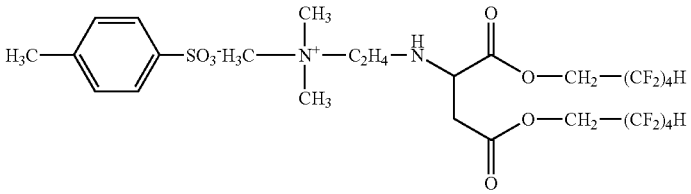
FS-26
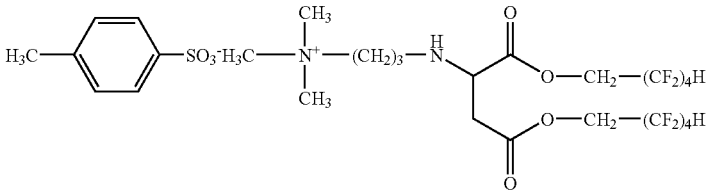
FS-27
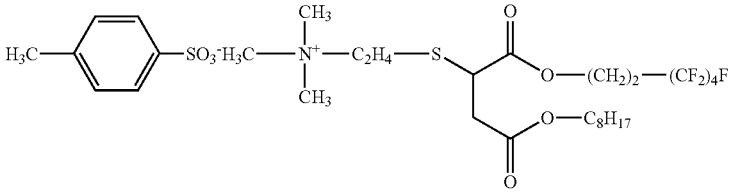
FS-28
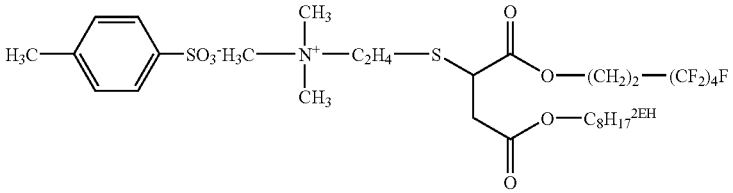
FS-29
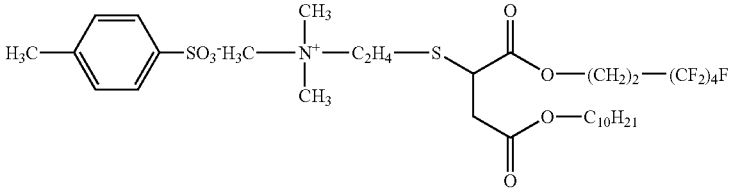

-continued
FS-30
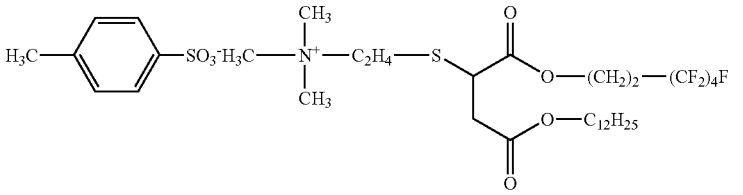
FS-31
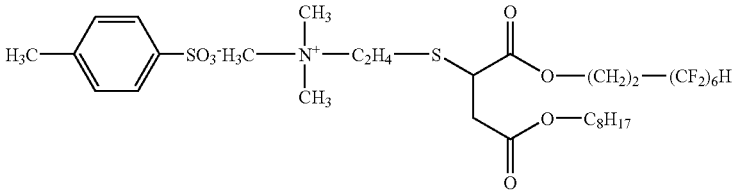
FS-32
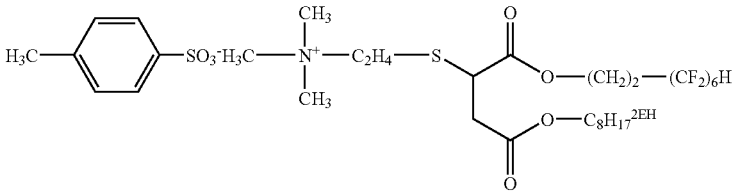
FS-33
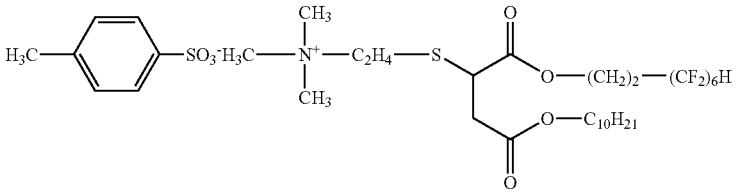
FS-34
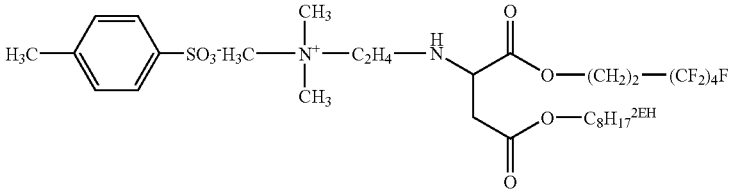
FS-35
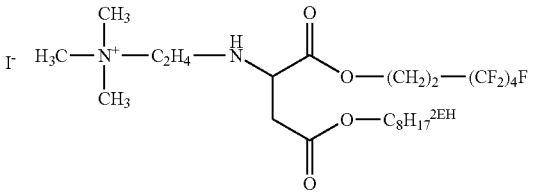
FS-36
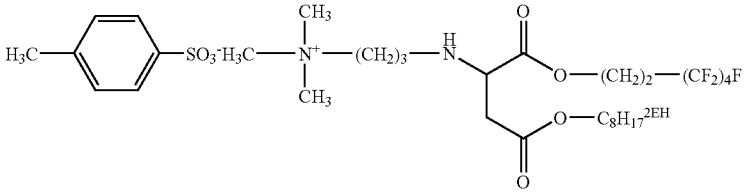
FS-37
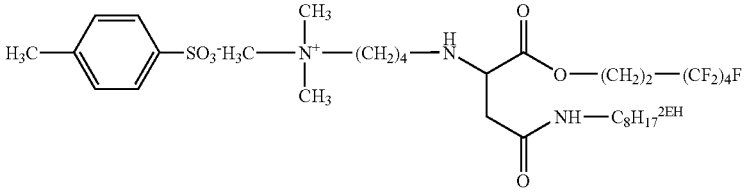

-continued
FS-38
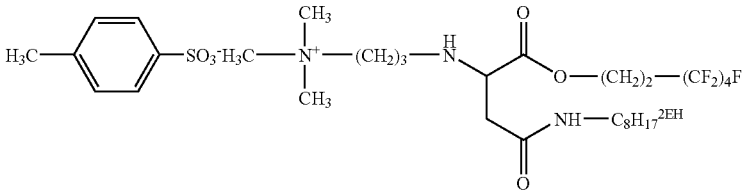
FS-39
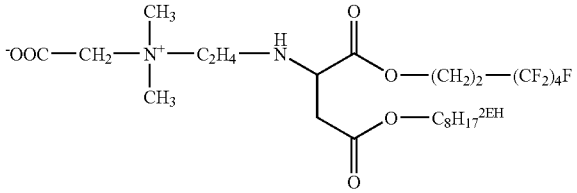
FS-40
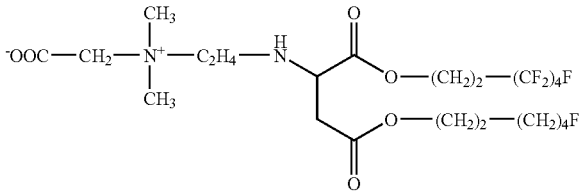
FS-41
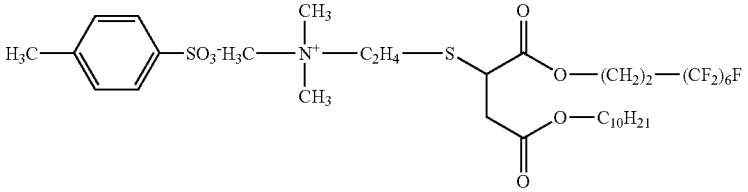
FS-42
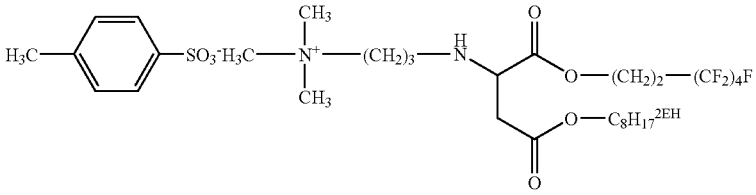
FS-43
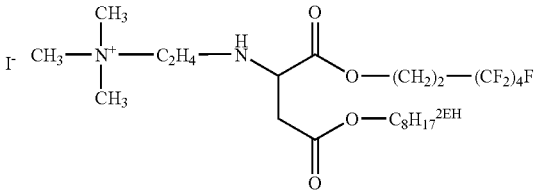
FS-44
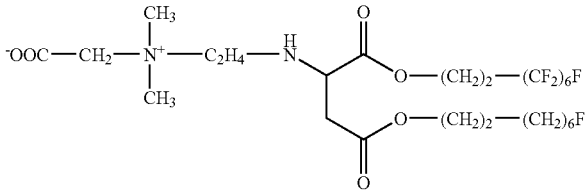
FS-45
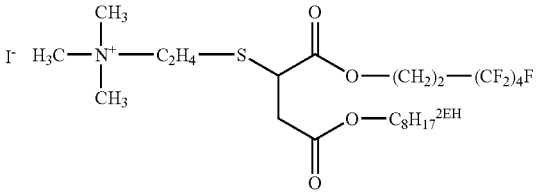

-continued
FS-46
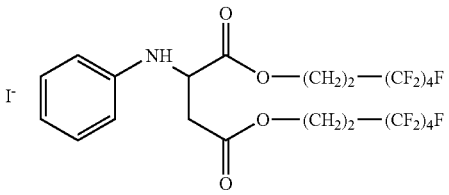
FS-47
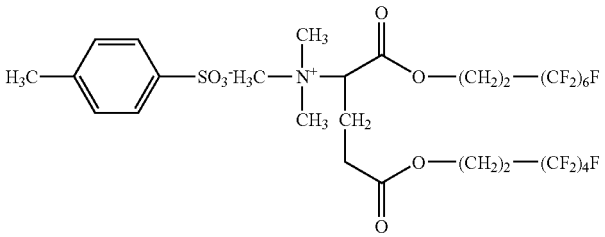
FS-48
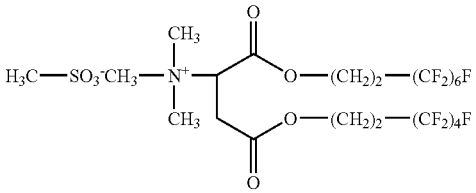
FS-49
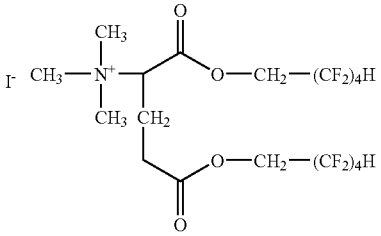
FS-50
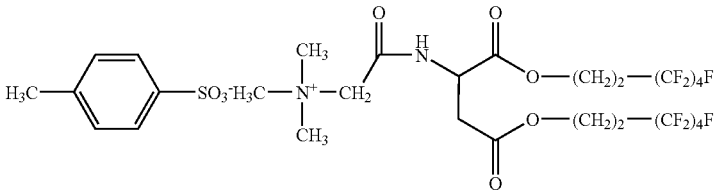
FS-51
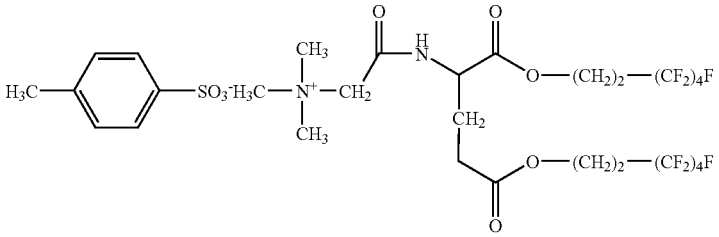
FS-52
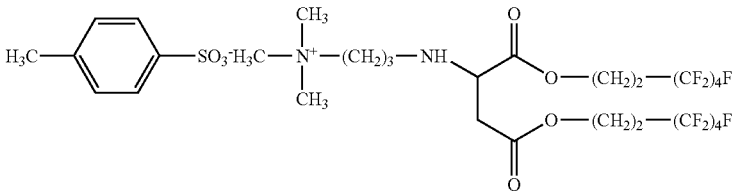

-continued
FS-53
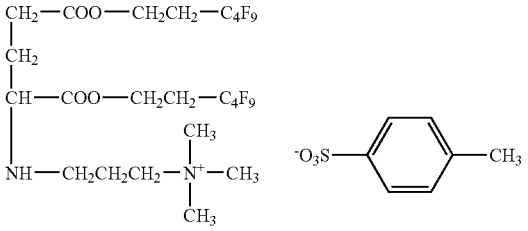
FS-54
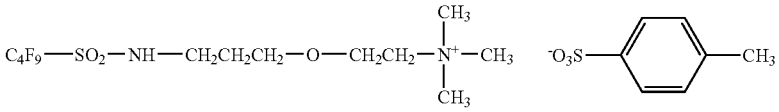
FS-55
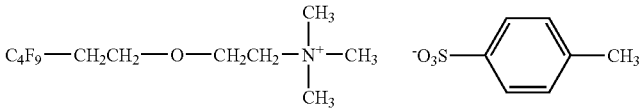
FS-56
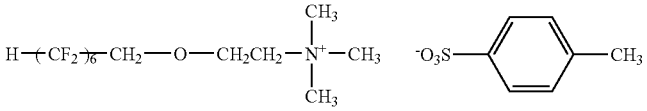
FS-57
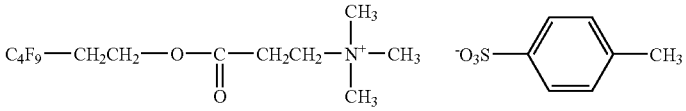
FS-58
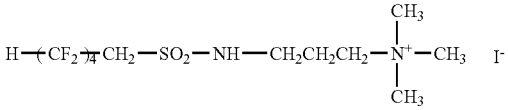
FS-59
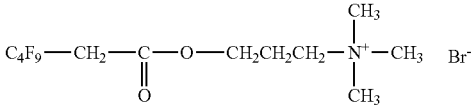
FS-60
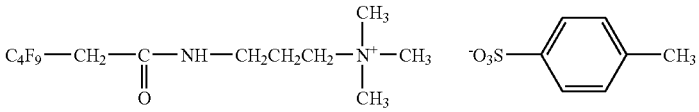
FS-61
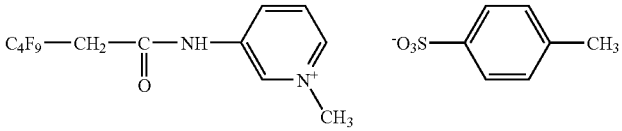
FS-62
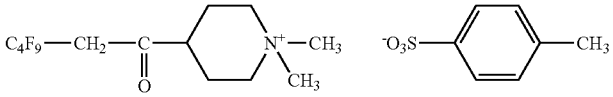
FS-63
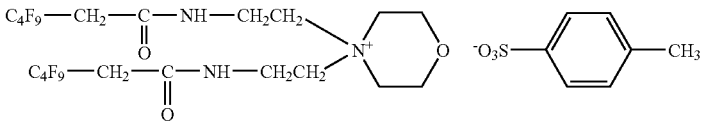
FS-64
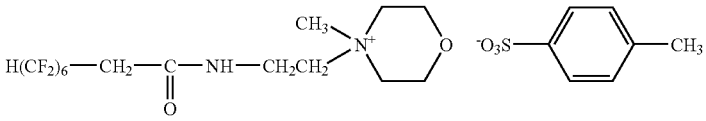

-continued

FS-65

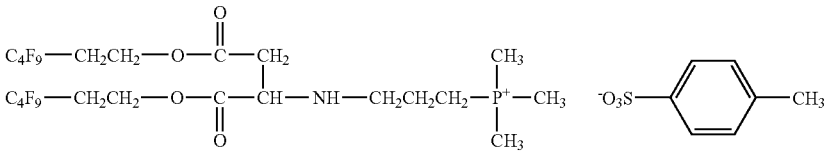

FS-66

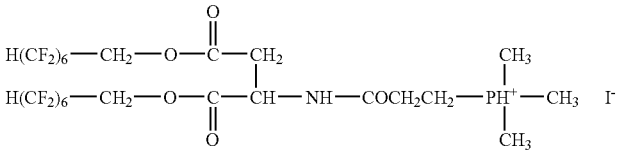

Next, an example of general synthesis of the compound represented by the above formula (1) or (1-a) of the present invention is shown, but the present invention is not limited in these.

The compounds of the present invention can be synthesized by using a fumaric acid derivative, a maleic acid derivative, an itaconic acid derivative, a glutamic acid derivative, an aspartic acid derivative, or the like as a raw material. For example, in the case where a fumaric acid derivative, a maleic acid derivative, or an itaconic acid derivative is used as a raw material, the compound of the present invention can be synthesized by cationization with an alkylating agent after the Michael addition reaction to the double bond with a nucleophilic agent.

The fluorocarbon compound of the present invention can have an anionic hydrophilic group.

The anionic hydrophilic group means an acidic group having a pKa of 7 or less and an alkali metal salt or an ammonium salt thereof. Specifically, a sulfo group, a carboxy group, a phosphonic acid group, a carbamoylsulfamoyl group, a sulfamoylsulfamoyl group, an acylsulfamoyl group or these salts can be described. Among these, a sulfo group, a carboxy group, a phosphonic acid group and these salts are preferred, and a sulfo group or a salt thereof is more preferred. As the cations to form a salt, lithium, sodium, potassium, cesium, ammonium, tetramethylammonium, tetrabutylammonium, methylpyridinium, and the like can be described. Lithium, sodium, potassium, and ammonium are preferred.

In the present invention, preferred fluorocarbon compound having an anionic hydrophilic group can be represented by the following formula (3).

Formula (3)

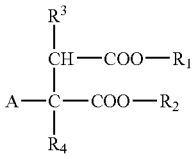

In the formula, $R^1$ and $R^2$ each independently represent an alkyl group, but at least one of them represents Rf. In the case where $R^1$ or $R^2$ represents an alkyl group other than a fluoroalkyl group, an alkyl group having 2 to 18 carbon atoms is preferred and an alkyl group having 4 to 12 carbon atoms is more preferred. $R^3$ and $R^4$ each independently represent a hydrogen atom or a substituted or unsubstituted alkyl group.

Specific examples of a fluoroalkyl group represented by $R^1$ or $R^2$ are the groups described above and the preferred structures are also those represented by formula (A) described above. And preferred structure among them is also similar to the description of fluoroalkyl group described above. Each alkyl group represented by $R^1$ and $R^2$ is preferably a fluoroalkyl group described above.

The substituted or unsubstituted alkyl group represented by $R^3$ or $R^4$ may be a linear chain, a branched chain, or a cyclic structure. The substituent described above may be any substituent, but is preferably an alkenyl group, an aryl group, an alkoxy group, a halogen. atom (preferably chlorine), a carboxylate ester group, a carbonamide group, a carbamoyl group, an oxycarbonyl group, a phosphate ester group, or the like.

A represents $-L_b-SO_3M$, and M represents a cation. Herein, as preferred examples of the cation represented by M, an alkali metal ion (lithium ion, sodium ion, potassium ion, or the like), an alkali earth metal ion (barium ion, calcium ion, or the like), an ammonium ion, and the like are described. Among these, lithium ion, sodium ion, potassium ion, and ammonium ion are preferred and, lithium ion, sodium ion, and potassium ion are more preferred, and these can be suitably selected in terms of a total number of carbon atoms of the compound in formula (3), the branch degree of the alkyl group or a substituent, and the like. In the case where the total number of carbon atoms in $R^1$, $R^2$, $R^3$, and $R^4$ is 16 or more, lithium ion for M is preferred in terms of being consistent with solubility (particularly in water) and antistatic activity or coating uniformity.

$L_b$ represents a single bond, or a substituted or unsubstituted alkylene group, and the substituent is preferably the one described in the case of $R^3$. In the case where $L_b$ is an alkylene group, $L_b$ has preferably 2 or less carbon atoms. $L_b$ is preferably a single bond or a $—CH_2—$ group, and most preferably a $—CH_2—$ group.

The compound described by the above formula (3) is more preferably combined with the above preferable embodiment each other.

Specific examples of the fluorocarbon compound for use in the present invention are described below, but the present invention is not limited by the following specific examples.

Unless otherwise indicated, an alkyl group and a perfluoroalkyl group in the structure donation of following examples mean a linear structure.

F-1

$NaO_3S-CH(CH_2-COO-C_8H_{17})-COO-CH_2CH_2C_4F_9$

F-2

$NaO_3S-CH(CH_2-COO-C_4H_9)-COO-CH_2CH_2C_4F_9$

F-3

$NaO_3S-CH(CH_2-COO-CH_2CH(C_2H_5)C_4H_9)-COO-CH_2CH_2C_4F_9$

F-4

$NaO_3S-CH(CH_2-COO-C_{12}H_{25})-COO-CH_2CH_2C_4F_9$

F-5

$NaO_3S-CH(CH_2-COO-C_8H_{17})-COO-CH_2(CF_2CF_2)_2H$

F-6

$NaO_3S-CH(CH_2-COO-C_8H_{17})-COO-CH_2(CF_2CF_2)_3H$

F-7

$NaO_3S-CH(CH_2-COO-CH_2CH_2C_4F_9)-COO-C_6H_{13}$

F-8

$NaO_3S-CH(CH_2-COO-CH_2(CF_2CF_2)_2H)-COO-CH_2CH(C_2H_5)C_4H_9$

F-9

$NaO_3S-CH(CH_2-COO-C_8H_{17})-COO-CH_2C_5F_{11}$

F-10

$NaO_3S-CH(CH_2-COO-C_4H_9)-COO-CH_2CH_2(CF_2CF_2)_3H$

F-11

$NaO_3S-CH(CH_2-COO-C_{10}H_{21})-COO-C_4F_9$

F-12

$NaO_3S-CH(CH_2-COO-(CH_2CH_2O)n-C_4H_9)-COO-CH_2CH_2C_4F_9$ $n = 5\sim15$

F-13

$NaO_3SCH_2-CH(CH_2-COO-C_8H_{17})-COO-CH_2CH_2C_4F_9$

F-14

$NaO_3SCH_2-CH(CH_2-COO-CH_2CH_2C_4F_9)-COO-C_{12}H_{25}$

F-15

$NaO_3SCH_2-CH(CH_2-COO-C_8H_{17})-COO-CH_2(CF_2CF_2)_2H$

F-16

$NaO_3SCH_2-CH(CH_2-COO-CH_2(CF_2CF_2)_3H)-COO-CH_2CH(C_2H_5)C_4H_9$

F-17

$NaO_3S-CH(CH_2-COO-CH_2CH_2C_4F_9)-COO-CH_2CH_2C_4F_9$

-continued

F-18

$NaO_3S-CH(CH_2-COO-CH_2CH_2C_3F_7)-COO-CH_2CH_2C_3F_7$

F-19

$NaO_3S-CH(CH_2-COO-CH_2CH_2C_5F_{11})-COO-CH_2CH_2C_5F_{11}$

F-20

$NaO_3S-CH(CH_2-COO-CH_2C_4F_9)-COO-CH_2C_4F_9$

F-21

$NaO_3S-CH(CH_2-COO-C_4F_9)-COO-C_4F_9$

F-22

$NaO_3S-CH(CH_2-COO-C_4F_9)-COO-CH_2CH_2C_4F_9$

F-23

$NaO_3S-CH(CH_2-COO-CH_2CH_2CF(CF_3)_2)-COO-CH_2CH_2CF(CF_3)_2$

F-24

$NaO_3S-CH(CH_2-COO-CH_2CH_2C_2F_5)-COO-CH_2CH_2C_4F_9$

F-25

$NaO_3S-CH(CH_2-COO-CH_2(CF_2CF_2)_2H)-COO-CH_2(CF_2CF_2)_2H$

F-26

$NaO_3S-CH(CH_2-COO-CH_2(CF_2CF_2)_3H)-COO-CH_2(CF_2CF_2)_3H$

F-27

$NaO_3S-CH(CH_2-COO-CH_2CF_2CF_2H)-COO-CH_2(CF_2CF_2)_3H$

F-28

$NaO_3S-CH(CH_2-COO-(CH_2CH_2O)nC_4F_9)-COO-(CH_2CH_2O)nC_4F_9$ $n = 5\sim15$

F-29

$NaO_3SCH_2-CH(CH_2-COO-CH_2CH_2C_4F_9)-COO-CH_2CH_2C_4F_9$

F-30

$NaO_3SCH_2-CH(CH_2-COO-CH_2CH_2C_3F_7)-COO-CH_2CH_2C_3F_7$

F-31

$NaO_3SCH_2-CH(CH_2-COO-CH_2CH_2C_5F_{11})-COO-CH_2CH_2C_5F_{11}$

F-32

$NaO_3SCH_2-CH(CH_2-COO-CH_2CH_2C_6F_{12}H)-COO-CH_2CH_2C_6F_{12}H$

F-33

$NaO_3SCH_2-CH(CH_2-COO-CH_2(CF_2CF_2)_2H)-COO-CH_2(CF_2CF_2)_2H$

F-34

$NaO_3SCH_2-CH(CH_2-COO-CH_2(CF_2CF_2)_3H)-COO-CH_2(CF_2CF_2)_3H$

F-35

$NaO_3SCH_2-CH(CH_2-COO-CH_2CF_2CF_2H)-COO-CH_2(CF_2CF_2)_3H$

F-36

$NaO_3SCH_2-CH(CH_2-COO-CH_2CH_2CF(CF_3)_2)-COO-CH_2CH_2CF(CF_3)_2$

-continued

F-37

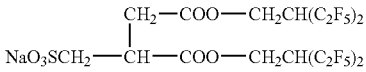

F-38

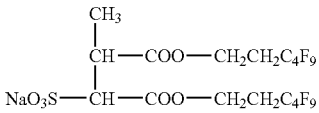

F-39

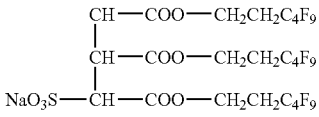

F-40

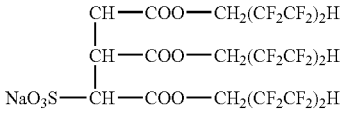

F-41

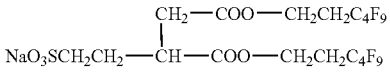

F-42

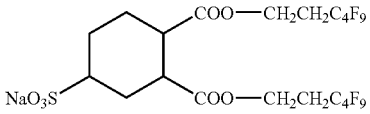

F-43

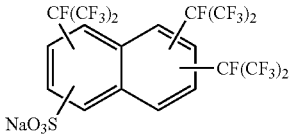

F-44

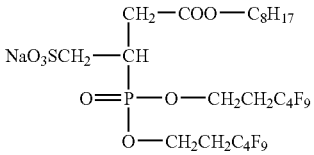

F-45

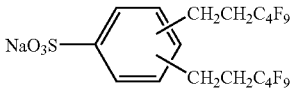

F-46

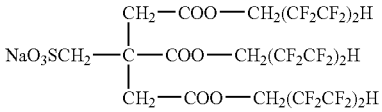

F-47

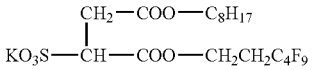

F-48

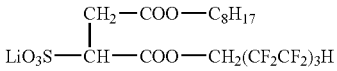

F-49

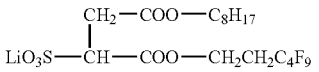

F-50

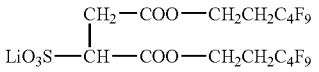

F-51

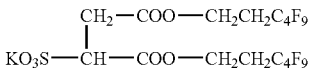

-continued

F-52

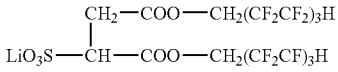

F-53

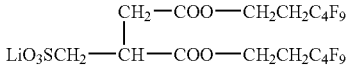

F-54

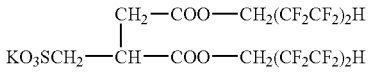

F-55

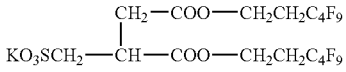

F-56

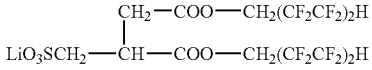

The fluorocarbon compound of the present invention can have a nonionic hydrophilic group. The nonionic hydrophilic group means the water-soluble group without dissociation as ion. Specific examples include polyoxyethylene alkyl ether, multivalent alcohol, and the like, but the invention is not limited in these.

The preferred nonionic fluorocarbon compound in the present invention can be represented by the following formula (4).

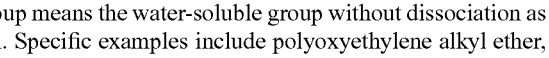

Formula (4)

In formula (4), Rf is a fluoroalkyl group described above and as specific examples, the substituents described above can be described and as the preferred structures, the above structures described in formula (A) can also be described. And the preferred structure among them is also similar to the description of Rf described above.

X in formula (4) represents a divalent linking group and is not especially limited. For example,

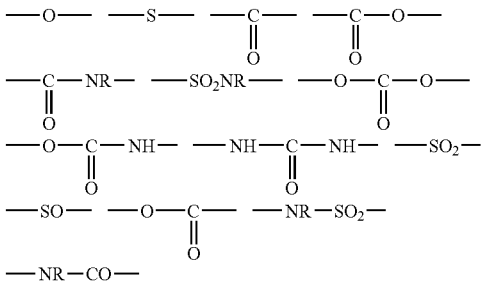

the like are described.

In formula (4), n represents an integer of 2 or 3, and m represents an integer of from 1 to 30. R represents one selected from a hydrogen atom, an alkyl group, an aryl group, a heterocyclic group, Rf, or the group having one or more Rf as a substituent.

Specific examples of the nonionic fluorocarbon compound for use in the present invention are described below, but the present invention is not limited by following specific examples.

FN-1

$C_4F_9CH_2CH_2O—(CH_2CH_2O)_n—H$ n = 5~15

FN-2

$H(CF_2)_6CH_2O—(CH_2CH_2O)_n—H$ n = 5~15

FN-3

$C_4F_9CH_2COO—(CH_2CH_2O)_n—H$ n = 5~15

FN-4

$C_4F_9CH_2CONH—(CH_2CH_2O)_n—H$ n = 5~15

FN-5

$C_4F_9CH_2SO_2NH—(CH_2CH_2O)_n—H$ n = 5~15

FN-6

$C_4F_9CH_2CH_2NHCOO—(CH_2CH_2O)_n—H$ n = 5~15

FN-7

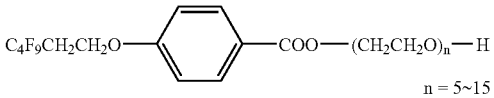

n = 5~15

FN-8

$H(CF_2)_4CH_2O—(CH_2CH_2CH_2O)_n—H$ n = 5~15

FN-9

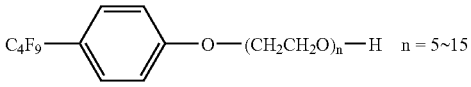

FN-10

$C_4F_9CH_2CH_2O—(CH_2CH_2O)_{n1}—(CH_2CH_2CH_2O)_{n2}—(CH_2CH_2O)_{n3}—H$ n1 = 5~10
n2 = 5~10
n3 = 5~10

FN-11

$C_4F_9CH_2CH_2O—(CH_2CH_2O)_n—CH_3$ n = 10~20

FN-12

$C_4F_9CH_2CH_2O—(CH_2CH_2O)_n—C_4H_9$ n = 10~20

FN-13

$C_4F_9CH_2CH_2O—(CH_2CH_2O)_n—CH_2CH_2C_4H_9$ n = 10~20

FN-14

$$\begin{array}{l} CH_2COO—(CH_2CH_2O)_n—CH_2CH_2C_4F_9 \\ | \\ CH_2COO—(CH_2CH_2O)_n—CH_2CH_2C_4F_9 \end{array}$$ n = 5~10

FN-15

$$\begin{array}{l} CH_2COO—(CH_2CH_2O)_n—CH_2CH_2C_4F_9 \\ | \\ CHCOO—(CH_2CH_2O)_n—CH_2CH_2C_4F_9 \\ | \\ CH_2COO—(CH_2CH_2O)_n—CH_2CH_2C_4F_9 \end{array}$$ n = 5~10

FN-16

$$\begin{array}{l} CH_2O—(CH_2CH_2O)_n—CH_2CH_2C_4F_9 \\ | \\ CHO—(CH_2CH_2O)_n—CH_2CH_2C_4F_9 \\ | \\ CH_2O—(CH_2CH_2O)_n—CH_2CH_2C_4F_9 \end{array}$$ n = 5~10

FN-17

$H—C_6F_{12}CH_2O—(CH_2CH_2O)_n—CH_2C_6F_{12}—H$ n = 5~10

FN-18

$$\begin{array}{l} \quad\quad CH_2O—(CH_2CH_2O)_n—CH_2(CF_2)_4H \\ \quad\quad | \\ C_2H_5—C—CH_2O—(CH_2CH_2O)_n—CH_2(CF_2)_4H \\ \quad\quad | \\ \quad\quad CH_2O—(CH_2CH_2O)_n—CH_2(CF_2)_4H \end{array}$$ n = 5~10

The fluorocarbon compound of the present invention is preferably used as a coating component to form either layer on the side having thereon an image forming layer. Among them, it is particularly preferred that the fluorocarbon compound is used for forming the outermost layer of photothermographic material, because of showing effective antistatic activity and coating uniformity. The fluorocarbon compound of the present invention is useful from the viewpoint of showing effective antistatic activity and coating uniformity, and also useful for storage stability and improving dependency on the using environment.

The addition amount of the fluorocarbon compound according to the present invention is not especially limited and is arbitrarily determined corresponding to the structure and the using place of the fluorocarbon compound and the series and an amount of other additive contained in a component. For example, in the case where the fluorocarbon compound is used in the coating solution for the outermost layer of a photothermographic material, the coating amount of the fluorocarbon compound in a coating solution is preferably in a range of from 0.1 $mg/m^2$ to 100 $mg/m^2$, and more preferably from 0.5 $mg/m^2$ to 20 $mg/m^2$.

In the present invention, the fluorocarbon compound may be used alone or by mixing two or more kinds thereof. Further, a fluorocarbon compound other than the fluorocarbon compound of the present invention can be used by mixing. Additionally, a surfactant other than a fluorocarbon compound can be used with the fluorocarbon compound according to the present invention in combination.

3) The others

Any additives can be added into the outermost layer.

2-2. Layer Adjacent to the Outermost Layer (Binder which Gelates)

In the present invention, a binder which gelates upon decrease in temperature can be used in the layer adjacent to the outermost layer. The binder which gelates means a water-soluble polymer derived from animal proteins described below or a water-soluble polymer which is not derived from animal protein to which a gelling agent is added, or a hydrophobic polymer.

By gelation, the layer formed by coating loses fluidity, so the surface of the image forming layer is hard to be effected by air for drying, at the drying step after coating step, and therefore, a photothermographic material with uniformly coated surface can be obtained.

Herein, it is important that a coating solution does not been gelled at the coating step. It is convenient for operation that the coating solution has fluidity at the coating step and loses fluidity by gelation before the drying step after coating step.

Viscosity of the said coating solution at a coating step is preferably from 5 mPa·s to 200 mPa·s, and more preferably from 10 mPa·s to 100 mPa·s.

In the present invention, an aqueous solvent is used as a solvent for a coating solution.

Though it is difficult to measure the viscosity of formed layer at the time before the drying step and after coating step (at this point, gelation occurs), it is guessed that the viscosity is about from 200 mPa·s to 5,000 mPa·s, and preferably from 500 mPa·s to 5,000 mPa·s.

The temperature for gelation is not specifically limited, however to consider the easy work operation of coating, the temperature for gelation is preferably nearly about a room temperature. Because at this temperature, it is easy to make the fluidity increase for easy coating of a coating solution and the fluidity can be maintained (that is namely the temperature level, in which the elevated temperature can be maintained easily) and this is the temperature that the cooling can be easily operated to make the fluidity of formed layer lose after coating. Preferable temperature for gelation is from 0° C. to 40° C., and more preferably from 0° C. to 35° C.

The temperature of a coating solution at coating step is not specifically limited as far as the temperature is set higher than a temperature for gelation, and the cooling temperature at the point before drying step and after coating step is not specifically limited as far as the temperature is set lower than a temperature for gelation. However, when the difference between the temperature of coating solution and a cooling temperature is small, the problem that gelation starts during coating step occurs and an uniform coating can not be performed. On the other hand, when the temperature of coating solution is set too high to make this temperature difference large, it causes the problem that the solvent of coating solution is evaporated and viscosity is changed. Therefore, the difference of temperatures is preferably set up in a range of from 5° C. to 50° C., more preferably from 10° C. to 40° C.

(Water-Soluble Polymer Derived from Animal Protein)

In the present invention, the polymer derived from animal protein means natural or chemically modified water-soluble polymer such as glue, casein, gelatin, egg white, or the like.

It is preferably gelatin, which include acid-processed gelatin and alkali-processed gelatin (lime-processed gelatin or the like) depending on a synthetic method and any of them can be preferably used. The molecular weight of gelatin used is preferably from 10,000 to 1,000,000. Modified gelatin, modification of gelatin utilizing an amino group or a carboxy group of gelatin (e.g., phthalated gelatin or the like), can be also used.

In an aqueous gelatin solution, solation occurs when gelatin is heated to 30° C. or higher, and gelation occurs and the solution loses fluidity when it is cooled to lower than 30° C. As this sol-gel exchange occurs reversibly, an aqueous gelatin solution as a coating solution has setting ability. That means, gelatin solution loses fluidity when it is cooled to a temperature lower than 30° C.

In the coating solution, the content of water-soluble polymer derived from animal protein is from 1% by weight to 20% by weight, preferably from 2% by weight to 12% by weight, with respect to the total coating solution.

(Water-Soluble Polymer which is not Derived from Animal Protein)

In the present invention, a water-soluble polymer which is not derived from an animal protein means a natural polymer (polysaccharide series, microorganism series, or animal series) except for animal protein such as gelatin or the like, a semi-synthetic polymer (cellulose series, starch series, or alginic acid series), and a synthetic polymer (vinyl series or others) and corresponds to synthetic polymer such as poly (vinyl alcohol) described below and natural or semi-synthetic polymer made by cellulose or the like derived from plant as a raw material. Poly(vinyl alcohols) and acrylic acid-vinyl alcohol copolymers are preferable. To use the water-soluble polymer which is not derived from an animal protein in the layer adjacent to the outermost layer, the polymer is used in combination with the gelling agent described below because the water-soluble polymer which is not derived from an animal protein has no setting ability.

1) Poly(Vinyl Alcohols)

The water-soluble polymer which is not derived from an animal protein according to the present invention is preferably poly(vinyl alcohols).

As the poly(vinyl alcohol) (PVA) preferably used in the present invention, there are compounds that have various degree of saponification, degree of polymerization, degree of neutralization, modified compound, and copolymers with various monomers as described below.

As fully saponified compound, it can be selected among PVA-105 [poly(vinyl alcohol) (PVA) content: 94.0% by weight or more, degree of saponification: 98.5±0.5 mol %, content of sodium acetate: 1.5% by weight or less, volatile constituent: 5.0% by weight or less, viscosity (4% by weight at 20° C.): 5.6±0.4 CPS], PVA-110 [PVA content: 94.0% by weight, degree of saponification: 98.5±0.5 mol %, content of sodium acetate: 1.5% by weight, volatile constituent: 5.0% by weight, viscosity (4% by weight at 20° C.): 11.0±0.8 CPS], PVA-117 [PVA content: 94.0% by weight, degree of saponification: 98.5 ±0.5 mol %, content of sodium acetate: 1.0% by weight, volatile constituent: 5.0% by weight, viscosity (4% by weight at 20° C.): 28.0±3.0 CPS], PVA-117H[PVA content: 93.5% by weight, degree of saponification: 99. 6±0.3 mol %, content of sodium acetate: 1.85% by weight, volatile constituent: 5.0% by weight, viscosity (4% by weight at 20° C.): 29.0±0.3 CPS], PVA-120 [PVA content: 94.0% by weight, degree of saponification: 98.5±0.5 mol %, content of sodium acetate: 1.0% by weight, volatile constituent: 5.0% by weight, viscosity (4% by weight at 20° C.): 39.5±4.5 CPS], PVA-124 [PVA content: 94.0% by weight, degree of saponification: 98.5±0.5 mol %, content of sodium acetate: 1.0% by weight, volatile constituent: 5.0% by weight, viscosity (4% by weight at 20° C.): 60.0±6.0 CPS], PVA-124H [PVA content: 93.5% by weight, degree of saponification: 99.6±0.3 mol %, content of sodium acetate: 1.85% by weight, volatile constituent: 5.0% by weight, viscosity (4% by weight at 20° C.): 61.0±6.0 CPS], PVA-CS [PVA content: 94.0% by weight, degree of saponification: 97.5±0.5 mol %, content of sodium acetate: 1.0% by weight, volatile constituent: 5.0% by weight, viscosity (4% by weight at 20° C.): 27.5±3.0 CPS], PVA-CST [PVA content: 94.0% by weight, degree of saponification: 96.0±0.5 mol %, content of sodium acetate: 1.0% by weight, volatile constituent: 5.0% by weight, viscosity (4% by weight at 20° C.): 27.0±3.0 CPS], PVA-HC [PVA content: 90.0% by weight, degree of saponification: 99.85 mol % or more, content of sodium acetate: 2.5% by weight, volatile constituent: 8.5% by weight, viscosity (4% by weight at 20° C.): 25.0±3.5 CPS] (above all trade names, produced by Kuraray Co., Ltd.), and the like.

As partial saponified compound, it can be selected among PVA-203 [PVA content: 94.0% by weight, degree of saponification: 88.0±1.5 mol %, content of sodium acetate: 1.0% by weight, volatile constituent: 5.0% by weight, viscosity (4% by weight at 20° C.): 3.4±0.2 CPS], PVA-204[PVA content: 94.0% by weight, degree of saponification: 88.0±1.5 mol %, content of sodium acetate: 1.0% by weight, volatile constituent: 5.0% by weight, viscosity (4% by weight at 20° C.): 3.9±0.3 CPS], PVA-205 [PVA content: 94.0% by weight, degree of saponification: 88.0±1.5 mol %, content of sodium acetate: 1.0% by weight, volatile substance: 5.0% by weight, viscosity (4% by weight at 20° C.): 5.0±0.4 CPS], PVA-210 [PVA content: 94.0% by weight, degree of saponification: 88.0±1.0 mol %, content of sodium acetate: 1.0% by weight, volatile constituent: 5.0% by weight, viscosity (4% by weight at 20° C.): 9.0±1.0 CPS], PVA-217 [PVA content: 94.0% by weight, degree of saponification: 88.0±1.0 mol %, content of sodium acetate: 1.0% by weight, volatile constituent: 5.0% by weight, viscosity (4% by weight at 20° C.): 22.5±2.0 CPS], PVA-220 [PVA content: 94.0% by weight, degree of saponification: 88.0±1.0 mol %, content of sodium acetate: 1.0% by weight, volatile constituent: 5.0% by weight, viscosity (4% by weight at 20° C.): 30.0±3.0 CPS], PVA-224 [PVA content: 94.0% by weight, degree of saponification: 88.0±1.5 mol %, content of sodium acetate: 1.0% by weight, volatile constituent: 5.0% by weight, viscosity (4% by weight at 20° C.): 44.0±4.0 CPS], PVA-228 [PVA content: 94.0% by weight, degree of saponification: 88.0±1.5 mol %, content of sodium acetate: 1.0% by weight, volatile constituent: 5.0% by weight, viscosity (4% by weight at 20° C.): 65.0±5.0 CPS], PVA-235 [PVA content: 94.0% by weight, degree of saponification: 88.0±1.5 mol %, content of sodium acetate: 1.0% by weight, volatile constituent: 5.0% by weight, viscosity (4% by weight at 20° C.): 95.0±15.0 CPS], PVA-217EE [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-217E [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-220E [PVA content: 94.0% by weight, degree of saponification: 88.0±1.0 mol %, content of sodium acetate: 1.0% by weight, volatile constituent: 5.0% by weight, viscosity (4% by weight at 20° C.): 31.0±4.0 CPS], PVA-224E [PVA content: 94.0% by weight, degree of saponification: 88.0±1.0 mol %, content of sodium acetate: 1.0% by weight, volatile constituent: 5.0% by weight, viscosity (4% by weight at 20° C.): 45.0±5.0 CPS], PVA-403 [PVA content: 94.0% by weight, degree of saponification: 80.0±1.5 mol %, content of sodium acetate: 1.0% by weight, volatile constituent: 5.0% by weight, viscosity (4% by weight at 20° C.): 3.1±0.3 CPS], PVA-405 [PVA content: 94.0% by weight, degree of saponification: 81.5±1.5 mol %, content of sodium acetate: 1.0% by weight, volatile constituent: 5.0% by weight, viscosity (4% by weight at 20° C.): 4.8±0.4 CPS], PVA-420 [PVA content: 94.0% by weight, degree of saponification: 79.5±1.5 mol %, content of sodium acetate: 1.0% by weight, volatile constituent: 5.0% by weight], PVA-613 [PVA content: 94.0% by weight, degree of saponification: 93.5±1.0 mol %, content of sodium acetate: 1.0% by weight, volatile constituent: 5.0% by weight, viscosity (4% by weight at 20° C.): 16.5±2.0 CPS], L-8 [PVA content: 96.0% by weight, degree of saponification: 71.0±1.5 mol %, content of sodium acetate: 1.0% by weight (ash), volatile constituent: 3.0% by weight, viscosity (4% by weight at 20° C.): 5.4±0.4 CPS] (above all are trade names, produced by Kuraray Co., Ltd.), and the like.

The above values were measured in the manner described in JISK-6726-1977.

As modified poly(vinyl alcohol), it can be selected among cationic modified compound, anionic modified compound, modified compound by —SH compound, modified compound by alkylthio compound and modified compound by silanol. Further, the modified poly(vinyl alcohol) described in "POVAL" (Koichi Nagano et. al., edited by Kobunshi Kankokai) can be used.

As this modified poly(vinyl alcohol) (modified PVA), there are C-118, C-318, C-318-2A, C-506 (above all are trade names, produced by Kuraray Co., Ltd.) as C-polymer, HL-12E, HL-1203 (above all are trade name, produced by Kuraray Co., Ltd.) as HL-polymer, HM-03, HM-N-03 (above all are trade marks, produced by Kuraray Co., Ltd.) as HM-polymer, M-115 (trade mark, produced by Kuraray Co., Ltd.) as M-polymer, MP-102, MP-202, MP-203 (above all are trade mark, produced by Kuraray Co., Ltd.) as MP-polymer, MPK-1, MPK-2, MPK-3, MPK-4, MPK-5, MPK-6 (above all are trade marks, produced by Kuraray Co., Ltd.) as MPK-polymer, R-1130, R-2105, R-2130 (above all are trade marks, produced by Kuraray Co., Ltd.) as R-polymer, V-2250 (trade mark, produced by Kuraray Co., Ltd.) as V-polymer, and the like.

Viscosity of aqueous solution of poly(vinyl alcohol) can be controlled or stabilized by addition of small amount of solvent or inorganic salts, which are described in detail in above literature "POVAL" (Koichi Nagano et. al., edited by Kobunshi Kankokai, pages 144 to 154). The typical example incorporates boric acid to improve the surface quality of coating, and it is preferable. The addition amount of boric acid is preferably from 0.01% by weight to 40% by weight with respect to poly(vinyl alcohol).

It is also described in above-mentioned "POVAL" that the crystallization degree of poly(vinyl alcohol) is improved and water resisting property is improved by heat treatment. The binder can be heated at coating-drying process or can be additionally subjected to heat treatment after drying, and therefore, poly(vinyl alcohol), which can be improved in water resisting property during those processes, is particularly preferable among water-soluble polymers.

Furthermore, it is preferred that a water resistance improving agent such as those described in above "POVAL" (pages 256 to 261) is added. As examples, there can be mentioned aldehydes, methylol compounds (e.g., N-methylolurea, N-methylolmelamine, or the like), active vinyl compounds (divinylsulfones, derivatives thereof, or the like), bis(β-hydroxyethylsulfones), epoxy compounds (epichlorohydrin, derivatives thereof, or the like), polyvalent carboxylic acids (dicarboxylic acids, poly(acrylic acid) as poly(carboxylic acid), methyl vinyl ether/maleic acid copolymers, isobutylene/maleic anhydride copolymers, or the like), diisocyanates, and inorganic crosslinking agents (Cu, B, Al, Ti, Zr, Sn, V, Cr, or the like).

In the present invention, inorganic crosslinking agents are preferable as a water resistance improving agent. Among these inorganic crosslinking agents, boric acid and derivatives thereof are preferred and boric acid is particularly preferable. Specific examples of the boric acid derivative are shown below.

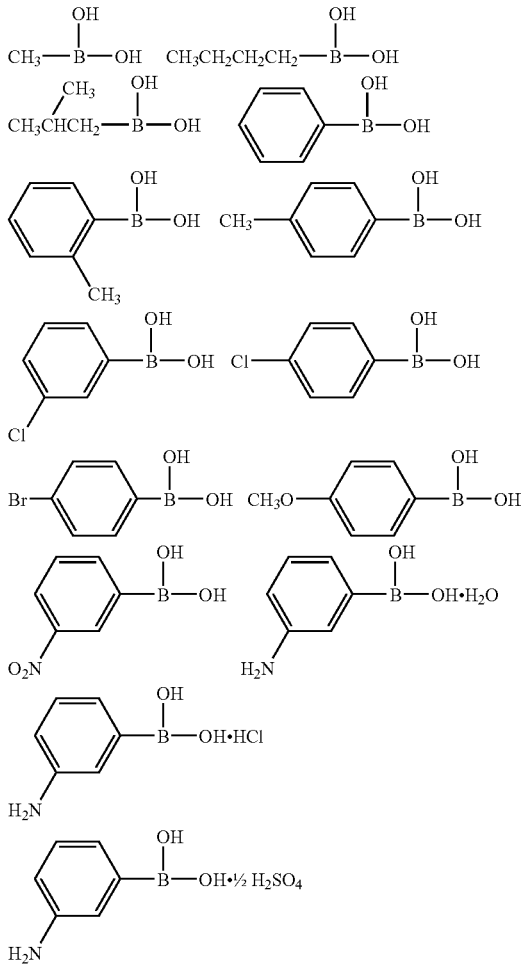

The addition amount of the water resistance improving agent is preferably in a range of from 0.01% by weight to 40% by weight with respect to poly(vinyl alcohol).

2) Other Water-Soluble Polymers not Derived from Animal Protein

Water-soluble polymers which are not derived from animal protein in the present invention besides above-mentioned poly(vinyl alcohol) are described below.

As typical examples, plant polysaccharides such as gum arabic, κ-carrageenan, ι-carrageenan, λ-carrageenan, guar gum (Supercol produced by SQUALON Co. or the like), locust bean gum pectin, tragacanth gum, corn starch (Purity-21 produced by National Starch & Chemical Co. or the like), starch phosphate (National 78-1898 produced by National Starch & Chemical Co. or the like), and the like are included.

Also as polysaccharides derived from microorganism, xanthan gum (Keltrol T produced by KELCO Co. and the like), dextrin (Nadex 360 produced by National Starch & Chemical Co. or the like) and as animal polysaccharides, sodium chondroitin sulfate (Cromoist CS produced by CRODA Co. or the like), and the like are included.

And as cellulose polymer, ethyl cellulose (Cellofas WLD produced by I.C.I. Co. or the like), carboxymethyl cellulose (CMC produced by Daicel Chemical Industries, Ltd. or the like), hydroxyethyl cellulose (HEC produced by Daicel Chemical Industries, Ltd. or the like), hydroxypropyl cellulose (Klucel produced by AQUQLON Co. or the like), methyl cellulose (Viscontran produced by HENKEL Co. or the like), nitrocellulose (Isopropyl Wet produced by HELCLES Co. or the like), cationized cellulose (Crodacel QM produced by CRODA Co. or the like), and the like are included. As alginic acid series, sodium alginate (Keltone produced by KELCO Co. or the like), propylene glycol alginate, and the like and as other classification, cationized guar gum (Hi-care 1000 produced by ALCOLAC Co. or the like) and sodium hyaluronate (Hyalure produced by Lifecare Biomedial Co. or the like) are included.

As others, agar, furcelleran, guar gum, karaya gum, larch gum, guar seed gum, psylium seed gum, kino's seed gum, tamarind gum, tara gum and the like are included. Among them, highly water-soluble compound is preferable and the compound in which can solution sol-gel conversion can occur within 24 hours at a temperature change in a range of from 5° C. to 95° C. is preferably used.

Concerning synthetic polymers, sodium polyacrylate, poly (acrylic acid)copolymers, polyacrylamide, polyacrylamide copolymers and the like as acryl series, poly(vinyl pyrrolidone), poly(vinyl pyrrolidone)copolymers and the like as vinyl series and poly(ethylene glycol), poly(propylene glycol), poly(vinyl ether), poly(ethylene imine), poly(styrene sulfonic acid) and copolymers thereof, poly(acrylic acid) and copolymers thereof, poly(vinyl sulfanic acid) and copolymers thereof, maleic acid copolymers, maleic acid monoester copolymers, acryloylmethylpropane sulfonic acid and copolymers thereof, and the like are included.

High-water-absorbable polymers described in U.S. Pat. No. 4,960,681, JP-A No. 62-245260 and the like, namely such as homopolymers of vinyl monomer having —COOM or —$SO_3M$ (M represents a hydrogen atom or an alkali metal) or copolymers of their vinyl monomers or other vinyl monomers (e.g., sodium methacrylate, ammonium methacrylate, or Sumikagel L-5H produced by SUMITOMO KAGAKU Co.) can be also used.

Among these, Sumikagel L-5H produced by SUMITOMO KAGAKU Co.) is preferably used as the water-soluble polymer.

Coating amount of the water-soluble polymer is preferably from 0.3 g/$m^2$ to 4.0 g/$m^2$ per one $m^2$ of the support, and more preferably from 0.5 g/$m^2$ to 2.0 g/$m^2$.

And it is preferred that the concentration of the water-soluble polymer in a coating solution is arranged to have suitable viscosity for simultaneous multilayer coating after the addition, but it is not specifically limited. Generally, the concentration of the water-soluble polymer in solution is from 0.01% by weight to 30% by weight, and is preferably from 0.05% by weight to 20% by weight, and particularly preferably 0.1% by weight to 10% by weight. The viscosity gain obtained by these addition is preferably from 1 mPa·s to 200 mPa·s with respect to the previous viscosity, and more preferably from 5 mPa·s to 100 mPa·s. The viscosities above mentioned were measured with B-type rotating viscosity meter at 25° C. The glass transition temperature of the water-soluble polymer preferably used in the present invention is not especially limited, but is preferably from 60° C. to 220° C. in term of brittleness such as a belt mark by thermal development, dust adhering at manufacturing, or the like. It is more preferably from 70° C. to 200° C., even more preferably from 80° C. to 180° C., and most preferably from 90° C. to 170° C.

A polymer which is dispersible to an aqueous solvent may be used in combination with the water-soluble polymer which is not derived from an animal protein.

Suitable as the polymer which is dispersible to an aqueous solvent are those that are synthetic resin or polymer and their copolymer; or media forming a film; for example, included are cellulose acetates, cellulose acetate butyrates, poly(methylmethacrylic acids), poly(vinyl chlorides), poly(methacrylic acids), styrene-maleic anhydride copolymers, styrene-acrylonitrile copolymers, styrene-butadiene copolymers, poly(vinyl acetals) (for example, poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides.

Preferable latexes are described above in the following explanation of latex polymer. The latex is mixed in an amount of from 1% by weight to 70% by weight, and preferably from 5% by weight to 50% by weight, with respect to the water-soluble polymer which is not derived from an animal protein.

(Polymer Latex)

The polymer latex usable in the invention is in a state where water-insoluble fine particles of hydrophobic polymer are dispersed in water.

The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle size distribution. From the viewpoint of controlling the physical properties of the coating solution, preferred mode of usage includes mixing two or more types of dispersions each having monodisperse particle distribution.

In the invention, preferred embodiment of the latex polymer includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer (for example, urethane-vinyl copolymers containing an acidic group, or the like described in U.S. Pat. No. 6,077,648). The molecular weight of these polymers is, in number average molecular weight, in a range of from 5,000 to 1,000,000, and preferably from 10,000 to 200,000. Those having too small a molecular weight exhibit insufficient mechanical strength on forming a layer in which the polymer is added, and those having too large a molecular weight are also not preferred because the resulting film-forming properties are poor. Further, crosslinking polymer latexes are particularly preferred for use.

1) Specific Examples of Latex

Specific examples of preferred polymer latex are given below, which are expressed by the starting monomers with % by weight given in parenthesis. The molecular weight is given in number average molecular weight. In the case where polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg −17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)- (crosslinking)

P-9; Latex of -St(70)-Bu(25)-DVB(2)-AA(3)- (crosslinking)

P-10; Latex of -VC(50)-MMA(20)-EA(20)-AN(5)-AA(5)- (molecular weight 80000)

P-11; Latex of -VDC(85)-MMA(5)-EA(5)-MAA(5)- (molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

2) Preferable Latexes

Particularly preferable as the polymer latex for use in the invention are that of styrene-butadiene copolymer. The mass ratio of monomer unit of styrene to that of butadiene constituting the styrene-butadiene copolymer is preferably in a range of from 40:60 to 95:5.

Furthermore, in the copolymer polymerized with two or more monomers, the sum of the styrene monomer unit and the butadiene monomer unit preferably account for the ratio of from 60% by weight to 99% by weight, based on the total copolymer. The copolymer for use in the present invention is preferably polymerized containing acrylic acid or methacrylic acid in an amount of from 1% by weight to 6% by weight, based on the sum of styrene and butadiene, and more preferably containing acrylic acid or methacrylic acid in an amount of 2% by weight to 5% by weight. Particularly, the copolymer polymerized in presence of acrylic acid is preferred. The preferred range of the molecular weight is similar to that described above.

As the latex of styrene-butadiene copolymer preferably used in the invention, there can be mentioned P-3 to P-8, and P-15, or commercially available LACSTAR-3307B, 7132C, Nipol Lx416, and the like.

3) Layer in which Polymer Latex can be Added

In the photothermographic material of the present invention, the polymer latex is used for the binder of the outermost surface layer. When the polymer latex is used as a binder for the layer adjacent to the outermost layer, a gelling agent is used with the polymer latex because the polymer latex has no setting ability.

Further, the polymer latex can be used as a binder for the layer other than the outermost layer and the layer adjacent to the outermost layer. In the case where the polymer latex is used in the layer other than the outermost layer, if necessary, there may be added a hydrophilic polymer such as gelatin, poly(vinyl alcohol), methyl cellulose, hydroxypropyl cellulose, carboxymethyl cellulose, or the like. The hydrophilic polymers above are preferably added in an amount of 30% by weight or less, and more preferably 20% by weight or less, with respect to the total weight of the binder incorporated in the layer.

4) Addition Amount

In the case of using the polymer latex in the outermost layer, the content of polymer is preferably from 3% by weight to 40% by weight, and more preferably from 5% by weight to 30% by weight, with respect to the entire coating solution.

In the case of using the polymer latex in the layer adjacent to the outermost layer, the content of polymer is preferably from 5% by weight to 60% by weight, and more preferably from 10% by weight to 50% by weight with respect to the entire coating solution, similar to that described in the explanation of [Binder which gelates].

(Gelling Agent)

A gelling agent according to the present invention is a compound which can gelate when it is added into an aqueous solution of the water-soluble polymer which is not derived from an animal protein or an aqueous latex solution of the hydrophobic polymer and cooled, or a compound which can gelate when it is further used with the galation accelerator. The fluidity is remarkably decreased by the occurrence of gelation.

The following water-soluble polysaccharides can be described as the specific examples of the gelling agent. Namely these are at least one kind selected from the group consisting of agar, κ-carrageenan, ι-carrageenan, alginic acid, alginate, agarose, furcellaran, jellan gum, glucono-δ-lactone, azotobactor vinelandii gum, xanthan gum, pectin, guar gum, locust bean gum, tara gum, cassia gum, glucomannan, tragacanth gum, karaya gum, pullulan, gum arabic, arabinogalactan, dextran, sodium carboxymethyl cellulose, methyl cellulose, cyalume seed gum, starch, chitin, chitosan, and curdlan.

As the compounds which can gelate by cooling after melted by heating, agar, carrageenan, jellan gum, and the like are included.

Among these gelling agents, i -carrageenan (e.g., K-9F produced by DAITO Co.: K-15, 21, 22, 23, 24 and I-3 produced by NITTA GELATIN Co.), ι-carrageenan, and agar are preferable, and κ-carrageenan is particularly preferable.

The gelling agent is preferably used in a range from 0.01% by weight to 10.0% by weight, preferably from 0.02% by weight to 5.0% by weight, and more preferably from 0.05% by weight to 2.0% by weight, with respect to the binder polymer.

The gelling agent is preferably used with a gelation accelerator. A gelation accelerator in the present invention is a compound which accelerates gelation by contact with a gelling agent, whereby the gelling function can be developed by specific combination with the gelling agent. In the present invention, the combinations of the gelling agent and the gelation accelerator such as shown below can be used.

<1> The combination of alkali metal ions such as potassium ion or the like or alkali earth metal ions such as calcium ion, magnesium ion, or the like as the gelation accelerator and carrageenan, alginate, azotobactor vinelandii gum, pectin, sodium carboxymethyl cellulose, or the like as the gelling agent;

<2> the combination of boric acid or other boron compounds as the gelation accelerator and guar gum, locust bean gum, tara gum, cassia gum, or the like as the gelling agent;

<3> the combination of acids or alkali compounds as the gelation accelerator and alginate, glucomannan, pectin, chitin, chitosan, curdlan, or the like as the gelling agent;

<4> a water-soluble polysaccharides which can form gel by reaction with the gelling agent is used as the galation accelerator. As typical examples, the combination of xanthan gum as the gelling agent and cassia gum as the gelation accelerator, and the combination of carrageenan as the gelling agent and locust bean gum as the gelation accelerator;

and the like are illustrated.

As the typical examples of the combination of these gelling agents and gelation accelerators, the following combinations a) to g) can be described.

a) Combination of κ-carrageenan and potassium;

b) combination of ι-carrageenan and calcium;

c) combination of low methoxyl pectin and potassium;

d) combination of sodium alginate and potassium;

e) combination of locust bean gum and xanthan gum;

f) combination of jellan gum and acid;

g) combination of locust bean gum and xanthan gum.

These combinations may be used simultaneously as plural combinations.

Although the gelation accelerator can be added to the same layer as the layer in which the gelling agent is added, it is preferably added in a different layer as to react. It is more preferable to add the galation accelerator to the layer not directly adjacent to the layer containing the gelling agent. Namely, it is more preferable to set a layer not containing any of the gelling agent and the gelation accelerator between the layer containing the gelling agent and the layer containing the gelation accelerator.

The gelation accelerator is used in a range from 0.1% by weight to 200% by weight, and preferably from 1.0% by weight to 100% by weight, with respect to the gelling agent.

(Other Component)

In the layer adjacent to the outermost layer, there can be added any additives such as a surfactant, a matting agent, or the like.

2-3. Image Forming Layer

The photothermographic material of the present invention contains, in the image forming layer, at least a photosensitive silver halide, a non-photosensitive organic silver salt, a reducing agent, and a binder. Each constituent component is explained in detail.

(Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source capable of supplying silver ions that are reducible by a reducing agent. Such a non-photosensitive organic silver salt is disclosed, for example, in JP-A No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being less than 5 are also used preferably. Such organic silver salt particles suffer less from fogging during thermal development compared with long needle-like particles with the major axis to minor axis length ratio of 5 or more. Particularly, a particle with the major axis to minor axis ratio of 3 or less is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average) ≧1.5 as an average value x is defined as a flake shape. The relation is preferably: 30≧x (average) ≧1.5 and, more preferably, 15≧ x (average)≧1.5. By the way, needle-like is expressed as 1≦x (average) <1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by. analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing is used preferably for controlling the photographic properties.

4) Addition Amount

While an organic silver salt in the invention can be used in a desired amount, a total amount of coated silver including silver halide is preferably in a range of from 0.1 $g/m^2$ to 5.0 $g/m^2$, more preferably from 0.3 $g/m^2$ to 3.0 $g/m^2$, and even more preferably from 0.5 $g/m^2$ to 2.0 $g/m^2$. In particular, in order to improve image storability, the total amount of coated silver is preferably 1.8 $mg/m^2$ or less, more preferably 1.6 $mg/m^2$ or less. In the case where a preferable reducing agent in the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) capable of reducing silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

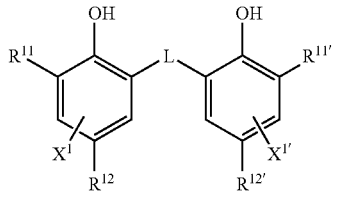

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, and the like. Examples of the substituent for the alkyl group can include, similar to substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms. Specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, and the like can be described. $R^{11}$ and $R^{11'}$ are, more preferably, a tertiary alkyl group having 4 to 12 carbon atoms and, among them, a t-butyl group, a t-amyl group, and a 1-methylcyclohexyl group are further preferred and, a t-butyl group is most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are methyl group, ethyl group, propyl group, isopropyl group, and t-butyl group.

$X^1$ and $X^{1'}$ are preferably a hydrogen atom, a halogen atom, or an alkyl group, and more preferably, a hydrogen atom.

L is preferably a —$CHR^{13}$— group.

$R^{13}$ is preferably a hydrogen atom or an alkyl group having 1 to 15 carbon atoms. Preferable examples of the alkyl group can include a methyl group, an ethyl group, a propyl group, an isopropyl group, and a 2,4,4-trimethylpentyl group. Particularly preferable $R^{13}$ is a hydrogen atom, a methyl group, a propyl group, or an isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably, an ethyl group.

When $R^{13}$ is a primary or secondary alkyl group having 1 to 8 carbon atoms, $R^{12}$ and $R^{12'}$ are preferably a methyl group. The primary or secondary alkyl group having 1 to 8 carbon atoms as $R^{13}$ is preferably a methyl group, an ethyl group, a propyl group, or an isopropyl group, and more preferably a methyl group, an ethyl group, or a propyl group.

When all of $R^{11}$, $R^{11'}$, $R^{12}$, and $R^{12'}$ are a methyl group, $R^{13}$ is preferably a secondary alkyl group. In this case, the secondary alkyl group as $R^{13}$ is preferably an isopropyl group, an isobutyl group, or a 1-ethylpentyl group, and more preferably, an isopropyl group.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents in combination, it is preferred to use two or more kinds of reducing agents in combination depending on the purpose.

Specific examples of the reducing agents of the invention including the compounds represented by formula (R) according to the invention are shown below, but the invention is not restricted to these.

R-1

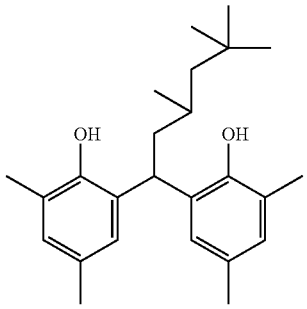

R-2

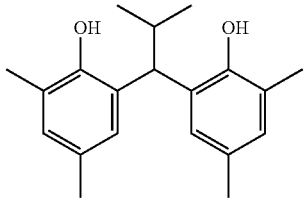

-continued
R-3
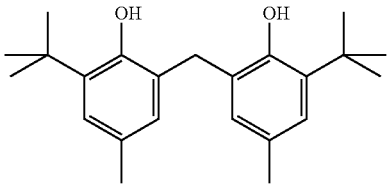
R-4
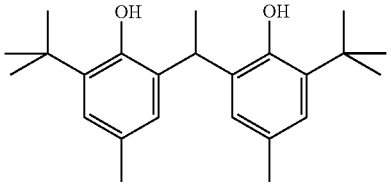
R-5
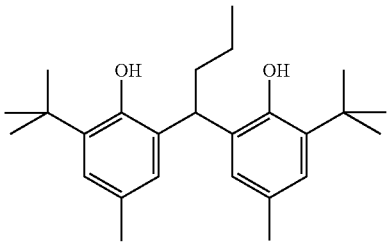
R-6
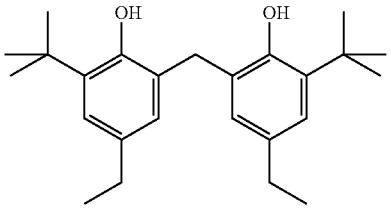
R-7
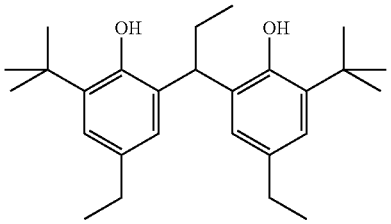
R-8
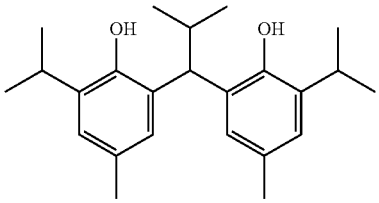
R-9
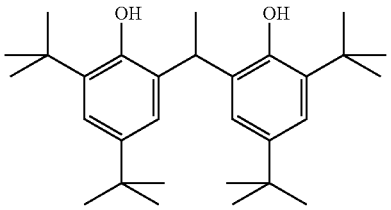
-continued
R-10
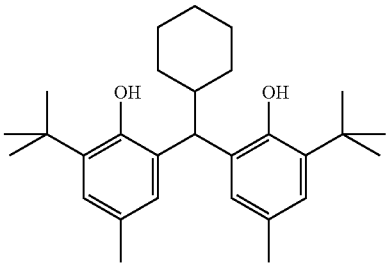
R-11
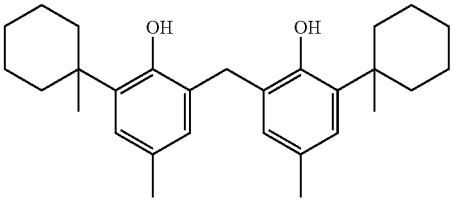
R-12
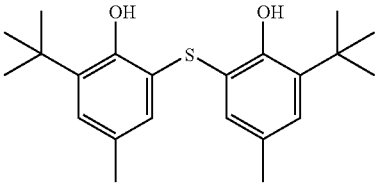
R-13
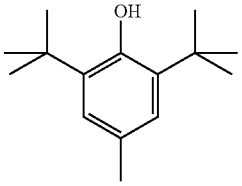
R-14
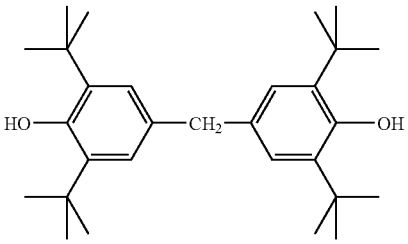
R-15
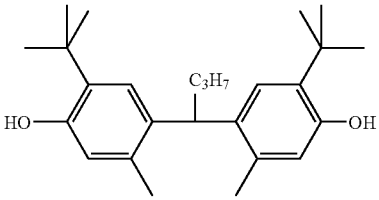

-continued

R-16

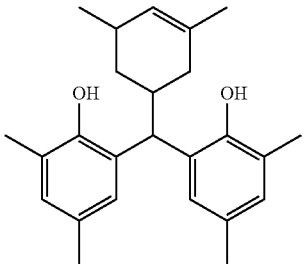

R-17

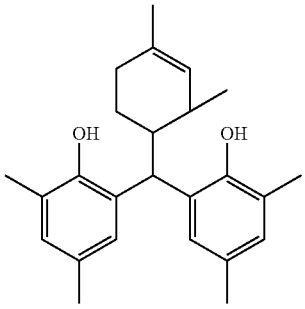

R-18

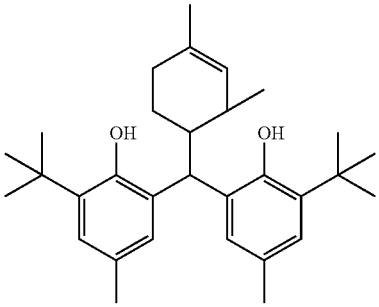

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 1.5 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsion dispersion, a solid fine particle dispersion, or the like.

As well known emulsion dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, a development accelerator is preferably used. As a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably. Further, phenolic compounds described in JP-A Nos. 2002-311533 and 2002-341484 are also preferable. Naphthalic compounds described in JP-A No. 2003-66558 are particularly preferable. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, among the development accelerators described above, it is more preferred to use hydrazine compounds represented by formula (D) described in the specification of JP-A Nos. 2002-156727 and phenolic or naphtholic compounds represented by formula (2) described in the specification of JP-A No. 2001-264929.

Particularly preferred development accelerators of the invention are the compounds represented by the following formulae (A-1) or (A-2).

$$Q_1\text{-NHNH-}Q_2 \qquad \text{Formula (A-1)}$$

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred. Further, $Q_2$ is preferably a carbamoyl group and, particularly, a carbamoyl group having a hydrogen atom on the nitrogen atom is particularly preferred.

Formula (A-2)

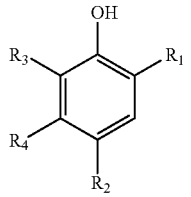

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

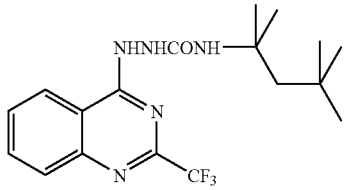

A-2

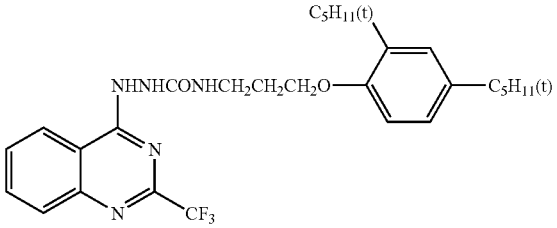

A-3

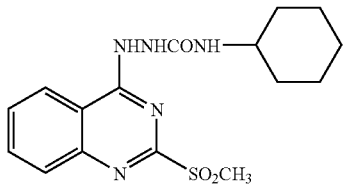

A-4

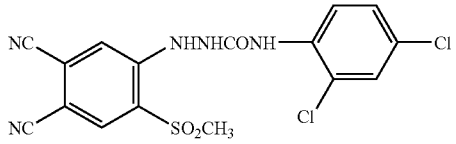

-continued

A-5

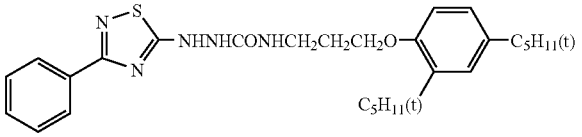

A-6

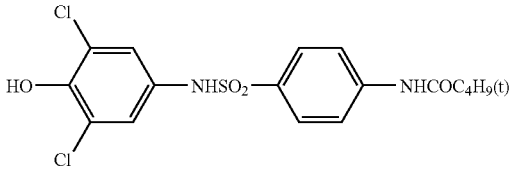

A-7

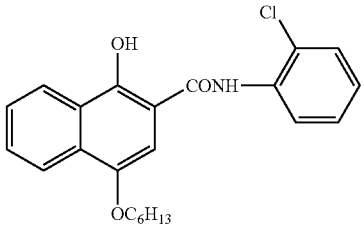

A-8

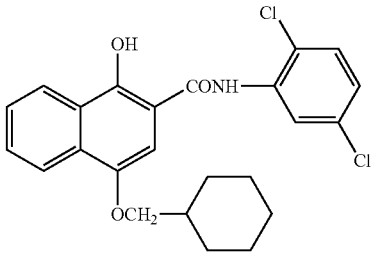

A-9

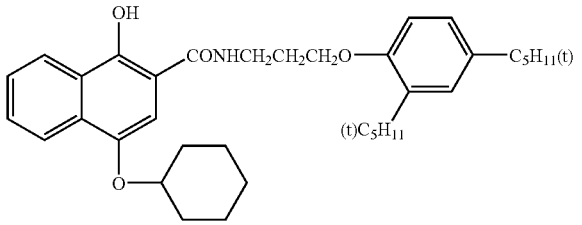

A-10

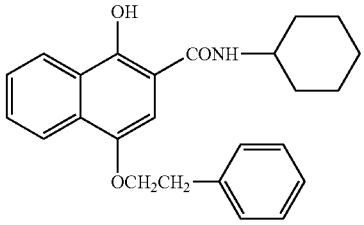

-continued

A-11

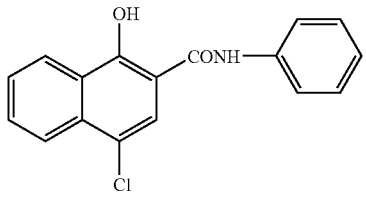

A-12

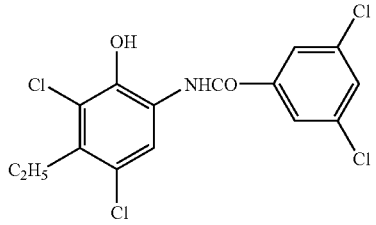

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

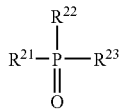

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

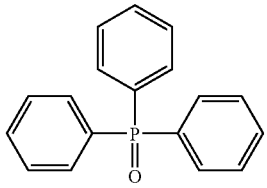

-continued
D-2
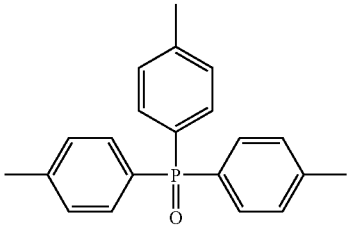
D-3
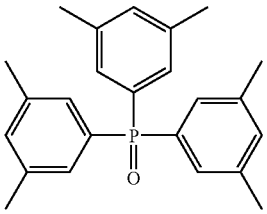
D-4
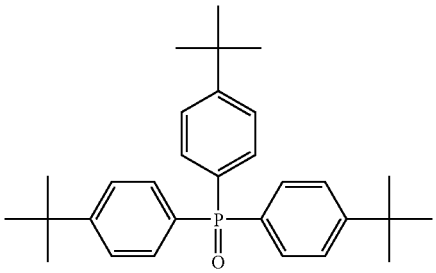
D-5
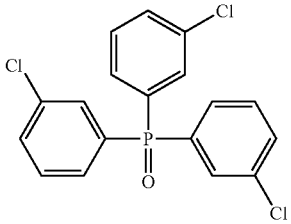
D-6
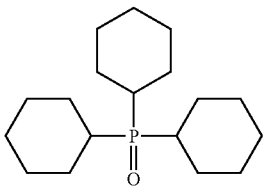
-continued
D-7
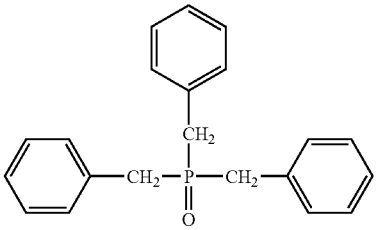
D-8
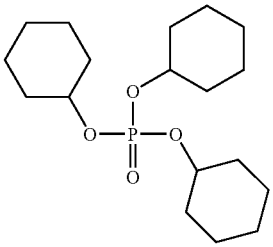
D-9
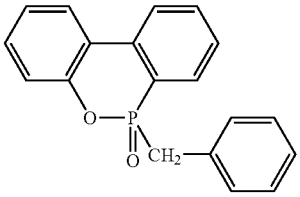
D-10
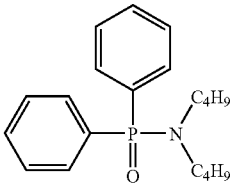
D-11
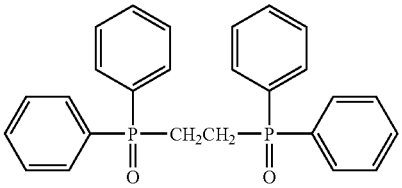
D-12
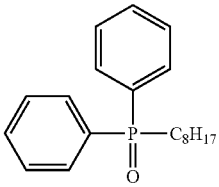
D-13
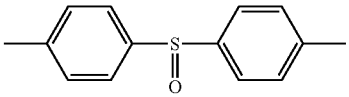
D-14
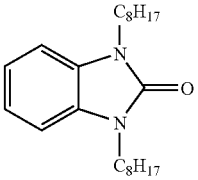

-continued

D-15

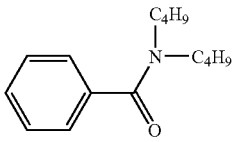

Specific examples of hydrogen bonding compounds other than those enumerated above can be found in those described in EP No. 1,096,310 and in JP-A Nos. 2002-156727 and 2002-318431.

The hydrogen bonding compound is preferably added in the same layer as the reducing agent.

The compound expressed by formula (D) used in the invention can be used in the photothermographic material by being incorporated into the coating solution in the form of solution, emulsion dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D). It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 13 of the periodic table is preferably rhodium, ruthenium, iridium, or iron. The metal complex may be used alone, or two or more kinds of complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, redissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that can be One-Electron-Oxidized to Provide a One-Electron Oxidation Product which Releases One or more Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). And the preferable ranges of these compounds are the same as the preferable ranges described in the quoted specifications.

Formula (1)

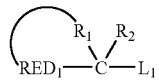

Formula (2)

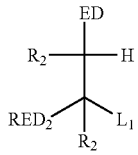

Formula (3)

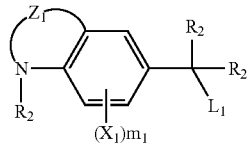

Formula (4)

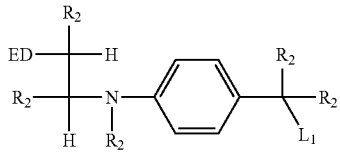

Formula (5)

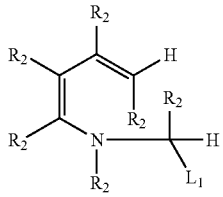

Formula (6)

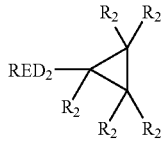

Formula (7)

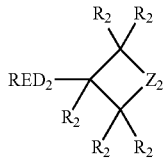

Formula (8)

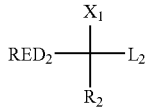

-continued

Reaction formula (1)

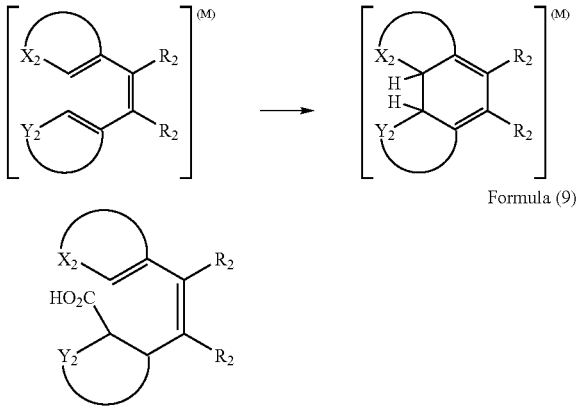

Formula (9)

-continued

Reaction formula (1)

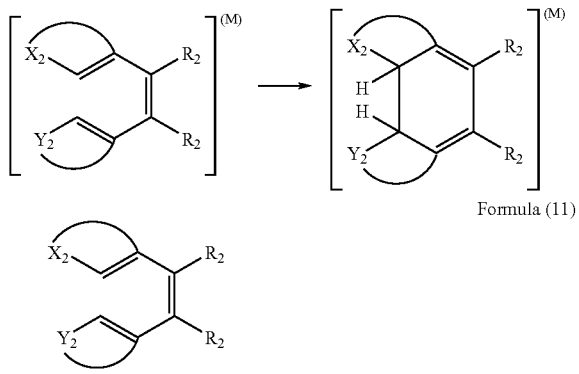

Formula (11)

In the formulae, $RED_1$ and $RED_2$ represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group capable to form a 6-membered ring with a nitrogen atom and two carbon atoms of a benzene ring. $X_1$ represents a substituent, and $m_1$ represents an integer of from 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group to form a 5-membered heterocycle with C═C. $Y_2$ represents a group to form a 5-membered aryl group or heterocyclic group with C═C. M represents one selected from a radical, a radical cation, or a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$$X—L_2—Y \qquad \text{Formula (10)}$$

In the formulae described above, X represents a reducing group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y $R_2$ represents a hydrogen atom or a substituent. In the case where plural $R_2$s exist in a same molecule, these may be identical or different from each other.

$X_2$ represents a group to form a 5-membered heterocycle with C═C. $Y_2$ represents a group to form a 5 or 6-membered aryl group or heterocyclic group with C═C. M represents one selected from a radical, a radical cation, or a cation.

The compounds of Groups 1 or 2 are preferably "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from each other.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 or 2 having a quaternary salt of nitrogen or phosphorus as an adsorptive group is represented by formula (X).

$$(P\text{-}Q_1\text{-})_i\text{—}R(\text{-}Q_2\text{—}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

Specific examples of the compounds of Groups 1 or 2 according to the invention are below without intention of restricting the scope of the invention.

1

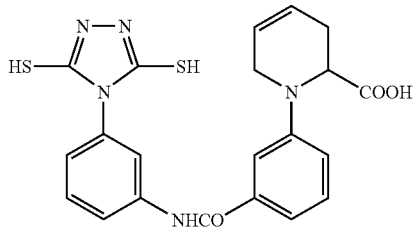

2

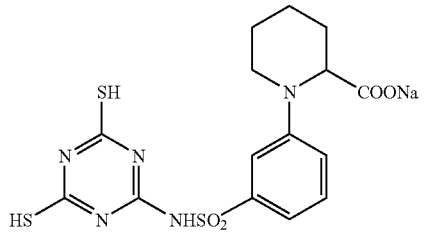

-continued
3
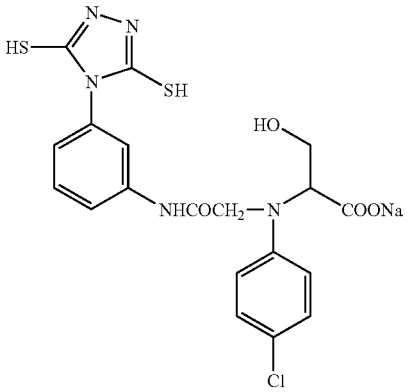
4
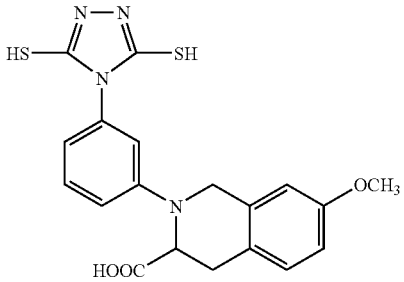
5
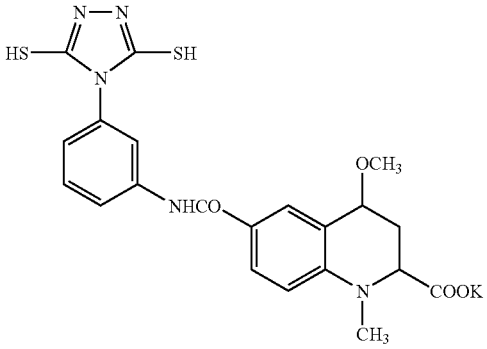
6
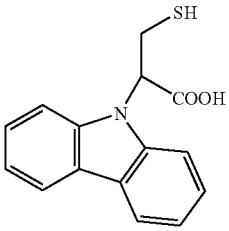
7
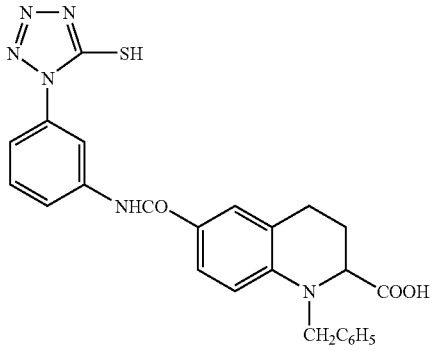
8
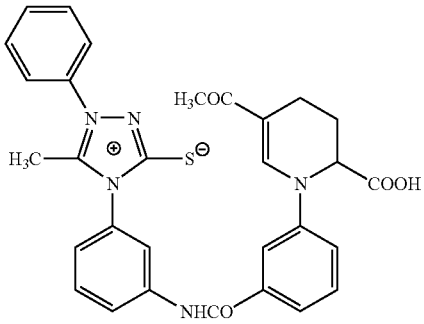
9
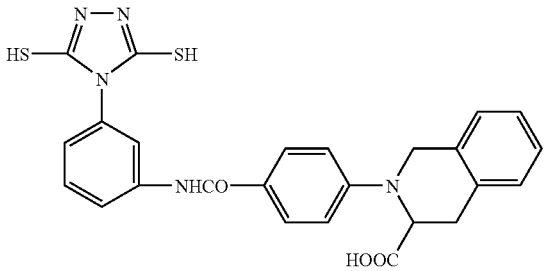

-continued
10
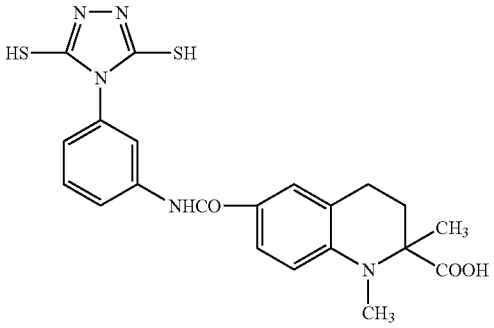
11
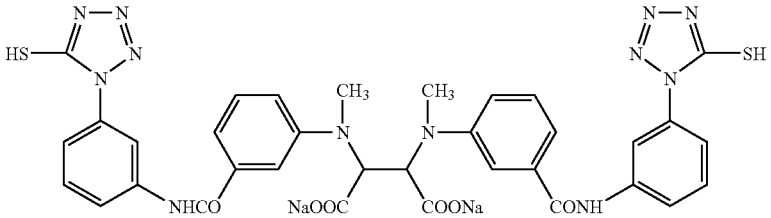
12
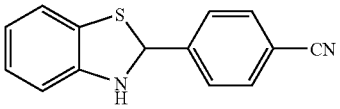
13
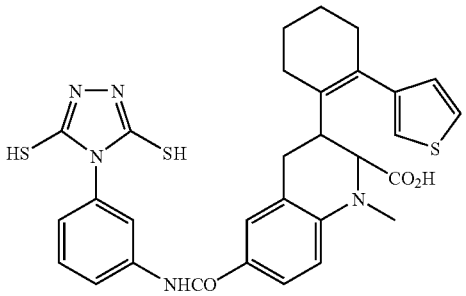
14
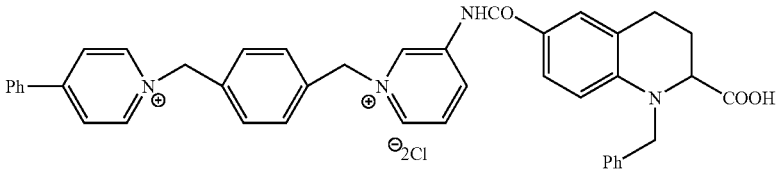
15
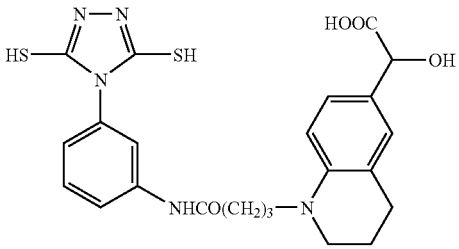
16
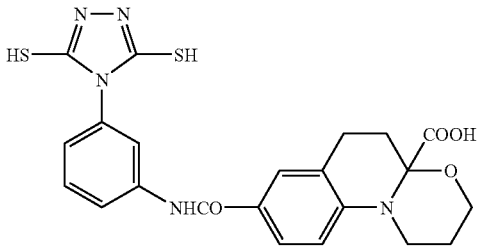

-continued
17
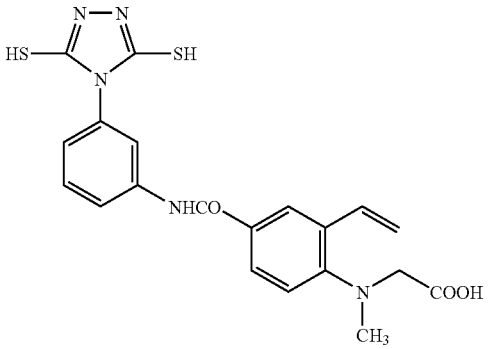
18
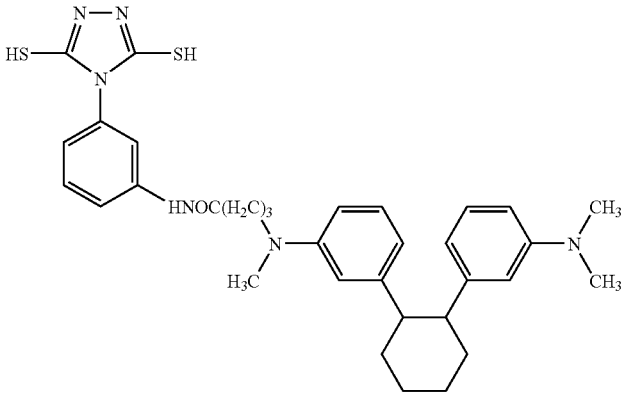
19
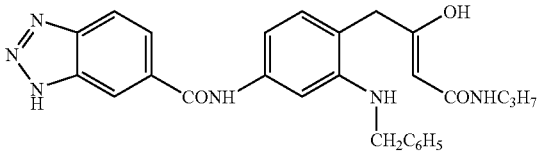
20
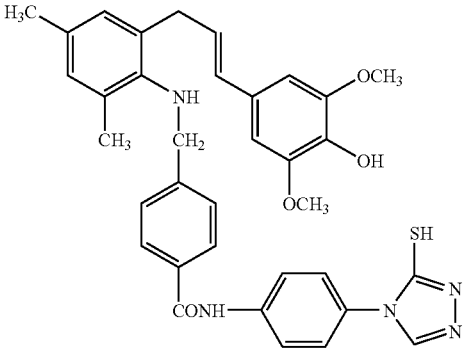
21
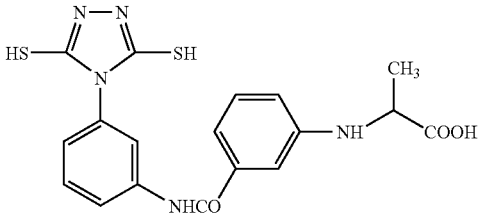
22
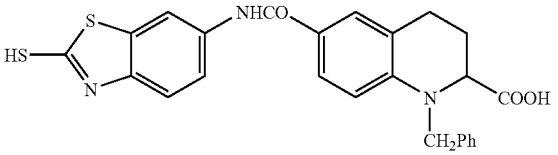

-continued
23
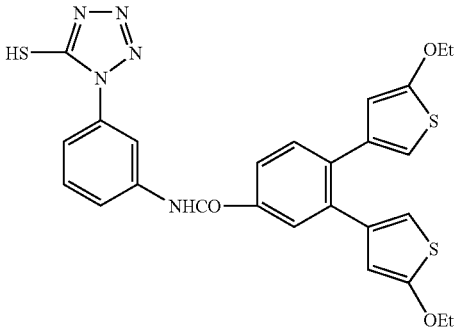
24
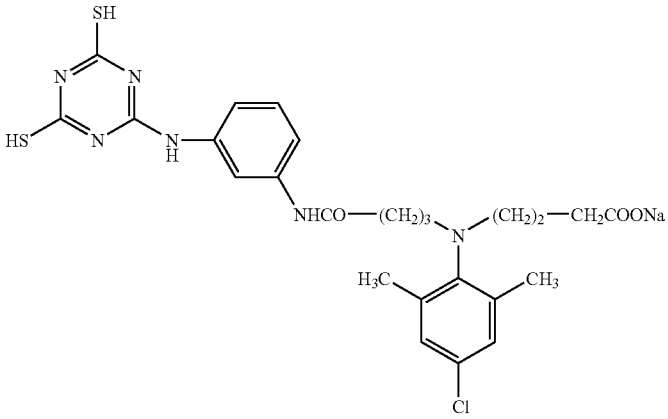
25
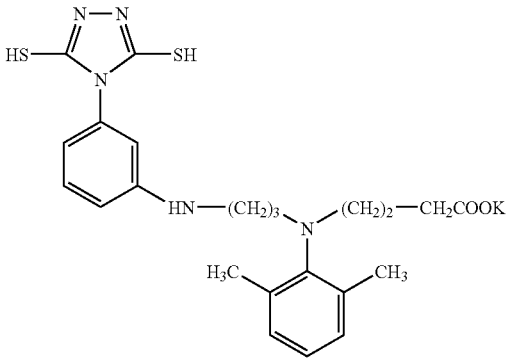
26
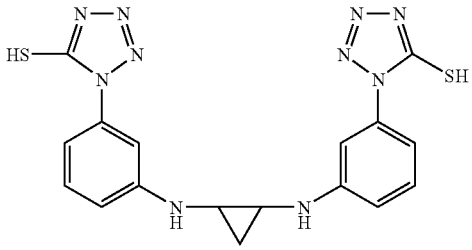
27
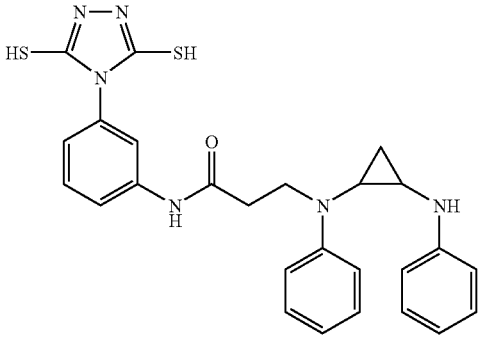
28
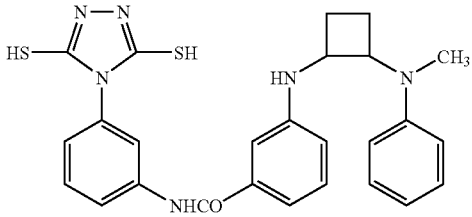

-continued
29
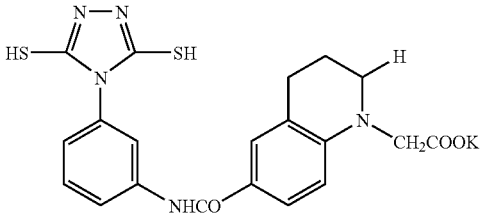
30
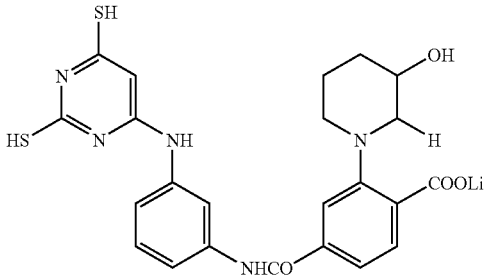
31
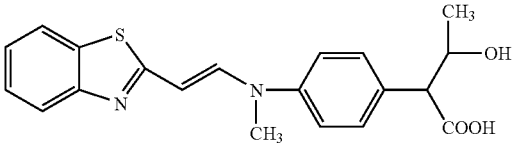
32
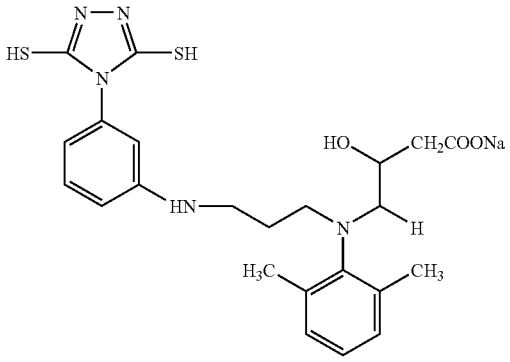
33
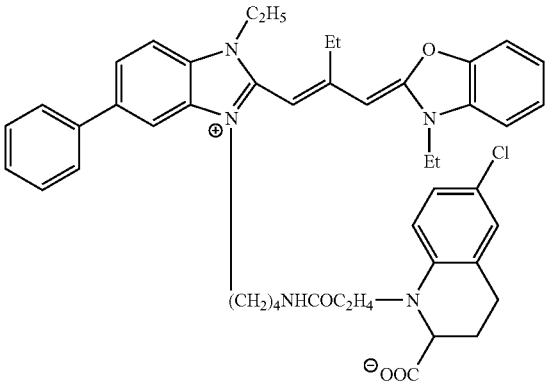
34
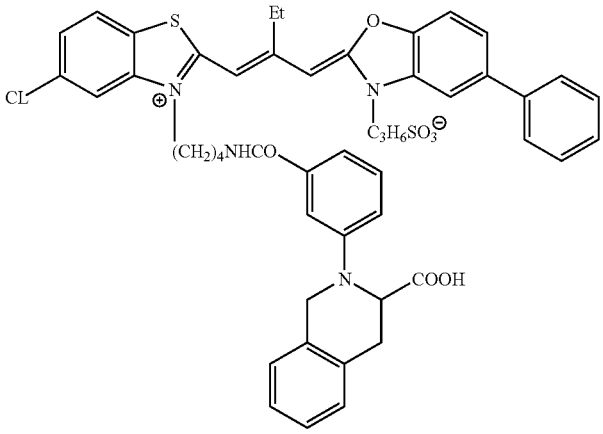

-continued
35
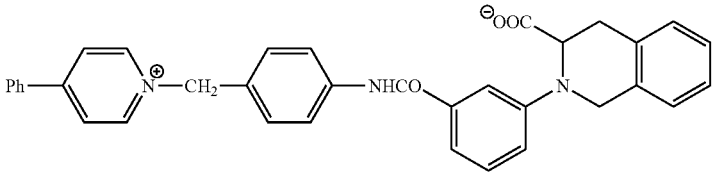
36
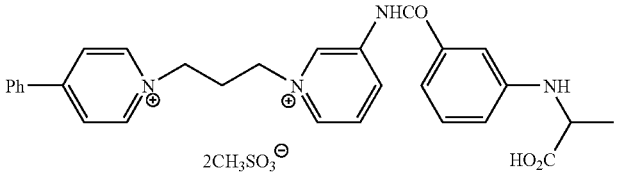
37
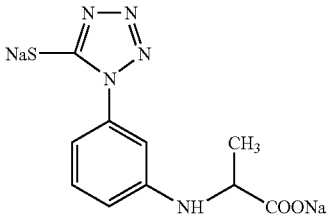
38
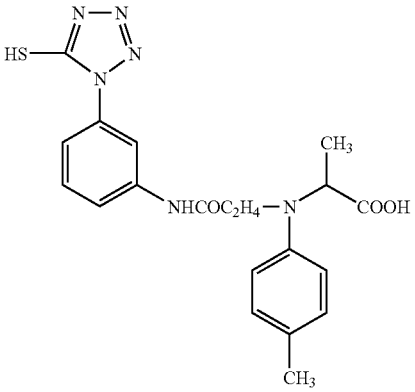
39
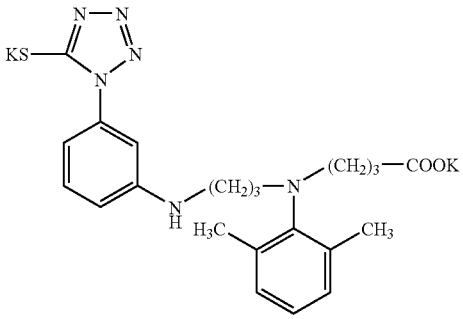
40
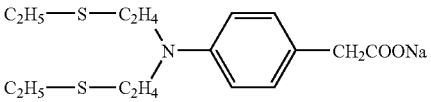
41
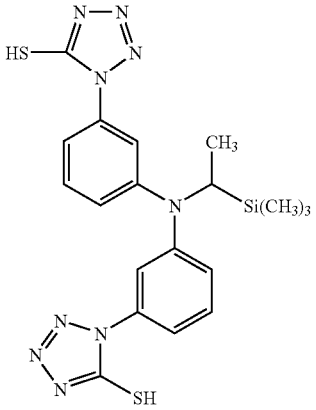
42
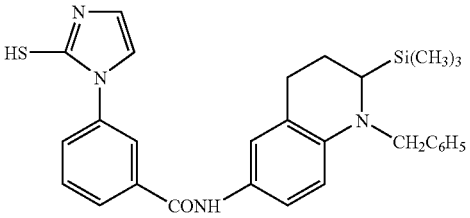

-continued

43

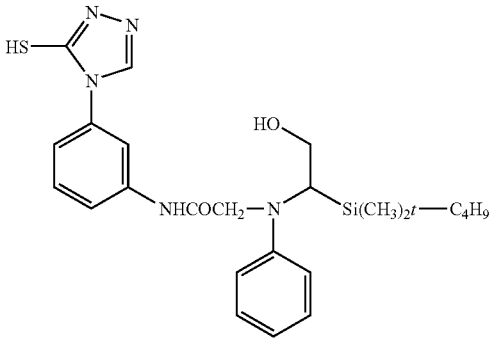

44

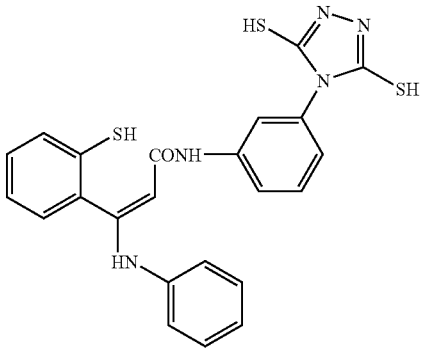

45

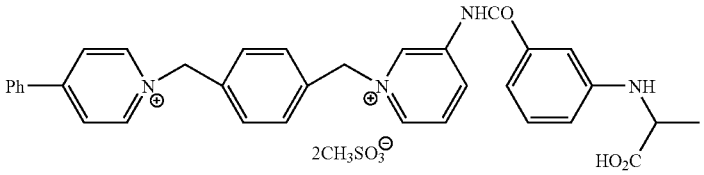

46

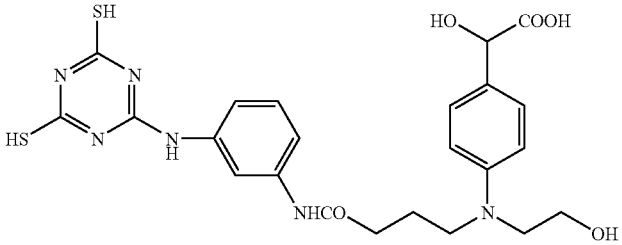

47

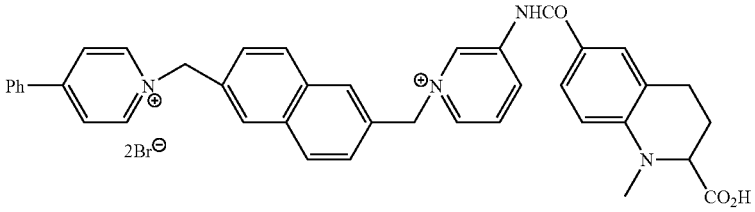

10) Compound Having Adsorptive Group and Reducing Group

The photothermographic material of the present invention preferably comprises a compound having an adsorptive group to silver halide and a reducing group in a molecule. It is preferred that the compound is represented by the following formula (I).

A-(W)n-B Formula (I)

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also include a linear or cyclic thioamide group, thiouredide group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, capable to form a silver iminate (>NAg) or a heterocyclic group, having an —S— group, a —Se— group, a —Te— group or a =N— group as a partial structure of a heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzophthiophene group, a benzothiazole group, a benzoxazole group, a thiadiazole group, an oxadiazole group, a triazine group, a selenoazole group, a benzoselenazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (>NAg) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (I), a reducing group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.

(1)
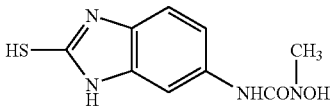
(2)
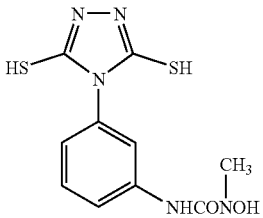
(3)
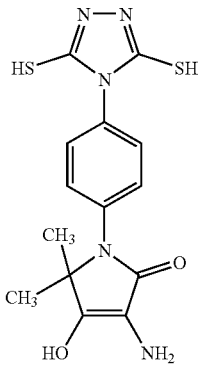
(4)
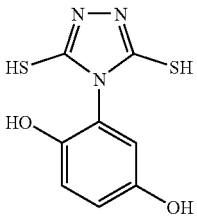
(5)
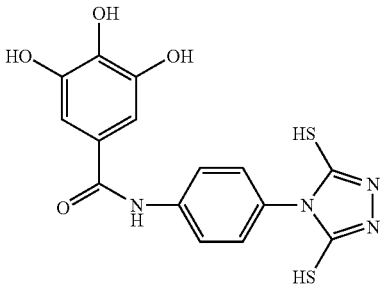
(6)
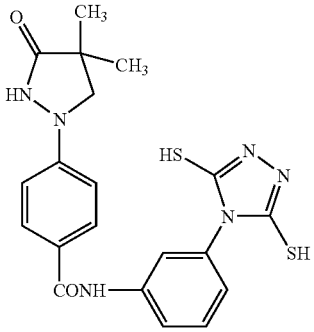
-continued
(7)
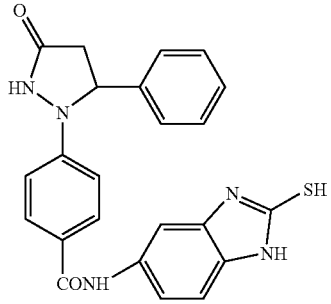
(8)
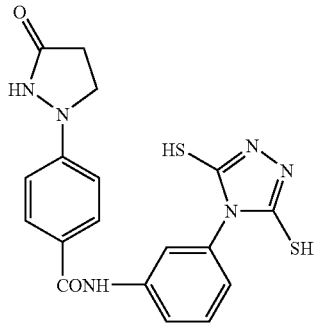
(9)
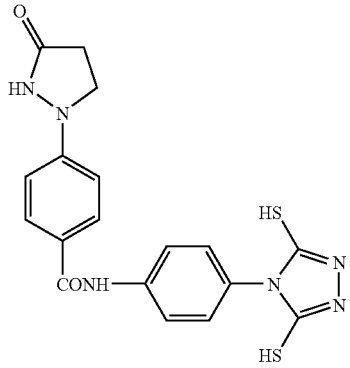
(10)
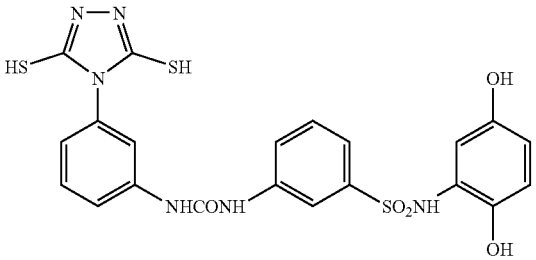
(11)
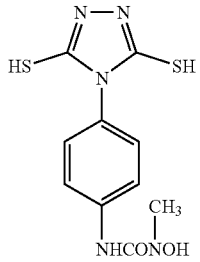

-continued (12)

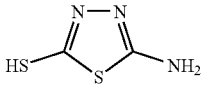

(13)

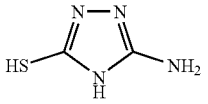

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method.

The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) according to the present invention is preferably added to an image forming layer, and more preferably, is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the kind of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, even more preferably, from 0.07 $g/m^2$ to 0.3 $g/m^2$. The photosensitive silver halide is used in a range of from 0.01 mol to 0.5 mol, preferably, from 0.02 mol to 0.3 mol, and even more preferably from 0.03 mol to 0.2 mol, per 1 mol of the organic silver salt.

13) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Binder)

Any kind of polymer may be used as the binder for the image forming layer of the invention. Suitable as the binder are those that are transparent or translucent, and that are generally colorless. However, as described above, in the case where the image forming layer is the layer adjacent to the outermost layer, the binder preferably has setting ability. Suitable as the binder are such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methylmethacrylic acids), poly(vinyl chlorides), poly(methacrylic acids), styrene-maleic anhydride copolymers, styrene-acrylonitrile copolymers, styrene-butadiene copolymers, poly(vinyl acetals) (for example, poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

In the present invention, the glass transition temperature (Tg) of the binder of the image forming layer is preferably in a range of from 0° C. to 80° C., more preferably from 10° C. to 70° C. and, even more preferably from 15° C. to 60° C.

In the specification, Tg is calculated according to the following equation.

$$1/Tg=\Sigma(Xi/Tgi)$$

where the polymer is obtained by copolymerization, of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, where the image forming layer is formed by applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As water-miscible organic solvents, there can be used, for example, alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, or the like.

The term "equilibrium water content under 25° C. and 60% RH" referred herein can be expressed as follows:

$$\text{Equilibrium water content under 25° C. and 60\% RH} = [(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, more preferably, in a range of from 0.01% by weight to 1.5% by weight, and even more preferably, from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a mono-disperse particle diameter distribution.

In the invention, preferred embodiment of the polymer capable of being dispersed in an aqueous solvent is similar to that described in the above explanation of the polymer latex. Further, specific examples of latex and preferred latex are also similar to those described in the above explanation of the polymer latex.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added at an amount of 30% by weight or less, and preferably 20% by weight or less, with respect to the total weight of the binder for the image forming layer.

According to the invention, the layer containing organic silver salt (image forming layer) is preferably formed by using the polymer latex. According to the amount of the binder for the image forming layer, a mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer containing a photosensitive silver halide, i.e., the photosensitive silver salt; in such a case, a mass ratio of total binder to silver halide (total binder/silver halide) is 400 or less and 5 or more, and more preferably, 200 or less and 10 or more.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a cross-linking agent for cross-linking, a surfactant, or the like to improve coating properties.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (II) in JP-A No. 10-339934, and organic polyhalogen compounds described in JP-A Nos. 2001-31644 and 2001-33911 are preferred.

1) Organic Polyhalogen Compound

Organic polyhalogen compounds preferably used in the invention are specifically described below. In the invention, preferred organic polyhalogen compounds are the compounds expressed by formula (H) below:

$$Q\text{-}(Y)_n\text{—}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an aryl group, or a heterocyclic group.

In formula (H), in the case where Q is a heterocyclic group, Q is preferably a nitrogen-containing heterocyclic group having 1 or 2 nitrogen atoms, and particularly preferably a 2-pyridyl group or a 2-quinolyl group.

In formula (H), in the case where Q is an aryl group, Q preferably is a phenyl group substituted by an electron-attracting group whose Hammett substituent coefficient σp yields a positive value. For the details of Hammett substituent coefficient, reference can be made to Journal of Medicinal Chemistry, vol. 16, No. 11 (1973), pp. 1207 to 1216, and the like. As such electron-attracting group, examples include, halogen atoms (fluorine atom (σp value: 0.06), chlorine atom (σp value: 0.23), bromine atom (σp value: 0.23), iodine atom (σp value: 0.18)), trihalomethyl groups (tribromomethyl (σp value: 0.29), trichloromethyl (σp value: 0.33), trifluoromethyl (σp value: 0.54)), a cyano group (σp value: 0.66), a nitro group (σp value: 0.78), an aliphatic aryl sulfonyl group or a heterocyclic sulfonyl group (for example, methanesulfonyl (σp value: 0.72)), an aliphatic aryl acyl group or a heterocyclic acyl group (for example, acetyl (σp value: 0.50) and benzoyl (σp value: 0.43)), an alkynyl (e.g., C═CH (σp value: 0.23)), an aliphatic aryl oxycarbonyl group or a heterocyclic oxycarbonyl group (for example, methoxycarbonyl (σp value: 0.45) and phenoxycarbonyl (σp value: 0.44)), a carbamoyl group (σp value: 0.36), a sulfamoyl group (σp value: 0.57), a sulfoxido group, a heterocyclic a group, a phosphoryl group, and the like. Preferred range of the σp value is from 0.2 to 2.0, and more preferably, from 0.4 to 1.0. Particularly preferred as the electron-attracting groups are a carbamoyl group, an alkoxycarbonyl group, an alkylsulfonyl group, and an alkylphosphoryl group, and most preferred among them is a carbamoyl group.

X is preferably an electron-attracting group, and more preferably, a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, or a sulfamoyl group; particularly preferred among them is a halogen atom. Among halogen atoms, preferred are chlorine atom, bromine atom, and iodine atom; more preferred are chlorine atom and bromine atom; and particularly preferred is bromine atom.

Y preferably represents —C(═O)—, —SO—, or —$SO_2$—; more preferably, —C(═O)— or —$SO_2$—; and particularly preferred is —$SO_2$—. n represents 0 or 1, and is preferably 1.

Specific examples of the compounds expressed by formula (H) of the invention are shown below.

H-1

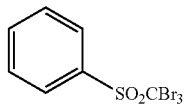

H-2

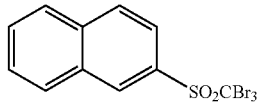

H-3

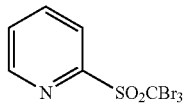

H-4

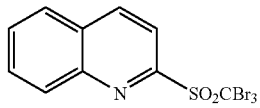

H-5

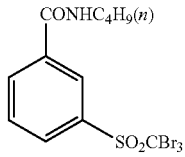

H-6

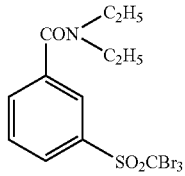

H-7

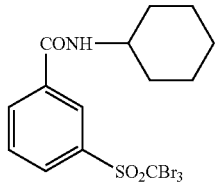

H-8

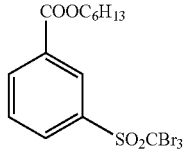

-continued

H-9

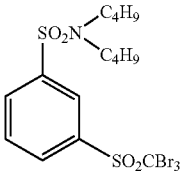

H-10

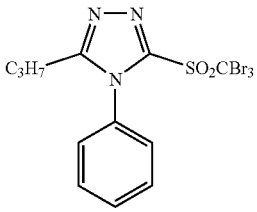

H-11

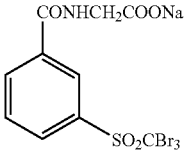

H-12

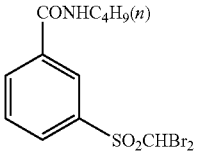

H-13

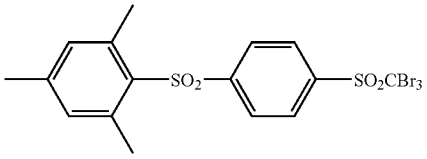

H-14

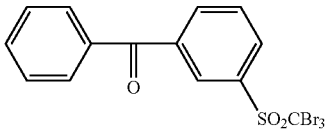

H-15

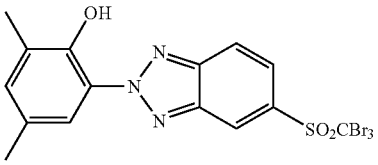

H-16

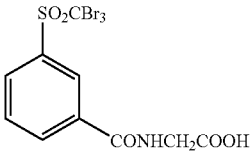

H-17

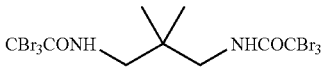

H-18

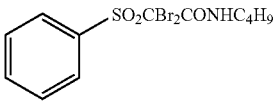

-continued

H-19

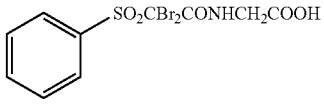

As preferred organic polyhalogen compounds of the invention other than those above, there can be mentioned compounds disclosed in JP-A Nos. 2001-31644, 2001-56526, and 2001-209145.

The compounds expressed by formula (H) of the invention are preferably used in an amount of from $10^{-4}$ mol to 1 mol, more preferably, $10^{-3}$ mol to 0.5 mol, and further preferably, $1\times10^{-2}$ mol to 0.2 mol, per 1 mol of non-photosensitive silver salt incorporated in the image forming layer.

In the invention, usable methods for incorporating the antifoggant into the photosensitive material are those described above in the method for incorporating the reducing agent. Furthermore, the organic polyhalogen compound is also preferably used in the form of solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in Japanese Patent Application Publication (JP-B) No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like. In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, the addition of a toner is preferred. The description of the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide at an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/M^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

2-4. Other Non-Photosensitive Layers

1) Antihalation Layer

The photothermographic material of the present invention can comprise an antihalation layer provided to the side farther from the light source than the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

2) Non-Photosensitive Layer on Image Forming Layer Side

As a non-photosensitive layer disposed on the side having thereon the image forming layer, there are preferably disposed an intermediate layer and a surface protective layer. As for the binder and additives used for the above layers, the compounds described above in the explanations of the outermost layer, the layer adjacent to the outermost layer, and the antihalation layer can be employed.

The outermost layer disposed on the image forming layer side also preferably contains the fluorocarbon polymer described above, especially more preferably the fluorocarbon polymer having a monomer component represented by formula (P).

2-5. Other Constituent Components

1) Surface pH Adjusting Agent

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development. It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

2) Hardener

A hardener may be used in each of image forming layer, protective layer, back layer, and the like of the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

3) Surfactant

Concerning the surfactant, the solvent, the support, antistatic agent and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. In particular, the fluorocarbon compound described above is preferred.

According to the invention, the fluorocarbon surfactant can be used on either side of image forming layer side or backside, but is preferred to use on both sides.

4) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P. halogen atoms, or the like; $TiO_2$ with Nb, Ta, or the like. Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect. The metal oxides is preferably used in a range of from 1 $mg/m^2$ to 1000 $mg/m^2$, more preferably from 10 $mg/m^2$ to 500 $mg/m^2$, and even more preferably from 20 $mg/m^2$ to 200 $mg/m^2$. The antistatic layer according to the invention can be laid on either side of the image forming layer side or the backside, it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

5) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-I described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for image forming layer and back layer is conducted on the support.

6) Other Additives

Furthermore, an antioxidant, stabilizing agent, plasticizer, UV absorbent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

3. Method for Preparing Photothermographic Material

1) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333. The coating solution for the image forming layer in the invention is preferably a so-called thixotropic fluid. For the details of this technology, reference can be made to JP-A No. 11-52509. Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

2) Wrapping Material

In order to suppress fluctuation from occurring on photographic properties during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

3) Other Applicable Techniques

Techniques which can be used for the photothermographic material of the invention also include those in EP No. 803764A1, EP No. 883022A1, WO No. 98/36322, JP-A Nos. 56-62648, and 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

In the case of multicolor photothermographic material, each of the image forming layers is maintained distinguished from each other by incorporating functional or non-functional barrier layer between each of the image forming layers as described in U.S. Pat. No. 4,460,681.

The constitution of a multicolor photothermographic material may include combinations of two layers for those for each of the colors, or may contain all the components in a single layer as described in U.S. Pat. No. 4,708,928.

4. Image Forming Method

1) Exposure

The photothermographic material of the invention may be subjected to imagewise exposure by any known methods.

Preferred is scanning exposure using laser beam. As laser beam, He—Ne laser of red through infrared emission, red laser diode, or $Ar^+$, He—Ne, He—Cd laser of blue through green emission, or blue laser diode can be used. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for this thermal developing process, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, even more preferably from 5 seconds to 25 seconds, and particularly preferably from 7 seconds to 15 seconds.

In the process of thermal development, either a drum type heater or a plate type heater can be used, but a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed, Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively Thus, the output time period for the first sheet can be reduced to about 60 seconds.

3) System

Examples of a medical laser imager equipped with an exposing portion and a thermal developing portion include Fuji Medical Dry Laser Imager FM-DPL and DRYPIX 7000. Both of FM-DPL and DRYPIX 7000 are a thermal developing apparatus having an imagewise exposing part and a thermal developing part comprising a plate heater as heating means, wherein a top part of the photothermographic material is exposed and thermal development of the exposed part is started before exposure of the end part of the photothermographic material has completed. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

5. Application of the Invention

The photothermographic material of the invention can be used for photothermographic materials for use in medical diagnosis, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

1) Preparations of Coating Solution for Undercoat Layer

| Formula (1) (for undercoat layer on the image forming layer side) | |
|---|---|
| Pesresin A-520 manufactured by Takamatsu Oil & Fat Co., Ltd. (30% by weight solution) | 59 g |
| Polyethyleneglycol monononylphenylether (average ethylene oxide number = 8.5) 10% by weight solution | 5.4 g |
| MP-1000 manufactured by Soken Chemical & Engineering Co., Ltd. (PMMA polymer fine particle, mean particle diameter of 0.4 μm) | 0.91 g |
| Distilled water | 935 mL |
| **Formula (2) (for first layer on the backside)** | |
| Styrene-butadiene copolymer latex (solid content of 40% by weight, styrene/butadiene mass ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (3) (for second layer on the backside)** | |
| $SnO_2SbO$ (9/1 mass ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

(Back Layer)

1) Preparation of Coating Solution for Back Layer

<Preparation of Dispersion of Solid Fine Particles (a) of Base Precursor>

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having a mean fine pore diameter of 3 μm) for eliminating dust to put into practical use.

2) Preparation of Solid Fine Particle Dispersion of Dye

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. Thus resulting dispersion was diluted with distilled water so that the concentration of the cyanine dye became 6% by weight, and filtrated with a filter (mean fine pore diameter: 1 μm) for removing dust to put into practical use.

3) Preparation of Coating Solution for Antihalation Layer

A vessel was kept at 40° C., and thereto were added 40 g of gelatin, 20 g of mono-dispersed polymethyl methacrylate fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the above-mentioned dispersion of the solid fine particles of the dye, 90 g of the above-mentioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

4) Preparations of Coating Solution for Back Surface Protective Layer

<<Preparation of Coating Solution-1 for Back Surface Protective Layer>>

A vessel was kept at 40° C., and thereto were added 40 g of gelatin, 35 mg of benzoisothiazolinone, and 840 mL of water to allow gelatin to be dissolved. Additionally, 5.8 mL of a 1 mol/L sodium hydroxide aqueous solution, a liquid paraffin emulsion at 1.5 g equivalent to liquid paraffin, 10 mL of a 5% by weight aqueous solution of di(2-ethylhexyl)sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of five-component latex (methyl methacrylate/styrene/butyl acrylate/hydroxyethyl methacrylate/acrylic acid copolymer; mass ratio of the copolymerization of 57/8/28/5/2) were admixed. Just prior to the coating, 25 mL of a 4% by weight aqueous solution of N,N-ethylenebis(vinylsulfone acetamide) was admixed to give a coating solution for the back surface protective layer.

<<Preparations of Coating Solution-2 to -18 for Back Surface Protective Layer>>

Preparations of coating solution-2 to -18 for the back surface protective layer were conducted in a similar manner to the process in the preparation of the coating solution-1 for the back surface protective layer described above except that a fluorocarbon polymer was used in the same weight or combined thereof in the same weight as described in Table 5 instead of using the five-component latex (methy methacrylate/styrene/butyl acrylate/hydroxyethyl methacrylate/acrylic acid copolymer, mass ratio of the copolymerization of 57/ 8/ 28/ 5/ 2).

5) Coating of Back Layer

The backside of the undercoated support described above was subjected to simultaneous double coating so that the coating solution for the antihalation layer gave the coating amount of gelatin of 0.52 g/m$^2$, and so that the coating solution-1 to -18 for the back surface protective layer gave the coating amount of gelatin of 1.7 g/m$^2$, followed by drying to produce a back layer.

(Image Forming Layer, Intermediate Layer, and Surface Protective Layer)

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/ desalting/ water washing/ dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3: 1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

Behenic acid manufactured by Henkel Co. (trade name: Edenor C22-85R) in an amount of 87.6 kg, 423 L of distilled water, 49.2 L of 5 mol/L sodium hydroxide aqueous solution, 120 L of t-butyl alcohol were admixed, and subjected to a reaction with stirring at 75° C. for one hour to give a solution A of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution A of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution A of sodium behenate was thereafter started, and during 14 minutes and 15 seconds following the completion of adding the aqueous silver nitrate solution, the added material was restricted to the solution A of sodium behenate alone. The temperature inside of the reaction vessel was then set to be 30° C., and the temperature outside was controlled so that the liquid temperature could be kept constant. In addition, the temperature of a pipeline for the addition system of the solution A of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution A of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution A of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a flake shaped crystal was revealed having a=0.14 μm, b=0.4 μm and c=0.6 μm on the average value, with a mean aspect ratio of 5.2, an equivalent spherical diameter of 0.52 μm, and a variation coefficient of an equivalent spherical diameter distribution of 15% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

<<Preparation of Reducing Agent-1 Dispersion>>

To 10 kg of reducing agent-1 (2,2'-methylene-bis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resultant reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium tri-isopropyl-naphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-I dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

8) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

9) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (¼G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

10) Preparation of SBR Latex Solution

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion: $NH_4^+$ ion=1:5.3, and thus, the pH of the mixture was adjusted to 8.05. Thereafter, filtration with a polypropylene filter having the pore size of 1.0 μm was conducted to remove foreign substances such as dust followed by storage. Accordingly, Compound No. RP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by To a Electronics Ltd. for the latex stock solution (44% by weight) at 25° C.).

2. Preparations of Coating Solution

1) Preparation of Coating Solution for Image Forming Layer

To the dispersion of silver salt of a fatty acid obtained as described above in an amount of 1000 g and 135 mL of water were serially added 35 g of the pigment-1 dispersion, 19 g of the organic polyhalogen compound-1 dispersion, 58g of the organic polyhalogen compound-2 dispersion, 162 g of the phthalazine compound-1 solution, 1060 g of the SBR latex solution (Tg: 17° C.), 75 g of the reducing agent-1, 75 g of the reducing agent-2 dispersion, 106 g of the hydrogen bonding compound-1 dispersion, 4.8 g of the development accelerator-1 dispersion, 9 mL of the mercapto compound-1 aqueous solution, and 27 mL of the mercapto compound-2 aqueous solution. The mixed emulsion A for coating solution in an amount of 118 g was added thereto, followed by thorough mixing just prior to the coating, which was fed directly to a coating die, and coated.

Viscosity of the above-described coating solution for the image forming layer was 25 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 32, 35, 33, 26, and 17 [mPa·s], respectively, at the shearing rate of 0.1, 1, 10, 100, 1000 [1/second].

The amount of zirconium in the coating solution was 0.32 mg per 1 g of silver.

2) Preparation of Coating Solution for Intermediate Layer

To 1000 g of poly(vinyl alcohol) PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of sodium di(2-ethylhexyl)sulfosuccinate, and 4200 mL of a 19% by weight solution of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/$m^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 800 mL of water were dissolved 100 g of inert gelatin and 10 mg of benzoisothiazolinone, and thereto were added a liquid paraffin emulsion at 8.0 g equivalent to liquid paraffin, 180 g of a 19% by weight solution of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-3), 5.5 mL of a 1% by weight aqueous solution of another fluorocarbon surfactant (F-4), 28 mL of a 5% by weight aqueous solution of sodium di-(2-ethylhexyl) sulfosuccinate, 4 g of polymethyl methacrylate fine particles (mean particle diameter of 0.7 μm), and 23 g of polymethyl methacrylate fine particles (mean particle diameter of 3.1 μm), and the obtained mixture was mixed to give a coating solution for the surface protective layer, which was fed to a coating die so that 8.3 mL/$m^2$ could be provided.

Viscosity of the coating solution was 19 [mPa·s] which was measured with a B type viscometer at 40° C. (No. 1 rotor, 60 rpm).

3. Preparations of Photothermographic Material

1) Preparations of Photothermographic Material-101 to -118

Reverse surface of the back surface on which the back layer was coated was subjected to simultaneous overlaying coating by a slide bead coating method in order of coating solution for the image forming layer, the coating solution for intermediate layer, the coating solution for the first layer of the surface protective layers, and the coating solution for the second layer of the surface protective layers, starting from the support to outer side, and thus photothermographic material-101 to -118 was produced.

In this method, the temperature of the coating solution was adjusted to 36° C. for the image forming layer and intermediate layer, to 37° C. for the first layer of the surface protective layers, and to 40° C. for the second layer of the surface protective layers.

The coating amount of each compound (g/m$^2$) for the image forming layer is as follows.

| | |
|---|---|
| Silver salt of fatty acid A | 5.42 |
| Pigment (C.I. Pigment Blue 60) | 0.036 |
| Organic polyhalogen compound-1 | 0.12 |
| Organic polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver halide (on the basis of Ag content) | 0.10 |

Conditions for coating and drying were as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Chemical structures of the compounds used in Examples of the invention are shown below.

(F-1)

$CF_3(CF_2)nCH_2CH_2SCH_2CH_2COOLi$

Mixture of $n$ = 5 to 11

(F-2)

$CF_3(CF_2)nCH_2CH_2O(CH_2CH_2O)mH$

Mixture of $n$ = 5 to 11, $m$ = 5 to 15

(F-3)

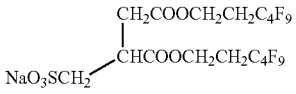

(F-4)

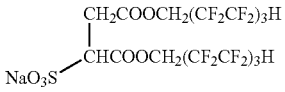

Spectral sensitizing dye A

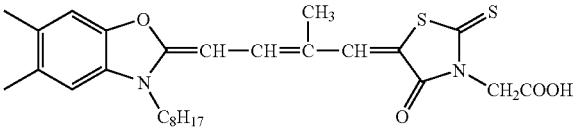

-continued

Spectral sensitizing dye B

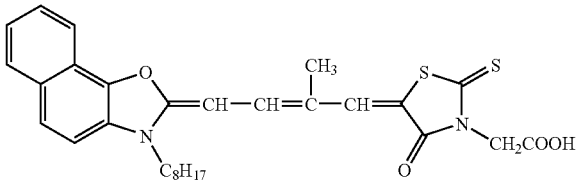

Tellurium sensitizer C

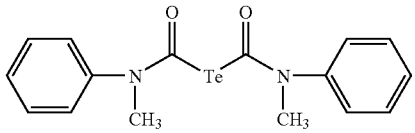

Base precursor-1

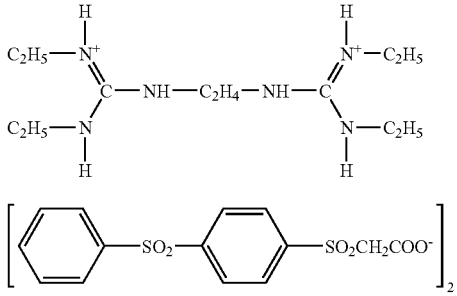

Cyanine dye-1

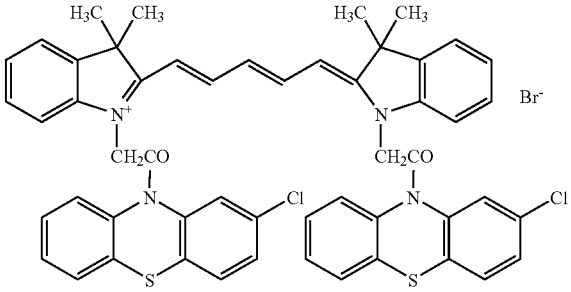

Reducing agent-1

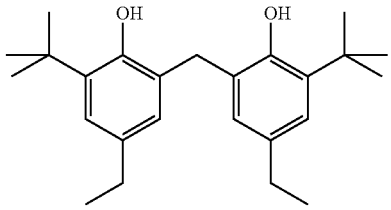

-continued

Reducing agent-2

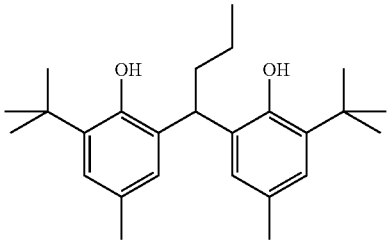

Hydrogen bonding compound-1

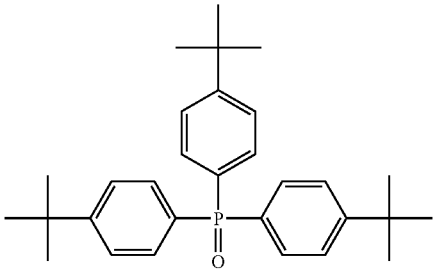

Organic polyhalogen compound-1

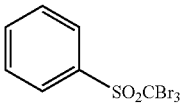

Organic polyhalogen compound-2

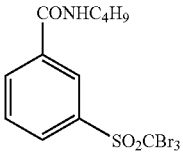

Mercapto compound-1

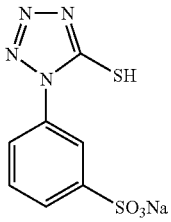

Mercapto compound-2

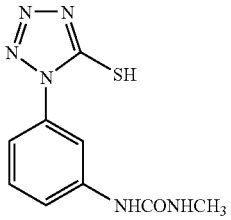

Phthalazine compound-1

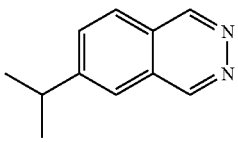

-continued

Development accelerator-1

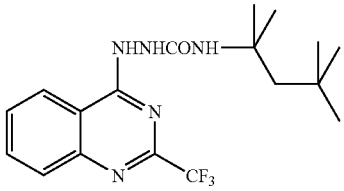

4. Evaluation of Photographic Properties

1) Preparation

The obtained sample was cut into a half-cut size (43 cm in length×35 cm in width), and was wrapped with the following packaging material under an environment of 25° C. and 50% RH, and stored for 2 weeks at an ambient temperature.

<<Packaging Material>>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-1}$.

2) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed.

In respect of each sample prepared above, a specimen having fog portion which was unexposed and therefore non-image formed and a specimen having Dmax portion which was fully exposed and therefore blackened were prepared.

3) Evaluation of Adhesion Resistance

After thermal developing the samples described above, the samples were stored under the condition of 25° C. and 80% RH for 16 hours, and then a combined set formed by bringing the image forming layer surface in contact with the back layer surface was prepared. The set was pressed with a load of 350 g on an area of 35 mm by 35 mm thereof and left under the condition of 45° C. for 3 days while loaded. Thereafter, upon peeling the combined set off, the surfaces of both the image forming layer side and the back layer side were observed on the surface state such as peelings out of coated film layer or adhesion marks on the surface. The obtained results were classified according to the following rankings.

◎: No film peelings and adhesion marks are seen.

○: Slight adhesion marks on the surface, but no film peelings are seen.

Δ: Slight film peelings are seen.

x: Apparent film peelings are seen in almost half area.

xx: Apparent film peelings are seen in almost overall area.

4) Result

The obtained results are shown in Table 5. From the results shown in Table 5, it is understood that the photothermographic material of the present invention has significantly improved adhesion resistance.

TABLE 5

| Sample No. | Back Surface Protective Layer: Coating Solution No. | Five-Component Latex | Fluorocarbon Polymer | Adhesion Resistance: Fog Portion | Dmax Portion | Note |
|---|---|---|---|---|---|---|
| 101 | 1 | — | — | X X | X X | Comparative |
| 102 | 2 | — | FL-1 | ○ | ○ | Invention |
| 103 | 3 | — | FL-2 | ○ | ○ | Invention |
| 104 | 4 | — | FL-4 | ◎ | ◎ | Invention |
| 105 | 5 | — | FL-5 | ○ | ○ | Invention |
| 106 | 6 | — | FL-6 | ◎ | ◎ | Invention |
| 107 | 7 | — | FL-8 | ◎ | ◎ | Invention |
| 108 | 8 | — | FL-12 | ○ | ○ | Invention |
| 109 | 9 | — | FL-15 | ○ | ○ | Invention |
| 110 | 10 | — | FL-19 | ◎ | ◎ | Invention |
| 111 | 11 | added | — | X X | X X | Comparative |
| 112 | 12 | added | FL-2 | ○ | ○ | Invention |
| 113 | 13 | added | FL-4 | ◎ | ◎ | Invention |
| 114 | 14 | added | FL-5 | ○ | ○ | Invention |
| 115 | 15 | added | FL-6 | ◎ | ◎ | Invention |
| 116 | 16 | added | FL-8 | ◎ | ◎ | Invention |
| 117 | 17 | added | FL-12 | ○ | ○ | Invention |
| 118 | 18 | added | FL-19 | ◎ | ◎ | Invention |

Example 2

Sample Nos. 201 to 218 were prepared in a similar manner to the process in the preparation of sample Nos. 101 to 118 except that mono-dispersed polymethyl methacrylate fine particles (mean particle diameter of 8 μm) used for the antihalation layer were added to the back surface protective layer and not to the antihalation layer. The sample was processed similar to Example 1, followed by evaluation. As a result, the samples of the present invention exhibit excellent adhesion resistance, similar to Example 1.

Example 3

<Preparations of Sample>

Samples were prepared in a similar manner to the process in the preparation of sample Nos. 201 to 218 except that in place of the fluorocarbon surfactant (F-1) and (F-2), (F-3) and (F-4) each was added in the same mass amount thereof for the coating solution for the back surface protective layer.

<Evaluation of Performance>

Results of evaluation performed similar to Example 2 reveal that the obtained samples of the present invention exhibit excellent results similar to Example 2.

Example 4

<Preparations of Sample>

Sample Nos. 301 to 308 were prepared in a similar manner to the process in the preparation of sample No. 212 of Example 2 except that the fluorocarbon polymer described in Table 6 was added instead of five-component latex (methyl methacrylate/styrene/butyl acrylate/hydroxyethyl methacrylate/acrylic acid copolymer latex, mass ratio of the copolymerization of 57/8/28/5/2) added into the coating solution for the second layer of the surface protective layers disposed on the side having thereon the image forming layer.

<Evaluation of Performance>

Results of evaluation performed similar to Example 1 are shown in Table 6. From the results shown in Table 6, it is understood that by utilizing the fluorocarbon polymer for both the backside outermost surface and the outermost surface of image forming layer side, the samples of the present invention attain more improved adhesion resistance.

TABLE 6

| Sample No. | Coating Solution for Second Layer of Surface Protective Layers No. | Fluorocarbon Polymer Coating: Kind | Amount (mg/m$^2$) | Adhesion Resistance: Fog Portion | Dmax Portion | Note |
|---|---|---|---|---|---|---|
| 212 | 12 | — | — | ○ | ○ | Invention |
| 301 | 31 | FL-1 | 200 | ◎ | ◎ | Invention |
| 302 | 32 | FL-2 | 200 | ◎ | ◎ | Invention |
| 303 | 33 | FL-4 | 200 | ◎ | ◎ | Invention |
| 304 | 34 | FL-5 | 200 | ◎ | ◎ | Invention |
| 305 | 35 | FL-6 | 200 | ◎ | ◎ | Invention |
| 306 | 36 | FL-8 | 200 | ◎ | ◎ | Invention |
| 307 | 37 | FL-12 | 200 | ◎ | ◎ | Invention |
| 308 | 38 | FL-15 | 200 | ◎ | ◎ | Invention |

Example 5

<Preparations of Sample>

Sample Nos. 401 to 413 were prepared in a similar manner in that of the preparation of coating solution for a back surface protective layer in Experiment 1 except that the liquid paraffin, the fluorocarbon surfactant and the fluorocarbon polymer were changed as disclosed in Table 7.

<Evaluation and Results>

The obtained sample was cut into 5000 sheets of a half-cut size (43 cm in length×35 cm 1) Exposure and Thermal Development The 5000 sheets were continuously exposed and thermally developed at a condition of 14 seconds in total with 3 plate heaters set to 107° C.-121° C.-121° C.) with Fuji Medical Dry Laser Imager DRYPIX 7000 (equipped with 660 nm laser diode having a maximum output of 50 mW (IIIB)).

2) Evaluation of Contamination of Plate Heater and Transportability

After thermal developing of 5000 sheets, the contamination of the plate heater was observed visually, and estimated as ○ in a case of having no contamination, Δ in a case of having a small contamination, and x in a case of having a significant contamination.

The transportability was evaluated by counting of sheets jammed during transporting 5000 sheets, and estimated as ○ in a case of no jamming, Δ in a case of jamming at 1 to 5 sheets, and x in a case of jamming 6 to 10 sheets and xx in a case of jamming 10 sheets or more.

The obtained results were shown in Table 7.

Sample Nos. 401 and 402 were inferior in the transportability. Sample No. 403 was good in the transportability, but showed a significant contamination. Sample No. 404, which contained both of a liquid paraffin and a fluorocarbon surfactant was also good in the transportability, but showed a significant contamination. On the other hand, sample Nos. 405 to 413 of the invention, which contained the fluorocarbon polymer, provided an excellent transportability and showed no contamination of plate heater.

TABLE 7

| Sample No. | Fluorocarbon Surface Active Agent/ Addition Amount | Liquid Paraffin/ Addition Amount | Fluorocarbon Polymer | Transportability | Contamination | Remarks |
|---|---|---|---|---|---|---|
| 401 | — | — | — | X | ○ | Comparative |
| 402 | F-1/20 mg/m$^2$<br>F-2/20 mg/m$^2$ | — | — | X | ○ | Comparative |
| 403 | — | 64 mg/m$^2$ — | — | ○ | X | Comparative |
| 404 | F-1/20 mg/m$^2$<br>F-2/20 mg/m$^2$ | 64 mg/m$^2$ | — | ○ | X | Comparative |
| 405 | — | — | F-1 | ○ | ○ | Invention |
| 406 | — | — | F-2 | ○ | ○ | Invention |
| 407 | — | — | F-4 | ○ | ○ | Invention |
| 408 | — | — | F-6 | ○ | ○ | Invention |
| 409 | — | — | F-12 | ○ | ○ | Invention |
| 410 | F-1/20 mg/m$^2$<br>F-2/20 mg/m$^2$ | — | F-1 | ○ | ○ | Invention |
| 411 | F-1/20 mg/m$^2$<br>F-2/20 mg/m$^2$ | — | F-2 | ○ | ○ | Invention |
| 412 | F-1/20 mg/m$^2$<br>F-2/20 mg/m$^2$ | — | F-6 | ○ | ○ | Invention |
| 413 | F-1/20 mg/m$^2$<br>F-2/20 mg/m$^2$ | — | F-12 | ○ | ○ | Invention |

What is claimed is:

1. A photothermographic material comprising:

a support;

an image forming layer which is disposed on the support and comprises at least a photosensitive silver halide, a non-photosensitive organic silver salt, a reducing agent, and a binder;

at least one non-photosensitive layer which is disposed on the same side of the support as the image forming layer and farther from the support than the image forming layer; and a back layer which comprises at least another non-photosensitive layer and is disposed on the opposite side of the support from the image forming layer, wherein the back layer contains a fluorocarbon polymer latex having a monomer component represented by the following (M2) and a monomer component represented by the following (M1):

(M2) a monomer containing a fluorine atom and having an unsaturated bond capable of radical polymerization;

(M1) a monomer having a group capable of forming a salt or a poly(alkylene oxide) group and having an unsaturated bond capable of radical polymerization.

2. The photothermographic material according to claim 1, wherein the fluorocarbon polymer comprises from 80% by weight to 99.9% by weight of the monomer component represented by (M2) and from 0.1% by weight to 20% by weight of the monomer component represented by (M1).

3. The photothermographic material according to claim 1, wherein the fluorocarbon polymer further has a monomer component (M3) having an unsaturated bond capable of radical polymerization which is different from either of(M2) and (M1).

4. The photothermographic material according to claim 3, wherein the fluorocarbon polymer comprises from 0.1% by weight to 20% by weight of the monomer component represented by (M1), from 5% by weight to 99% by weight of the monomer component represented by (M2), and from 0.5% by weight to 95% by weight of the monomer component represented by (M3) having an unsaturated bond capable of radical polymerization which is different from either of (M2) and (M1).

5. The photothermographic material according to claim 1, wherein the monomer component represented by (M2) is selected from the group consisting of a fluorine atom-containing acrylate, a derivative thereof, a fluorine atom-containing methacrylate, and a derivative thereof.

6. The photothermographic material according to claim 5, wherein the monomer component represented by (M2) is a monomer component represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 to 41 fluorine atoms; p represents an integer of 1 or 2; L represents a linking group containing 1 to 12 carbon atoms; and R represents a hydrogen atom or a methyl group.

7. The photothermographic material according to claim 6, wherein the fluorocarbon polymer comprises 5% by weight or more of the monomer component represented by formula (P).

8. The photothermographic material according to claim 1, wherein the back layer further contains a matting agent.

9. The photothermographic material according to claim 8, wherein a mean particle size of the matting agent is from 0.5 μm to 10 μm.

10. The photothermographic material according to claim 1, wherein the back layer further contains a fluorocarbon surfactant.

11. The photothermographic material according to claim 10, wherein the fluorocarbon surfactant is a compound which has a fluoroalkyl group having 2 or more carbon atoms and 12 or fewer fluorine atoms.

12. The photothermographic material according to claim 1, wherein the non-photosensitive layer, which is disposed on the same side of the support as the image forming layer and farther from the support than the image forming layer, contains the fluorocarbon polymer having the monomer component represented by (M2).

13. The photothermographic material according to claim 12, wherein the fluorocarbon polymer is a latex polymer.

14. The photothermographic material according to claim 12, wherein the non-photosensitive layer, which is disposed on the same side of the support as the image forming layer and farther from the support than the image forming layer, further contains a matting agent.

15. The photothermographic material according to claim 1, wherein the non-photosensitive layer, which is disposed on the same side of the support as the image forming layer and farther from the support than the image forming layer, contains a fluorocarbon surfactant.

16. The photothermographic material according to claim 15, wherein the fluorocarbon surfactant is a compound which has a fluoroalkyl group having 2 or more carbon atoms and 12 or fewer fluorine atoms.

17. An image forming method comprising at least an imagewise exposing and a thermal developing the photothermographic material according to claim 1, wherein the image forming method comprises contacting the imagewise exposed photothermographic material with a heating means at a back surface of the photothermographic material during the thermal developing.

18. An image forming method according to claim 17, wherein the heating means comprises a plate heater.

19. An image forming method according to claim 17, wherein the image forming method uses a thermal developing apparatus having an imagewise exposing part and a thermal developing part, wherein a top part of the photothermographic material is exposed and thermal development of the exposed part is started before exposure of the end part of the photothermographic material has completed.

* * * * *